US009708104B2

(12) United States Patent
Lyzenga et al.

(10) Patent No.: US 9,708,104 B2
(45) Date of Patent: Jul. 18, 2017

(54) RECLOSABLE FLEXIBLE PACKAGING AND METHODS FOR MANUFACTURING SAME

(75) Inventors: Deborah A. Lyzenga, Long Valley, NJ (US); Jeffrey T. Weber, Lake Zurich, IL (US); Paul E. Doll, Madison, WI (US); Louis P. Fenech, East Hanover, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 156 days.

(21) Appl. No.: 13/698,568

(22) PCT Filed: May 18, 2011

(86) PCT No.: PCT/US2011/037054

§ 371 (c)(1),
(2), (4) Date: Feb. 4, 2013

(87) PCT Pub. No.: WO2011/146658

PCT Pub. Date: Nov. 24, 2011

(65) Prior Publication Data

US 2013/0121624 A1 May 16, 2013

Related U.S. Application Data

(60) Provisional application No. 61/345,778, filed on May 18, 2010, provisional application No. 61/345,785,
(Continued)

(51) Int. Cl.
*B65D 33/00* (2006.01)
*B65D 65/26* (2006.01)
(Continued)

(52) U.S. Cl.
CPC ..... *B65D 33/00* (2013.01); *B31B 25/00* (2013.01); *B65B 5/00* (2013.01); *B65B 9/067* (2013.01);
(Continued)

(58) Field of Classification Search
CPC ..... B65D 75/5838; B56D 75/5838; B56D 75/5855
(Continued)

(56) References Cited

U.S. PATENT DOCUMENTS 401,974 A 4/1889 Smith
811,092 A 1/1906 Roberts
(Continued)

FOREIGN PATENT DOCUMENTS

AU 768679 6/2001
BR 55008852 11/2001
(Continued)

OTHER PUBLICATIONS

English Translation of Japanese Unexamined Application Publication No. H9-156677, published Jul. 17, 1997; 6 pages.
(Continued)

*Primary Examiner* — Derek Battisti
(74) *Attorney, Agent, or Firm* — Fitch, Even, Tabin & Flannery LLP

(57) ABSTRACT

Flexible film packages having a partial, initial seal against ambient atmosphere and are easily openable and reclosable. The flexible film packages are generally resealable to extend the shelf-life or freshness of products contained therein once the package is initially opened. By one approach, the flexible film has two opposing edge portions that meet to form a longitudinal seal extending from a first end seal to a second end seal. The flexible film may have a score that defines a package opening. An elongated closure layer (14) may extend over the score and may extend from a first end seal (26) to a second end seal (28) and within the opposing edge portions that form the longitudinal seal (24). The elongated closure layer may have a tack-free gripping portion (40)
(Continued)

used to release at least a portion of the elongated closure from the flexible film to form the package opening.

35 Claims, 39 Drawing Sheets

Related U.S. Application Data filed on May 18, 2010, provisional application No. 61/453,872, filed on Mar. 17, 2011.

(51) Int. Cl.

| | |
|---|---|
| ***B65B 9/067*** | (2012.01) |
| ***B65B 23/10*** | (2006.01) |
| ***B65B 61/02*** | (2006.01) |
| ***B65B 61/18*** | (2006.01) |
| ***B65D 75/58*** | (2006.01) |
| ***B31B 25/00*** | (2006.01) |
| ***B65B 5/00*** | (2006.01) |

(52) U.S. Cl.
CPC ..... *B65B 23/10* (2013.01); *B65B 61/02* (2013.01); *B65B 61/184* (2013.01); *B65D 75/5838* (2013.01); *B65D 75/5855* (2013.01); *Y10T 428/15* (2015.01)

(58) Field of Classification Search
USPC ..... 383/203, 207, 210, 210.1, 211
See application file for complete search history.

(56) References Cited

U.S. PATENT DOCUMENTS 1,065,012 A 6/1913 Watanabe
1,106,721 A 8/1914 Lewis
1,171,462 A 2/1916 Rice
1,791,352 A 2/1931 Pascual
1,915,503 A 6/1933 Schmidt
1,949,161 A 2/1934 Haug
1,963,639 A 6/1934 Ahlquist
1,978,035 A 10/1934 Thom
2,033,550 A 3/1936 Rosen
2,034,007 A 3/1936 Smith
2,066,495 A 1/1937 Swift
2,079,328 A 5/1937 McBean
2,128,196 A 8/1938 Max
2,248,578 A 7/1941 Moore
2,260,064 A 10/1941 Stokes
2,320,143 A 5/1943 Johnson
2,321,042 A 6/1943 Preis
2,330,015 A 9/1943 Stokes
2,475,236 A 7/1949 Matthew
2,554,160 A 5/1951 Von
2,605,897 A 8/1952 Rundle
2,621,788 A 12/1952 Hitchcock
2,684,807 A 7/1954 Gerrish
2,719,647 A 10/1955 Freeman
2,823,795 A 2/1958 Moore
2,965,224 A 12/1960 Harwood
3,070,102 A * 12/1962 MacDonald ..... 15/104.94
3,080,238 A 3/1963 Howard
3,127,273 A 3/1964 Monahan
3,179,326 A 4/1965 Underwood
3,186,628 A 6/1965 Rohde
3,187,982 A 6/1965 Underwood
3,217,871 A 11/1965 Lee
3,235,165 A 2/1966 Jackson
3,245,525 A 4/1966 Shoemaker
3,259,303 A 7/1966 Repko
3,260,358 A 7/1966 Gottily
3,272,422 A 9/1966 Miller
3,291,377 A 12/1966 Eggen
3,298,505 A 1/1967 Stephenson
3,311,032 A 3/1967 Lucas
3,326,450 A 6/1967 Langdon
3,331,501 A 7/1967 Stewart
3,343,541 A 9/1967 Bellamy
3,373,922 A 3/1968 Watts
3,373,926 A 3/1968 Voigtman
3,454,210 A * 7/1969 Spiegel ..... B65D 75/30 229/123.1
3,471,005 A 10/1969 Sexstone
3,520,401 A 7/1970 Richter
3,528,825 A 9/1970 Doughty
3,570,751 A 3/1971 Trewella
3,595,466 A 7/1971 Rosenburg
3,595,468 A 7/1971 Repko
3,618,751 A 11/1971 Rich
3,630,346 A 12/1971 Burnside
3,651,615 A 3/1972 Bohner
3,653,502 A 4/1972 Beaudoin
3,685,720 A 8/1972 Brady
3,687,352 A 8/1972 Kalajian
3,740,238 A 6/1973 Graham
3,757,078 A 9/1973 Conti
3,790,744 A 2/1974 Bowen
3,811,564 A 5/1974 Braber
3,865,302 A 2/1975 Kane
3,885,727 A 5/1975 Gilley
3,905,646 A 9/1975 Brackmann
3,909,582 A 9/1975 Bowen
3,910,410 A 10/1975 Shaw
3,938,659 A 2/1976 Wardwell
3,966,046 A 6/1976 Deutschlander
3,971,506 A 7/1976 Roenna
3,979,050 A 9/1976 Cilia
4,082,216 A 4/1978 Clarke
4,113,104 A 9/1978 Meyers
4,140,046 A 2/1979 Marbach
4,143,695 A 3/1979 Hoehn
4,156,493 A 5/1979 Julius
4,185,754 A 1/1980 Julius
4,192,420 A 3/1980 Ross
4,192,448 A 3/1980 Porth
4,197,949 A 4/1980 Carlsson
4,210,246 A 7/1980 Kuchenbecker
4,258,876 A 3/1981 Ljungcrantz
4,260,061 A 4/1981 Jacobs
4,273,815 A 6/1981 Gifford
4,285,681 A 8/1981 Walitalo
4,306,367 A 12/1981 Otto
4,337,862 A 7/1982 Suter
4,364,478 A 12/1982 Tuens
4,397,415 A 8/1983 Lisiecki
4,411,365 A 10/1983 Horikawa
4,420,080 A * 12/1983 Nakamura ..... 206/449
4,428,477 A 1/1984 Cristofolo
4,460,088 A 7/1984 Rugenstein
4,464,154 A 8/1984 Ljungcrantz
4,488,647 A 12/1984 Davis
4,506,488 A 3/1985 Matt et al.
4,518,087 A 5/1985 Goglio
4,538,396 A 9/1985 Nakamura
4,545,844 A 10/1985 Buchanan
4,548,824 A 10/1985 Mitchell
4,548,852 A 10/1985 Mitchell
4,549,063 A 10/1985 Ang
4,550,831 A 11/1985 Whitford
4,552,269 A * 11/1985 Chang ..... 383/211
4,557,505 A 12/1985 Schaefer
4,570,820 A 2/1986 Murphy
4,572,377 A 2/1986 Beckett
4,589,943 A 5/1986 Kimball
4,608,288 A 8/1986 Spindler
4,610,357 A * 9/1986 Nakamura ..... 206/449
4,613,046 A 9/1986 Kuchenbecker
4,616,470 A 10/1986 Nakamura
4,625,495 A 12/1986 Holovach
4,632,299 A 12/1986 Holmberg
4,638,911 A 1/1987 Prohaska
4,648,509 A 3/1987 Alves
4,651,874 A 3/1987 Nakamura

(56) References Cited

U.S. PATENT DOCUMENTS 4,653,250 A 3/1987 Nakamura
4,658,963 A 4/1987 Jud
4,667,453 A 5/1987 Goglio
4,671,453 A 6/1987 Cassidy
4,673,085 A 6/1987 Badouard
4,679,693 A 7/1987 Forman
4,694,960 A 9/1987 Phipps
4,696,404 A 9/1987 Corella
4,709,399 A 11/1987 Sanders
4,723,301 A 2/1988 Chang
4,738,365 A 4/1988 Prater
4,739,879 A 4/1988 Nakamura
4,770,325 A 9/1988 Gordon
4,784,885 A 11/1988 Carespodi
4,786,355 A 11/1988 Kontz
4,790,436 A 12/1988 Nakamura
4,798,295 A 1/1989 Rausing
4,798,296 A 1/1989 Lagerstedt
4,799,594 A 1/1989 Blackman
4,811,848 A 3/1989 Jud
4,818,120 A 4/1989 Addiego
4,838,429 A 6/1989 Fabisiewicz
4,840,270 A 6/1989 Caputo
4,845,470 A 7/1989 Boldt
4,848,575 A 7/1989 Nakamura
4,858,780 A 8/1989 Odaka
4,863,064 A 9/1989 Dailey
4,865,198 A 9/1989 Butler
4,866,911 A 9/1989 Grindrod
4,874,096 A 10/1989 Tessera-Chiesa
4,876,123 A 10/1989 Rivera
4,889,731 A 12/1989 Williams
4,901,505 A 2/1990 McLeod
4,902,142 A 2/1990 Lammert
4,917,247 A 4/1990 Jud
4,943,439 A 7/1990 Andreas
4,972,953 A 11/1990 Friedman
4,998,666 A 3/1991 Ewan
4,999,081 A 3/1991 Buchanan
5,000,320 A 3/1991 Kuchenbecker
5,001,325 A 3/1991 Huizinga
5,005,264 A 4/1991 Breen
5,010,231 A 4/1991 Huizinga
5,018,625 A 5/1991 Focke
5,029,712 A 7/1991 Obrien
5,040,685 A 8/1991 Focke
5,046,621 A 9/1991 Bell
5,048,718 A 9/1991 Nakamura
5,054,619 A 10/1991 Muckenfuhs
5,060,848 A 10/1991 Ewan
5,065,868 A 11/1991 Cornelissen
5,076,439 A 12/1991 Kuchenbecker
5,077,064 A 12/1991 Hustad
5,078,509 A 1/1992 Center
5,082,702 A 1/1992 Alband
5,085,724 A 2/1992 Focke
5,096,113 A 3/1992 Focke
5,100,003 A 3/1992 Jud
5,103,980 A 4/1992 Kuchenbecker
5,108,669 A 4/1992 van Dijk et al.
5,124,388 A 6/1992 Pruett
5,125,211 A 6/1992 OBrien
5,134,001 A 7/1992 Osgood
5,158,499 A 10/1992 Guckenberger
5,161,350 A 11/1992 Nakamura
5,167,455 A 12/1992 Forman
5,167,974 A 12/1992 Grindrod
5,174,659 A 12/1992 Laske
5,184,771 A 2/1993 Jud
5,190,152 A 3/1993 Smith
5,197,618 A 3/1993 Goth
5,222,422 A 6/1993 Benner
5,222,813 A 6/1993 Kopp
5,229,180 A 7/1993 Littmann
5,294,470 A 3/1994 Ewan
5,307,988 A 5/1994 Focke
5,310,262 A 5/1994 Robison
5,333,735 A 8/1994 Focke
5,344,007 A 9/1994 Nakamura
5,352,466 A 10/1994 Delonis
5,356,068 A 10/1994 Moreno
5,366,087 A 11/1994 Bane
5,371,997 A 12/1994 Kopp
5,374,179 A 12/1994 Swanson
5,375,698 A 12/1994 Ewart
5,381,643 A 1/1995 Kazaitis
5,382,190 A 1/1995 Graves
5,388,757 A 2/1995 Lorenzen
5,405,629 A 4/1995 Marnocha
5,407,070 A 4/1995 Bascos
5,409,115 A 4/1995 Barkhorn
5,409,116 A 4/1995 Aronsen
5,439,102 A 8/1995 Brown
5,454,207 A 10/1995 Storandt
5,460,838 A * 10/1995 Wermund ..... 426/106
5,460,844 A 10/1995 Gaylor
5,461,845 A 10/1995 Yeager
5,464,092 A 11/1995 Seeley
5,470,015 A 11/1995 Jud
5,489,060 A 2/1996 Godard
5,499,757 A 3/1996 Back
5,503,858 A 4/1996 Reskow
5,505,305 A 4/1996 Scholz
5,515,965 A 5/1996 Boldrini
5,519,982 A 5/1996 Herber
5,520,939 A 5/1996 Wells
5,524,759 A 6/1996 Herzberg
5,531,325 A 7/1996 Deflander
5,538,129 A 7/1996 Chester
5,550,346 A 8/1996 Andriash
5,558,438 A 9/1996 Warr
5,582,342 A 12/1996 Jud
5,582,853 A 12/1996 Marnocha
5,582,887 A 12/1996 Etheredge
5,591,468 A 1/1997 Stockley
5,630,308 A 5/1997 Guckenberger
5,633,058 A 5/1997 Hoffer
5,636,732 A 6/1997 Gilels
5,637,369 A 6/1997 Stewart
5,647,100 A 7/1997 Porchia
5,647,506 A 7/1997 Julius
5,664,677 A 9/1997 Oconnor
5,672,224 A 9/1997 Kaufmann
5,688,394 A 11/1997 McBride
5,688,463 A 11/1997 Robichaud
5,702,743 A 12/1997 Wells
5,709,479 A 1/1998 Bell
5,725,311 A 3/1998 Ponsi
D394,204 S 5/1998 Seddon
D394,605 S 5/1998 Skiba
5,749,657 A 5/1998 May
5,770,283 A 6/1998 Gosselin
5,791,465 A 8/1998 Niki
5,795,604 A 8/1998 Wells
5,819,931 A 10/1998 Boucher
5,820,953 A 10/1998 Beer
5,833,368 A 11/1998 Kaufman
5,855,435 A 1/1999 Chiesa
5,862,101 A 1/1999 Haas
5,873,483 A 2/1999 Goertz
5,873,607 A 2/1999 Waggoner
5,882,116 A 3/1999 Backus
5,885,673 A 3/1999 Light
5,906,278 A 5/1999 Ponsi
5,908,246 A 6/1999 Arimura
5,928,749 A 7/1999 Forman
5,938,013 A 8/1999 Palumbo
5,939,156 A 8/1999 Rossi
5,945,145 A 8/1999 Narsutis
5,956,794 A 9/1999 Skiba
5,993,962 A 11/1999 Timm
5,996,797 A 12/1999 Flaig
5,997,177 A 12/1999 Kaufman
6,006,907 A 12/1999 Sato

(56) References Cited

U.S. PATENT DOCUMENTS 6,012,572 A 1/2000 Heathcock
6,015,934 A 1/2000 Lee
6,026,953 A 2/2000 Nakamura
6,028,289 A 2/2000 Robichaud
6,029,809 A 2/2000 Skiba
6,056,141 A 5/2000 Navarini
6,060,095 A 5/2000 Scrimager
6,065,591 A 5/2000 Dill
6,066,437 A 5/2000 Kosslinger
6,076,969 A 6/2000 Jaisle
6,077,551 A 6/2000 Scrimager
6,099,682 A 8/2000 Krampe
6,113,271 A * 9/2000 Scott et al. ..... 383/211
6,125,614 A 10/2000 Jones
6,126,009 A 10/2000 Shiffler
6,126,317 A 10/2000 Anderson
6,152,601 A 11/2000 Johnson
6,164,441 A * 12/2000 Guy et al. ..... 206/210
6,213,645 B1 4/2001 Beer
6,228,450 B1 5/2001 Pedrini
D447,054 S 8/2001 Hill
6,273,610 B1 8/2001 Koyama
6,279,297 B1 8/2001 Latronico
6,296,884 B1 10/2001 Okerfund
6,299,355 B1 10/2001 Schneck
6,309,104 B1 10/2001 Koch
6,309,105 B1 * 10/2001 Palumbo ..... 383/211
6,318,894 B1 11/2001 Derenthal
6,325,877 B1 12/2001 Murphy
6,352,364 B1 3/2002 Mobs
6,364,113 B1 4/2002 Faasse
6,365,255 B1 4/2002 Kittel
6,383,592 B1 5/2002 Lowry
6,402,379 B1 6/2002 Albright
6,420,006 B1 7/2002 Scott
6,427,420 B1 8/2002 Olivieri
6,428,208 B1 8/2002 Addison
6,428,867 B1 8/2002 Scott
6,446,811 B1 9/2002 Wilfong
6,450,685 B1 9/2002 Scott
6,457,585 B1 10/2002 Huffer
6,461,043 B1 10/2002 Healy
6,461,708 B1 10/2002 Dronzek
6,471,817 B1 10/2002 Emmert
6,476,743 B1 11/2002 Brown
6,482,867 B1 11/2002 Kimura
6,502,986 B1 1/2003 Bensur
6,517,243 B2 2/2003 Huffer
6,519,918 B2 2/2003 Forman et al.
6,539,691 B2 4/2003 Beer
6,554,134 B1 4/2003 Guibert
6,563,082 B2 5/2003 Terada
6,589,622 B1 7/2003 Scott
6,592,260 B1 7/2003 Randall
6,594,872 B2 7/2003 Cisek
6,612,432 B2 9/2003 Motson
6,616,334 B2 9/2003 Faaborg
6,621,046 B2 9/2003 Kaji
6,669,046 B1 12/2003 Sawada
6,691,886 B1 2/2004 Berndt
6,698,928 B2 3/2004 Miller
6,726,054 B2 4/2004 Fagen
6,726,364 B2 4/2004 Perell
6,746,743 B2 6/2004 Knoerzer
6,750,423 B2 6/2004 Tanaka
6,767,604 B2 7/2004 Muir
6,815,634 B2 11/2004 Sonoda
6,852,947 B2 2/2005 Tanaka
6,865,860 B2 3/2005 Arakawa
6,889,483 B2 5/2005 Compton
6,918,532 B2 7/2005 Sierra-Gomez
6,929,400 B2 8/2005 Razeti
6,932,135 B2 8/2005 Tabuchi
6,945,400 B2 9/2005 Bolnick
6,951,999 B2 10/2005 Monforton
6,969,196 B2 11/2005 Woodham
6,983,875 B2 1/2006 Emmott
7,007,423 B2 3/2006 Andersson
7,018,502 B2 3/2006 Treleaven
7,021,827 B2 4/2006 Compton
7,032,754 B2 4/2006 Kopecky
7,032,757 B2 4/2006 Richards
7,032,810 B2 4/2006 Benedetti et al.
7,040,810 B2 5/2006 Steele
7,048,441 B2 5/2006 Pape
7,051,877 B2 5/2006 Lin
7,165,888 B2 1/2007 Rodick
7,172,779 B2 2/2007 Castellanos
7,207,718 B2 4/2007 Machacek
7,207,719 B2 4/2007 Marbler
7,213,710 B2 5/2007 Cotert
7,228,968 B1 6/2007 Burgess
7,254,873 B2 8/2007 Stolmeier
7,261,468 B2 8/2007 Schneider
7,262,335 B2 8/2007 Motsch
7,302,783 B2 12/2007 Cotert
7,350,688 B2 4/2008 Sierra-Gomez
7,351,458 B2 4/2008 Leighton
7,352,591 B2 4/2008 Sugahara
7,404,487 B2 7/2008 Kumakura
7,416,768 B2 8/2008 Knoerzer
7,422,142 B2 9/2008 Arippol
7,470,062 B2 12/2008 Moteki
7,475,781 B2 1/2009 Kobayashi
7,516,599 B2 4/2009 Doll
5,826,101 A1 5/2009 Aldridge
7,527,189 B2 5/2009 Billig
7,533,773 B2 5/2009 Aldridge
7,600,641 B2 10/2009 Burgess
7,703,602 B2 4/2010 Saito
7,708,463 B2 5/2010 Sampaio Camacho
7,717,620 B2 5/2010 Hebert
7,740,923 B2 6/2010 Exner
7,758,484 B2 7/2010 Peterson
7,858,901 B2 12/2010 Krishnan
2,588,409 A1 7/2011 Aldridge
7,971,718 B2 7/2011 Aldridge
8,002,171 B2 8/2011 Ryan
8,002,941 B2 8/2011 Exner
8,029,428 B2 10/2011 Selle
8,038,349 B2 10/2011 Andersson
8,181,784 B2 5/2012 Bouthiette
8,240,546 B2 8/2012 Friebe
8,262,830 B2 9/2012 Hebert
8,262,832 B2 9/2012 Hebert
8,273,434 B2 9/2012 Zietlow
8,506,165 B2 8/2013 Shinozaki
8,540,839 B2 9/2013 Zietlow
8,544,519 B2 10/2013 Ikeda
8,763,890 B2 7/2014 Clark
8,920,030 B2 12/2014 McSweeney
8,951,591 B2 2/2015 Vogt
8,986,803 B2 3/2015 Yoshida
8,999,100 B2 4/2015 Carmichael
2001/0000480 A1 4/2001 Stagg
2002/0000441 A1 1/2002 Redmond
2002/0068668 A1 6/2002 Chow
2003/0019780 A1 1/2003 Parodi
2003/0039412 A1 2/2003 Rodick
2003/0047695 A1 3/2003 Zik
2003/0051440 A1 3/2003 Chow
2003/0053720 A1 3/2003 Smith
2003/0118255 A1 * 6/2003 Miller ..... 383/205
2003/0127352 A1 7/2003 Buschkiel
2003/0170357 A1 9/2003 Garwood
2003/0183637 A1 10/2003 Zappa
2003/0183643 A1 10/2003 Fagen
2003/0210838 A1 11/2003 Steele
2003/0217946 A1 11/2003 Hsu
2003/0223656 A1 12/2003 Razeti
2004/0011677 A1 1/2004 Arakawa
2004/0035719 A1 2/2004 Ebbers
2004/0060974 A1 4/2004 Dacey
2004/0062838 A1 4/2004 Castellanos

(56) References Cited

U.S. PATENT DOCUMENTS

| | | | | |
|---|---|---|---|---|
| 2004/0067326 | A1 | 4/2004 | Knoerzer | |
| 2004/0083680 | A1 | 5/2004 | Compton | |
| 2004/0091184 | A1 | 5/2004 | Miller | |
| 2004/0112010 | A1 | 6/2004 | Richards | |
| 2004/0112771 | A1 | 6/2004 | Bailey | |
| 2004/0141664 | A1* | 7/2004 | Olsen et al. | 383/66 |
| 2004/0150221 | A1 | 8/2004 | Brown | |
| 2004/0175060 | A1 | 9/2004 | Woodham | |
| 2004/0180118 | A1 | 9/2004 | Renger | |
| 2004/0206637 | A1 | 10/2004 | Sierra-Gomez | |
| 2005/0000965 | A1 | 1/2005 | Boardman | |
| 2005/0031233 | A1 | 2/2005 | Varanese | |
| 2005/0084186 | A1 | 4/2005 | Caris | |
| 2005/0116016 | A1 | 6/2005 | Lo Duca | |
| 2005/0117819 | A1 | 6/2005 | Kingsford | |
| 2005/0220371 | A1 | 10/2005 | Machacek | |
| 2005/0247764 | A1 | 11/2005 | Sierra-Gomez | |
| 2005/0276885 | A1 | 12/2005 | Bennett | |
| 2006/0018569 | A1* | 1/2006 | Bonenfant | 383/5 |
| 2006/0066096 | A1 | 3/2006 | Kan | |
| 2006/0124494 | A1 | 6/2006 | Clark | |
| 2006/0144911 | A1 | 7/2006 | Sierra-Gomez | |
| 2006/0171611 | A1 | 8/2006 | Rapparini | |
| 2006/0199717 | A1 | 9/2006 | Marbler | |
| 2006/0251342 | A1 | 11/2006 | Forman | |
| 2006/0257056 | A1 | 11/2006 | Miyake | |
| 2006/0257599 | A1 | 11/2006 | Exner | |
| 2006/0283750 | A1 | 12/2006 | Villars | |
| 2006/0285779 | A1 | 12/2006 | Golas | |
| 2007/0023435 | A1 | 2/2007 | Sierra-Gomez | |
| 2007/0023436 | A1 | 2/2007 | Sierra-Gomez | |
| 2007/0095709 | A1 | 5/2007 | Saito | |
| 2007/0116388 | A1 | 5/2007 | Kuge | |
| 2007/0140600 | A1 | 6/2007 | Nowak | |
| 2007/0209959 | A1* | 9/2007 | Burgess | 206/494 |
| 2007/0269142 | A1 | 11/2007 | Tyska | |
| 2007/0275133 | A1 | 11/2007 | Sierra-Gomez | |
| 2008/0013869 | A1* | 1/2008 | Forman | 383/210 |
| 2008/0031555 | A1 | 2/2008 | Roberts | |
| 2008/0034713 | A1 | 2/2008 | Kohl | |
| 2008/0037911 | A1 | 2/2008 | Cole | |
| 2008/0041750 | A1 | 2/2008 | Kohlweyer | |
| 2008/0053861 | A1 | 3/2008 | Mellin | |
| 2008/0060751 | A1 | 3/2008 | Arrindell | |
| 2008/0063324 | A1 | 3/2008 | Bernard | |
| 2008/0063759 | A1 | 3/2008 | Raymond | |
| 2008/0063760 | A1 | 3/2008 | Raymond | |
| 2008/0101733 | A1 | 5/2008 | Fenn-Barrabass | |
| 2008/0131035 | A1 | 6/2008 | Rogers | |
| 2008/0135428 | A1 | 6/2008 | Tallier | |
| 2008/0152264 | A1 | 6/2008 | Pokusa | |
| 2008/0156861 | A1 | 7/2008 | Sierra-Gomez | |
| 2008/0159666 | A1 | 7/2008 | Exner | |
| 2008/0199109 | A1 | 8/2008 | Rutzinger | |
| 2008/0203141 | A1 | 8/2008 | Friebe | |
| 2008/0214376 | A1 | 9/2008 | Bonenfant | |
| 2008/0220227 | A1 | 9/2008 | Keeney | |
| 2008/0240627 | A1 | 10/2008 | Cole | |
| 2008/0273821 | A1 | 11/2008 | Doll | |
| 2008/0292225 | A1 | 11/2008 | Dayrit | |
| 2009/0001143 | A1 | 1/2009 | Cowan | |
| 2009/0014491 | A1 | 1/2009 | Fuisz | |
| 2009/0022431 | A1 | 1/2009 | Conner | |
| 2009/0028472 | A1 | 1/2009 | Andersson | |
| 2009/0053372 | A1 | 2/2009 | Harnbrick | |
| 2009/0074333 | A1 | 3/2009 | Griebel | |
| 2009/0097786 | A1 | 4/2009 | Goglio | |
| 2009/0161995 | A1 | 6/2009 | Henderson | |
| 2009/0190866 | A1 | 7/2009 | Hughes | |
| 2009/0211938 | A1 | 8/2009 | Aldridge | |
| 2009/0226117 | A1 | 9/2009 | Davis | |
| 2009/0232425 | A1 | 9/2009 | Tai | |
| 2009/0273179 | A1 | 11/2009 | Scott | |
| 2009/0301903 | A1 | 12/2009 | Andersson | |
| 2010/0002963 | A1 | 1/2010 | Holbert | |
| 2010/0018974 | A1 | 1/2010 | Lyzenga | |
| 2010/0019022 | A1 | 1/2010 | Ryan | |
| 2010/0111453 | A1 | 5/2010 | Dierl | |
| 2010/0147724 | A1 | 6/2010 | Mitra-Shah | |
| 2010/0172604 | A1 | 7/2010 | Andersson | |
| 2010/0226598 | A1 | 9/2010 | Stoeppelmann | |
| 2010/0230303 | A1 | 9/2010 | Buse | |
| 2010/0230411 | A9 | 9/2010 | Sierra-Gomez | |
| 2010/0278454 | A1 | 11/2010 | Huffer | |
| 2010/0303391 | A9 | 12/2010 | Cole | |
| 2011/0049158 | A1 | 3/2011 | Bouthiette | |
| 2011/0058755 | A1 | 3/2011 | Guibert | |
| 2011/0127319 | A1 | 6/2011 | Golden | |
| 2011/0132976 | A1 | 6/2011 | Drenowski | |
| 2011/0147443 | A1 | 6/2011 | Igo | |
| 2011/0204056 | A1 | 8/2011 | Veternik et al. | |
| 2011/0253718 | A1 | 10/2011 | Sierra-Gomez et al. | |
| 2012/0125932 | A1 | 5/2012 | Sierra-Gomez | |
| 2012/0128835 | A1 | 5/2012 | Lyzenga | |
| 2012/0177307 | A1 | 7/2012 | Duan | |
| 2013/0004626 | A1 | 1/2013 | Renders et al. | |
| 2013/0011527 | A1 | 1/2013 | Renders | |
| 2013/0064477 | A1 | 3/2013 | Vogt | |
| 2013/0064934 | A1 | 3/2013 | Vogt | |
| 2013/0114918 | A1 | 5/2013 | Lyzenga | |
| 2013/0121623 | A1 | 5/2013 | Lyzenga | |
| 2013/0205964 | A1 | 8/2013 | Matsushita | |
| 2013/0270268 | A1 | 10/2013 | Lyzenga | |
| 2014/0185965 | A1 | 7/2014 | Lyzenga | |
| 2014/0270597 | A1 | 9/2014 | Friedman | |
| 2014/0314339 | A1 | 10/2014 | Docherty | |
| 2015/0016756 | A1 | 1/2015 | Down | |
| 2015/0021219 | A1 | 1/2015 | SeyfferthDeOliveira | |

FOREIGN PATENT DOCUMENTS

| | | | |
|---|---|---|---|
| BR | 62020307 | | 4/2003 |
| BR | 68046367 | | 10/2009 |
| CN | 1224396 | A | 7/1999 |
| CN | 1781819 | A | 6/2006 |
| DE | 1848870 | | 3/1962 |
| DE | 3700988 | A1 | 7/1988 |
| DE | 3835721 | A1 | 5/1990 |
| DE | 9003401 | | 5/1990 |
| DE | 9005297 | | 8/1990 |
| DE | 9014065 | | 2/1991 |
| DE | 4134567 | | 1/1993 |
| DE | 4241423 | | 6/1994 |
| DE | 19738411 | | 3/1999 |
| DE | 19822328 | A1 | 11/1999 |
| DE | 202004012301 | | 12/2004 |
| DE | 20122333 | | 3/2005 |
| DE | 202007005487 | | 6/2007 |
| DE | 102007030267 | A1 | 1/2009 |
| DE | 102010019867 | A1 | 9/2011 |
| EP | 0085289 | | 8/1983 |
| EP | 0307924 | A2 | 3/1989 |
| EP | 0388310 | | 9/1990 |
| EP | 408831 | A1 | 1/1991 |
| EP | 0447636 | | 9/1991 |
| EP | 0474981 | | 3/1992 |
| EP | 0488967 | | 6/1992 |
| EP | 0546369 | | 6/1993 |
| EP | 0608909 | | 8/1994 |
| EP | 0613824 | | 9/1994 |
| EP | 0629561 | A2 | 12/1994 |
| EP | 0661154 | | 7/1995 |
| EP | 0669204 | B2 | 8/1995 |
| EP | 0744357 | | 11/1996 |
| EP | 0752375 | | 1/1997 |
| EP | 0758993 | | 2/1997 |
| EP | 0796208 | | 9/1997 |
| EP | 0905048 | A | 3/1999 |
| EP | 1046594 | | 10/2000 |
| EP | 1056066 | | 11/2000 |
| EP | 1086906 | A2 | 3/2001 |
| EP | 1136379 | | 9/2001 |
| EP | 1288139 | | 3/2003 |
| EP | 1318081 | A1 | 6/2003 |

(56) References Cited

FOREIGN PATENT DOCUMENTS

| | | | |
|---|---|---|---|
| EP | 1350741 | | 10/2003 |
| EP | 1375380 | A1 | 1/2004 |
| EP | 1382543 | A2 | 1/2004 |
| EP | 1437311 | A1 | 7/2004 |
| EP | 1449789 | A1 | 8/2004 |
| EP | 1457424 | | 9/2004 |
| EP | 1467929 | | 10/2004 |
| EP | 1468936 | | 10/2004 |
| EP | 1477425 | A1 | 11/2004 |
| EP | 1488936 | | 12/2004 |
| EP | 1608567 | | 12/2005 |
| EP | 1609737 | | 12/2005 |
| EP | 1619137 | A1 | 1/2006 |
| EP | 1637472 | A1 | 3/2006 |
| EP | 1351861 | | 10/2006 |
| EP | 1712468 | | 10/2006 |
| EP | 1712488 | A1 | 10/2006 |
| EP | 1755980 | | 2/2007 |
| EP | 1760006 | A1 | 3/2007 |
| EP | 1770025 | | 4/2007 |
| EP | 1846306 | | 10/2007 |
| EP | 1858776 | | 11/2007 |
| EP | 1873082 | A1 | 1/2008 |
| EP | 1908696 | | 4/2008 |
| EP | 1939107 | | 7/2008 |
| EP | 1975081 | A1 | 10/2008 |
| EP | 2033910 | | 3/2009 |
| EP | 2189506 | | 5/2010 |
| FR | 1327914 | A | 5/1963 |
| FR | 2674509 | | 10/1992 |
| FR | 2693988 | | 1/1994 |
| FR | 2766794 | | 2/1999 |
| FR | 2772009 | | 6/1999 |
| FR | 2783512 | | 3/2000 |
| GB | 1107200 | | 3/1968 |
| GB | 2171077 | | 8/1986 |
| GB | 2266513 | | 11/1993 |
| GB | 2276095 | A | 9/1994 |
| GB | 2335652 | A | 9/1999 |
| GB | 2339187 | A | 1/2000 |
| JP | 57163658 | | 10/1982 |
| JP | S5822411 | B2 | 5/1983 |
| JP | 6080405 | | 5/1985 |
| JP | 62171479 | | 10/1987 |
| JP | 63022370 | | 1/1988 |
| JP | 01167084 | A | 6/1989 |
| JP | 01226579 | A | 9/1989 |
| JP | 01267182 | A | 10/1989 |
| JP | H11343468 | | 12/1990 |
| JP | H0581083 | | 11/1993 |
| JP | 09142551 | A | 6/1997 |
| JP | 9150872 | | 6/1997 |
| JP | H09156677 | A | 6/1997 |
| JP | 10059441 | | 3/1998 |
| JP | 10129685 | | 5/1998 |
| JP | H10167355 | | 6/1998 |
| JP | H10152179 | A | 9/1998 |
| JP | H10509406 | | 9/1998 |
| JP | 10120016 | | 12/1998 |
| JP | H0444968 | | 2/1999 |
| JP | 11198977 | | 7/1999 |
| JP | 2000335542 | A | 12/2000 |
| JP | 2001114357 | | 4/2001 |
| JP | 2001301807 | | 10/2001 |
| JP | 2002002805 | A | 1/2002 |
| JP | 2002104550 | A | 4/2002 |
| JP | 200326224 | | 1/2003 |
| JP | 2003026224 | | 1/2003 |
| JP | 2003072774 | | 3/2003 |
| JP | 2003137314 | | 5/2003 |
| JP | 2005015015 | | 1/2005 |
| JP | 200602767 | | 2/2006 |
| JP | 2006062712 | | 3/2006 |
| JP | 2006137445 | A | 6/2006 |
| JP | 2006199343 | | 8/2006 |
| JP | 2007045434 | | 2/2007 |
| JP | 2008105751 | | 5/2008 |
| JP | 2009166870 | | 7/2009 |
| WO | 8606350 | | 11/1986 |
| WO | 9104920 | | 4/1991 |
| WO | 9411270 | A1 | 5/1994 |
| WO | 9424019 | A2 | 10/1994 |
| WO | 9532902 | | 12/1995 |
| WO | 9725200 | | 7/1997 |
| WO | 0061458 | A | 10/2000 |
| WO | 0064755 | | 11/2000 |
| WO | 0140073 | A1 | 6/2001 |
| WO | 02064365 | A1 | 8/2002 |
| WO | 02066341 | | 8/2002 |
| WO | 03013976 | A1 | 2/2003 |
| WO | 03035504 | | 5/2003 |
| WO | 03037727 | | 5/2003 |
| WO | 03059776 | A1 | 7/2003 |
| WO | 2004087527 | A1 | 10/2004 |
| WO | 2005054079 | | 6/2005 |
| WO | 2005056420 | | 6/2005 |
| WO | 2005110042 | | 11/2005 |
| WO | 2005110865 | | 11/2005 |
| WO | 2005110876 | | 11/2005 |
| WO | 2005110885 | A2 | 11/2005 |
| WO | 2005120989 | | 12/2005 |
| WO | 2005123535 | A1 | 12/2005 |
| WO | 2006055128 | A2 | 5/2006 |
| WO | 2006080405 | | 8/2006 |
| WO | 2006108614 | | 10/2006 |
| WO | 2007079071 | A1 | 7/2007 |
| WO | 2007090419 | | 8/2007 |
| WO | 2008051813 | | 5/2008 |
| WO | 2008062159 | A1 | 5/2008 |
| WO | 2008074060 | | 6/2008 |
| WO | 2008108969 | | 9/2008 |
| WO | 2008115693 | A1 | 9/2008 |
| WO | 2008122961 | | 10/2008 |
| WO | 2008146142 | | 12/2008 |
| WO | 2009065120 | | 5/2009 |
| WO | 2009111153 | | 9/2009 |
| WO | 2010002834 | | 1/2010 |
| WO | 2010046623 | | 4/2010 |
| WO | 2010080810 | | 7/2010 |
| WO | 2010084336 | A1 | 7/2010 |
| WO | 2010088492 | A1 | 8/2010 |
| WO | 2010114879 | A1 | 10/2010 |
| WO | 2010149996 | A1 | 12/2010 |
| WO | 2011004156 | A2 | 1/2011 |
| WO | 2011032064 | | 3/2011 |
| WO | 2011121337 | A2 | 10/2011 |
| WO | 2011123410 | | 10/2011 |
| WO | 2012036765 | | 3/2012 |
| WO | 2012098412 | | 7/2012 |

OTHER PUBLICATIONS

Kellogg's Reply Claim Construction Brief, dated Jan. 24, 2014, 19 pages.

Kellogg's Opening Claim Construction Brief, dated Dec. 13, 2013, 30 pages.

Defendants' Supplemental Memorandum of Law Regarding Additional Claim Construction Authority Requested by the Court, dated Feb. 28, 2014, 13 pages.

Kellogg's Response to Plaintiff's Surreply Claim Construction Brief Pursuant to Docket No. 98, dated Feb. 28, 2014, 9 pages.

Plaintiff Intercontinental Great Brands LLC's Submission of Authority Pursuant to Docket No. 98, dated Feb. 28, 2014, 11 pages.

Plaintiff Intercontinental Great Brands LLC's Responsive Claim Construction Brief Pursuant to LPR 4.2, dated Feb. 10, 2014, 27 pages.

U.S. District Court for the Northern District of Illinois, Eastern Division Memorandum Opinion and Order, dated Sep. 22, 2014, 12 pages.

Plaintiff Intercontinental Great Brands LLC's Surreply Claim Construction Brief Pursuant To Docket No. 98, dated Feb. 21, 2014, 6 pages.

(56) References Cited

OTHER PUBLICATIONS

Machine translation of CN 1781819A published Jun. 7, 2006 from google.com/patents; 13 pages, accessed Jun. 5, 2014.
'Cheese Range', Mintel gnpd, Jan. 26, 2001, Mintel Publishing, 1 page.
'Elite Edam Cheese', Mintel gnpd, Dec. 3, 2001, Mintel Publishing, 2 pages.
'Margin.' Merriam-Webster Online Dictionary. 2010. Merriam-Webster [online], retrieved on May 6, 2010, Retrieved from the internet:URL: http://www.merriam-webster.com/dictionary/margin, 3 pages.
'New Easy Peel Cheese Packaging', Mintel gnpd, Aug. 10, 2001, Mintel Publishing.
'New on the Shelf—Product Instructions and Packaging Trends', Circle Reader Service Card No. 93, Aug. 1998, Baking & Snack.
'Soft Bread Sticks', Mintel gnpd, Mar. 20, 1998, Mintel Publishing, 1 page.
Wall's Bacon "A Sizzling Success Story" and The Grocer: "When sealed delivers", the second page of which bears a date of Aug. 21, 1999.
Defendants' Final Invalidity Contentions—Exhibit A-1, dated Sep. 27, 2013, 55 pages.
Defendants' Final Invalidity Contentions—Exhibit A-2, dated Sep. 27, 2013, 35 pages.
Defendants' Final Invalidity Contentions—Exhibit A-3, dated Sep. 27, 2013, 34 pages.
Defendants' Final Invalidity Contentions—Exhibit A-4, dated Sep. 27, 2013, 35 pages.
Defendants' Final Invalidity Contentions—Exhibit B-1, dated Sep. 27, 2013, 135 pages.
Defendants' Final Invalidity Contentions—Exhibit B-2, dated Sep. 27, 2013, 64 pages.
Defendants' Final Invalidity Contentions—Exhibit B-3, dated Sep. 27, 2013, 140 pages.
Defendants' Final Invalidity Contentions—Exhibit B-4, dated Sep. 27, 2013, 273 pages.
Defendants' Final Invalidity Contentions—Exhibit B-5, dated Sep. 27, 2013, 146 pages.
Defendants' Final Invalidity Contentions—Exhibit B-6, dated Sep. 27, 2013, 226 pages.
Defendants' Final Invalidity Contentions Pursuant to LPR 3.1, dated Sep. 27, 2013, 22 pages.
Defendants' Final Unenforceability Contentions Pursuant to LPR 3.1, dated Sep. 27, 2013, 14 pages.
Defendants' Initial Non-Infringement Contentions Pursuant to LPR 2.3(a), dated May 17, 2013, 7 pages.
Defendants' Invalidity Contentions—Exhibit A-1, dated May 17, 2013, 55 pages.
Defendants' Invalidity Contentions—Exhibit A-2, dated May 17, 2013, 35 pages.
Defendants' Invalidity Contentions—Exhibit A-3, dated May 17, 2013, 34 pages.
Defendants' Invalidity Contentions—Exhibit A-4, dated May 17, 2013, 35 pages.
Defendants' invalidity Contentions—Exhibit A-5, dated May 17, 2013, 39 pages.
Defendants' Invalidity Contentions Pursuant to LPR 2.3, dated May 17, 2013, 23 pages.
Defendants' LPR 2.3 Initial Non-Infringement Contentions Exhibit A, dated May 17, 2013, 39 pages.
Defendants' Unenforceability Contentions Pursuant to LPR 2.3, dated May 17, 2013, 13 pages.
Defendants' Answer, Affirmative Defenses, and Counterclaims Responsive to Complaint, dated Apr. 5, 2012, 25 pages.
English Transiation of JP H09-158677 published on Jun. 17, 1997, 2 pages.
English Translation of Japanese Official Notice of Rejection mailed on Feb. 14, 2012 in JP Application No. 2009-172352, 3 pages.
English Translation of JP 1998-152179 (H10-152179 A), published on Sep. 6, 1998, 6 pages.
English Translation of JP 2001-114357 published on Apr. 24, 2001, 8 pages.
English Translation of JP 2003-26224 published on Jan. 29, 2003, 13 pages.
English Translation of JP H09-156677 published Jun. 17, 1995; 8 pages.
English Translation of JP Official Notice of Rejection mailed on Jan. 29, 2013 in JP Appl. No. 2008-087152 citing JPH0581083, 5 pages.
European Packaging Pack Report, NR. May 5, 2001 and partial translation thereof, 6 pages.
European Search Report, EP10305289 citing DE1848870U, 3 pages.
European Search Report 06118142.6 dated May 3, 2007, citing DE90140656, 10 pages.
Fuji Packaging GmbH Fachpack brochure, Oct. 11-12, 2001; 2 pages.
Giant Baby Wipes package, item No. 80203-91, resealable package having die cut-out portions (tabs) which remain affixed to the top of the package after label is withdrawn from the top, whereb.y tamper evidence is indicated by a misalignment of the die cut-out portions with the holes formed in the label.
Global Brands' LPR 2.5 Initial Response to Defendants' Initial Invalidity Contentions Chart Ex. A-1, dated May 31, 2013, 30 pages.
Global Brands' LPR 2.5 Initial Response to Defendants' Initial Invalidity Contentions Chart Ex. A-2, dated May 31, 2013, 20 pages.
Global Brands' LPR 2.5 Initial Response to Defendants' Initial Invalidity Contentions Chart Ex. A-3, dated May 31, 2013, 21 pages.
Global Brands' LPR 2.5 Initial Response to Defendants' Initial Invalidity Contentions Chart Ex. A-5, dated May 31, 2013, 14 pages.
Global Brands LPR 2.5 Initial Response to Defendants' Initial Invalidity Contentions Chart Ex. A-4, dated May 31, 2013, 17 pages.
International Search Report, PCT/EP2011/054250 dated Jun. 28, 2011, 3 pages.
Machine translation of claim for BR 5500885-2 from Googletranslate.com; 1 page.
Machine translation of claim for BR 6202030-7 from Googletranslate.com; 1 page.
Machine translation of claim for BR 6804636-7 from Googletranslate.com; 1 page.
Machine translation of DE 202007005487, published Jun. 14, 2007, provided by Espacenet, 3 pages.
Machine translation of DE9014065, published Mar. 19, 2009, provided by Espacenet, 9 pages.
Machinery Update, Mar./Apr. 2002, pp. 56-62.
Machinery Update, Sep./Oct. 2001, pp. 46-47.
Opposition to EP1679269 filed by Awapatent AB, Heisingborg, Sweden. May 2, 2012.
Opposition to EP1679269 filed by Bahlse GmbH and Co. KG, Apr. 30, 2012.
Partial European Search Report for Appl. No. EP11155570 dated Jun. 12, 2011, citing DE9003401 and DE9005297, 9 pages.
Plaintiff's Initial Response to Defendant's Initial Invalidity Contentions, dated May 31, 2013, 20 pages.
Plaintiffs Answer to Counterclaims of Defendant, dated Apr. 26, 2013, 20 pages.
Plaintiffs Complaint for Patent Infringement, dated Jan. 16, 2013, 7 pages.
Reclosure system lengthens food life, Packaging News PPMA Preview, Sep. 2001, 4 pages.
Reseal-It. Web page Internet print out accessed Mar. 14, 2005; 19 pages.
Additional Exhibits from Declaration of James Lukas Jr. filed Mar. 26, 2015, 73 pages.
Declaration of James J. Lukas, Jr. in Support of Defendants' Motion for Summary Judgment with Exhibits, Part 1 dated Mar. 23, 2015, 277 pages.

(56) References Cited

OTHER PUBLICATIONS

Declaration of James J. Lukas, Jr. in Support of Defendants' Opposition to Plaintiff's Motions for Summary Judgment with Exhibits (redacted), dated May 28, 2015, 228 pages.
Declaration of Katie Crosby Lehmann in Support of Plaintiff's Consolidated Memorandum of Law in Support of Plaintiff's Cross-Motion for Summary Judgment with Exhibits Part 1 (redacted), dated May 8, 2015, 400 pages.
Declaration of Katie Crosby Lehmann in Support of Plaintiff's Reply in Support of its Motions for Summary Judgment and Exhibit (unsealed), dated Jun. 10, 2015, 8 pages.
Defendants' Consolidated Memorandum in Support of Motion for Summary Judgment (redacted) with Exhibits A-G, dated Mar. 23, 2015, 166 pages.
Defendants' Consolidated Reply in Support of Defendants' Motion for Summary Judgment with Exhibits, dated May 28, 2015, 36 pages.
Defendants' Local Rule 56.1 Statement of Material Facts in Support of Motion for Summary Judgment, dated Mar. 23, 2015, 75 pages.
Defendants' Local Rule 56.1 Statement of Material Facts in Support of Motion for Summary Judgment (redacted), dated Mar. 23, 2015, 75 pages.
Defendants' LR 56.1 (b) (3) (C) Statement of Additional Material Facts in Support of Their Opposition to Plaintiff's Motions for Summary Judgment (redacted), dated May 28, 2015, 30 pages.
Defendants' Memorandum in Support of Motion for Summary Judgment of Non-Infringement and Their Motion for Summary Judgment of Invalidity Under 35 U.S.C. 102 and/or 103, dated Mar. 26, 2015, 60 pages.
Defendants' Memorandum in Support of Their Motion to Compel Discovery, dated Oct. 13, 2014, 13 pages.
Defendants' Motion for Summary Judgment of Non-Infringement and Motion for Summary Judgment of Invalidity Under 35 U.S.C. 102 And/Or 103, dated Mar. 23, 2015, 4 pages.
Defendants' Motion to Compel Discovery, dated Oct. 13, 2014, 3 pages.
Defendants' Response to Plaintiff's Local Rule 56.1 Statement of Material Facts in Support of Plaintiff's Motions for Summary Judgment, dated May 28, 2015, 108 pages.
Exhibits, part 2, to Declaration of James J. Lukas, Jr. in Support of Defendants' Motion for Summary Judgment, dated Mar. 23, 2015 125 pages.
Exhibits, part 2, to Declaration of Katie Crosby Lehmann in Support of Plaintiff's Consolidated Memorandum of Law in Support of Plaintiff's Cross-Motion for Summary Judgment (redacted), dated May 8, 2015, 300 pages.
Exhibits, part 3, to Declaration of James J. Lukas, Jr. in Support of Defendants' Motion for Summary Judgment, dated Mar. 23, 2015, 125 pages.
Exhibits, part 3, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 4, to Declaration of James J. Lukas, Jr. in Support of Defendants' Motion for Summary Judgment with Exhibits, dated Mar. 23, 2015, 28 pages.
Exhibits, part 4, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 5, to Declaration of Katie Crosby Lehmann in Support of Plaintiff's Consolidated Memorandum of Law in Support of Plaintiff's Cross-Motion for Summary Judgment (redacted), dated May 8, 2015, 200 pages.
Exhibits, part 6, to Declaration of Katie Crosby Lehmann in Support of Plaintiff's Consolidated Memorandum of Law in Support of Plaintiff's Cross-Motion for Summary Judgment (redacted),dated May 8, 2015, 300 pages.
Exhibits, part 7, to Declaration of Katie Crosby Lehmann in Support of Plaintiff's Consolidated Memorandum of Law in Support of Plaintiff's Cross-Motion for Summary Judgment (redacted),dated May 8, 2015, 136 pages.
Exhibits from Defendants' Memorandum in Support of Their Motion to Compel Discovery, dated Oct. 13, 2014, 68 pages.
Exhibits from Plaintiff's Memorandum of Law in Opposition to Defendants' Motion to Compel Discovery, Oct. 15, 2014, 78 pages.
Plaintiff's Consolidated Memorandum of Law in Support of Plaintiff's Cross-Motion for Summary Judgment, dated May 8, 2015, 54 pages.
Plaintiff's Cross-Motion for Summary Judgment, dated Apr. 27, 2015, 4 pages.
Plaintiff's LR 56.1(a) Response to Defendants' Statement of Additional Material Facts in Support of Their Opposition to Plaintiff's Motion for Summary Judgment (redacted), dated Jun. 10, 2015, 39 pages.
Plaintiff's Memorandum of Law in Opposition to Defendants' Motion to Compel Discovery, Oct. 15, 2014, 12 pages.
Plaintiff's Reply in Support of its Motions for Summary Judgment, dated Jun. 1, 2015, 19 pages.
Machine Translation of EP 1449789 description. Translated on Jun. 13, 2015, 18 pages.
English Translation of JP2003-026224 published Jan. 29, 2003, translated on Jul. 27, 2015. Translation provided by USPTO in U.S. Appl. No. 14/175,434, 9 pages.
English Translation of JP2001-301807 published Oct. 31, 2001, translated on Jul. 27, 2015. Translation provided by USPTO in U.S. Appl. No. 14/175,434, 6 pages.
Defendant's Local Rule 56.1 Statement of Material Facts in Support of Motion for Summary Judgment, dated Mar. 23, 2015, 75 pages.
U.S. District Court for the Northern District of Illinois, Eastern Division, Memorandum Opinion and Order, dated Aug. 3, 2015, 37 pages.
English Translation of JP2002-002805 filed by Onuma, published Sep. 1, 2012, translation provided by the USPTO in U.S. Appl. No. 11/193,614.
English Translation of JP2006137445 filed by Shimomura, published Jun. 1, 2006, translation provided by the USPTO in U.S. Appl. No. 13/698,567.
Definition of "end." Webster's New World Dictionary, Third College Edition. 1988 Simon & Schuster, cited by USPTO in U.S. Appl. No. 11/193,614, dated Jan. 21, 2016, 3 pages.
Machine Translation of the description of DE 3835721. Translation provided by USPTO in U.S. Appl. No. 14/005,783, dated Jan. 21, 2016, 17 pages.
Non-Confidential Brief For Plaintiff-Appellant Intercontinental Great Brands LLC, dated Dec. 30, 2015, 149 pages, filed with the Federal Circuit in Case Nos. 2015-2082, -2084 (litigation related to U.S. Pat. No. 6,918,532).
Reply Brief of Defendants-Cross-Appellants; dated Oct. 14, 2016, 37 pages, filed with the Federal Circuit in Case Nos. 2015-2082, -2084.
Non-Confidential Responsive/Reply Brief For Plaintiff-Appellant Intercontinental Great Brands LLC, dated Sep. 30, 2016; 69 pages, filed with the Federal Circuit in Case Nos. 2015-2082, -2084.
Brief of Defendants-Cross-Appellants; dated Jun. 17, 2016; 86 pages, filed with the Federal Circuit in Case Nos. 2015-2082, -2084.
European Extended Search Report for Application No. 16180214.5, dated Sep. 26, 2016, 7 pages.

* cited by examiner 582
582
514
512
578

536
518
514
520
525
512
522

518
514
512
520
516
516
522

516
516
504
508
514
506
500
502
512
520

RECLOSABLE FLEXIBLE PACKAGING AND METHODS FOR MANUFACTURING SAME

CROSS REFERENCE TO RELATED APPLICATIONS

This application is a national phase application of International Application No. PCT/US2011/037054, filed May 18, 2011, designating the United States and claiming priority to U.S. Patent Application No. 61/345,778, filed May 18, 2010, U.S. Patent Application No. 61/345,785, filed May 18, 2010, and U.S. Patent Application No. 61/453,872, filed Mar. 17, 2011, which are incorporated by reference herein in its entirety.

TECHNICAL FIELD

This disclosure relates generally to flexible packaging and, in particular, to flexible packaging having a reclosable opening.

BACKGROUND

Flexible packaging is well known in the art for use in containing food products. Flexible films can provide a lightweight package with a substantially hermetic seal for shipping and storage of a variety of food products, including, for example, crackers, chewing gum, chocolate, cookies, cheese, sandwiches, biscuits, candy, meat products, and dried fruits and vegetables. Some of these flexible film packages also may contain structural supports, such as a frame or tray.

One example of such flexible film packages are flow-wrap type packages, which may employ a continuous film or web to envelop a product during assembly or formation of the package. Flow-wrap packages may include, for example, horizontal or vertical fin seal or lap seal packages, end seal wrap, horizontal bagging and pillow-pouch packaging. In one configuration, flow-wrap packaging positions a film, such as polyethylene or polypropylene, adjacent a product, wraps the film around the product, forms a seal from the ends or edges of the film, and then forms seals at either end of the product. These seals may be permanent and also may provide some structural integrity. Flexible film packages have other advantages. For example, they can be manufactured at substantially lower cost than rigid containers, are lightweight (resulting in lower transportation costs), and can reduce space required for storage.

Despite the advantages of flexible film, these packages are sometimes difficult for consumers to open. Further, these packages often contain various amount of food product, and a consumer may not want to consume all of the food product at one time. Therefore, a reclose feature may be included to provide users with an easy, efficient manner of preserving some of the food product for a later time. The reclose feature may provide a partial barrier to moisture and gas resulting in a partially hermetic seal, though it may not provide a complete hermetic seal, and may help to retain the shelf-life or freshness of a food product contained within the package.

The flexible packages that have a resealable or reclosure feature are sometimes difficult to manufacture on equipment that is widely available. For example, some flexible film packages may require specialized die assemblies or heat seal bars to produce the seals, package openings, and other package features related to the reclose feature. Another drawback with the manufacture of some flexible packages is the common requirement of precisely calibrated manufacturing equipment. For example, packages and processes that employ a pattern-applied adhesive may require specialized equipment that may need to be properly calibrated. As another example, some laminate structures may employ partial depth die cuts from both the interior and exterior surface of the laminate structure, which increases the complexity of the equipment. These processes also may require very precise registration of the package elements to ensure the consumer is able to easily and reliably open the package and also to ensure proper closure or sealing of the flexible package.

In addition, previous package designs also tend to require additional package material to accommodate the equipment and various manufacture and consumer specifications. This extra film or other material (such as a label backing) often resulted in costly waste, which increases the cost of the packages.

DETAILED DESCRIPTION OF THE PREFERRED EMBODIMENTS

Figure 1:
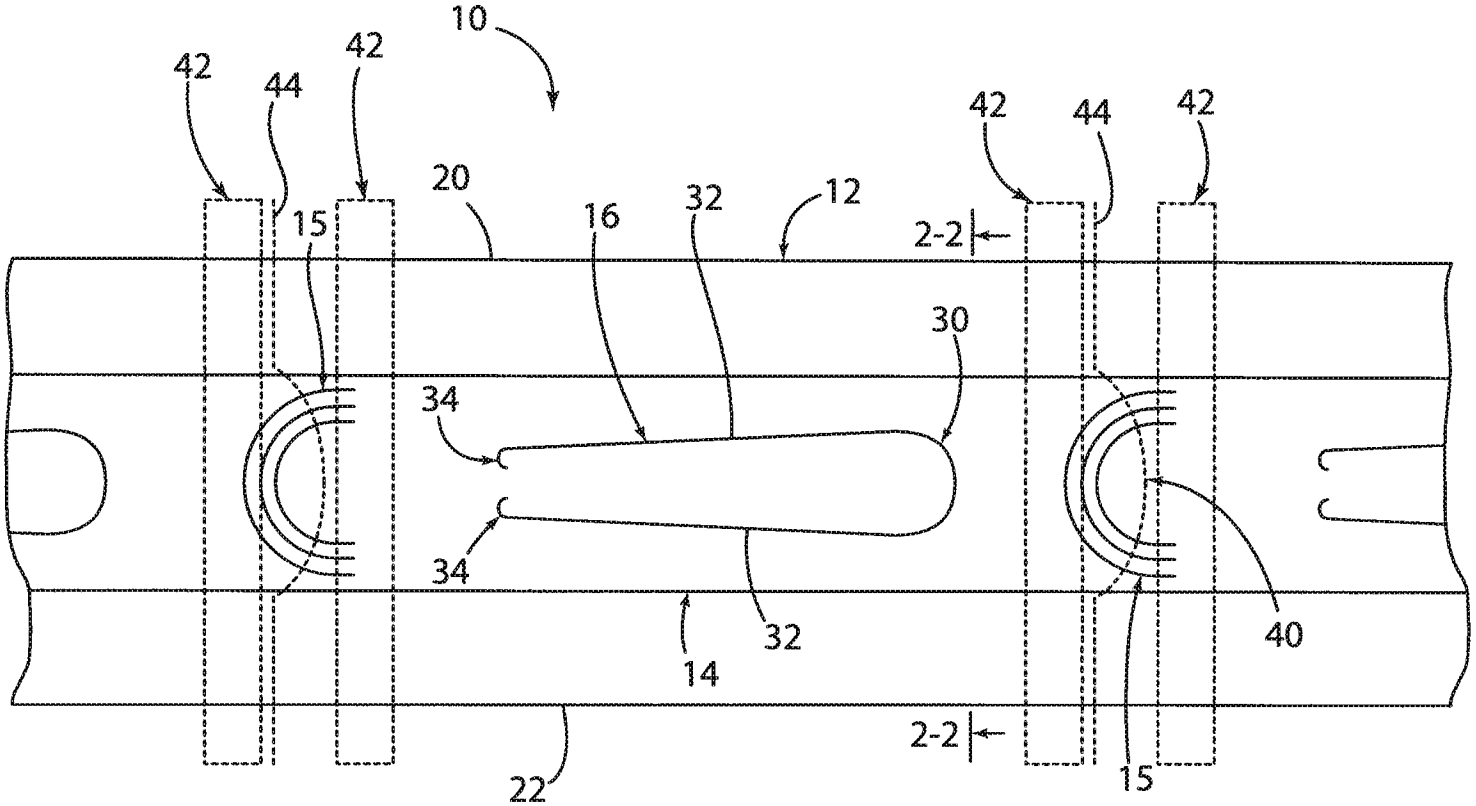
FIG. 1 is a plan view of a section of a series of flexible film package blanks.

Pursuant to the various embodiments described herein, flexible film packages and methods of producing such packages are provided herein. The flexible film packages may have at least a partial, initial seal against ambient atmosphere and are easily openable and reclosable. More particularly, the initial seal, which is present prior to initial opening of the flexible film package, may provide at least a partial barrier against ambient atmosphere, including gas and moisture, for an extended period of time. For example, the initial seal of the flexible film package may provide a light barrier and also a gas and moisture barrier for at least 6 to 8 months prior to initial opening. In some applications, a gas and moisture barrier may be desired for even longer periods of time prior to initial opening. Further, the flexible film packages are generally resealable such that the shelf-life of food products contained therein is not unnecessarily shortened due to exposure to the ambient atmosphere once the flexible film package is initially opened. Thus, the flexible film packages may have a reseal feature that provides a resealable seal that is present subsequent to initial opening of the package. While the present disclosure is described for food product applications, it also can be applied to non-food, medical, pharmaceutical, industrial packaging applications and the like.

In one approach, the flexible film package is generally configured to accommodate multiple servings of a food product. Thus, the resealing characteristics of the flexible film package help retain freshness or shelf-life of the food product remaining within the package subsequent to initial opening. The seals of the flexible film package, such as any longitudinal seals including, for example, a fin or lap seal, and any ends seals may be hermetic (and also may have varying degrees of hermeticity, such as partial or substantial hermetic seals) to help retain the shelf-life of any food products contained therein. The seals may be formed by a variety of process such as, for example, hot seal, cold seal, low tack seal such as that employing a low tack adhesive or fastener, sonic waves, and combinations thereof. Any resealable seals of the flexible package, such as that formed around the package opening, may be formed, in part, by a pressure sensitive adhesive located between the flexible film and an the elongated closure layer. This resealable seal feature may be formed by a variety of manufacturing processes.

The flexible film packages may have a variety of configurations, including, for example, a bag, a pouch, or other shapes such as a cylindrical-shape, a column-shape, or a rectilinear-shape, among others. For example, the flexible film package may have squared edges such as that found on a primarily rectilinear-shaped package, or may have more curvilinear-shaped edges, such as that found on more circular or ovoid-shaped packages. Further, the flexible film package may be formed around the food product, such as a package having a sleeve configuration that is wrapped around a discrete stack or stacks of food products. In other applications, the flexible film packages may be fully or partially formed and then filled with the food products, which may be helpful for various discrete food products. The various configurations may be easily opened and resealed while maintaining package integrity.

By one approach, the flexible film has two opposing edge portions that meet to form a longitudinal seal extending from a first end seal to a second end seal. The flexible film may have a score that defines a package opening upon initial rupture or initial opening. In one illustrative embodiment, an elongated closure layer extends over the score and extends from the first end seal (or to the first package end) to the second end seal (or second package end) and within the opposing edge portions that meet to form the longitudinal seal. A pressure sensitive adhesive may be located between the flexible film and the elongated closure layer. The elongated closure layer may have a tack-free gripping portion used to release at least a portion of the elongated closure from the flexible film to form the package opening.

By one approach, the package configuration and shape may be primarily influenced by the products contained within the package, in part, due to the flexibility of the laminate film. In another configuration, the flexible film may be configured as a flow-wrap or overwrap around a support structure, such as an internal rigid support or product tray.

The method for producing the flexible film packages provided herein may include forming a score in a portion of a continuous web of flexible film having a longitudinal axis and applying a continuous closure layer along the longitudinal axis with a pressure sensitive adhesive. By one approach, the continuous closure layer may be applied over a partial width of the continuous web of flexible film. The method also may include forming a continuous longitudinal seal from two opposing edges of the continuous web of flexible material and forming a first end seal and a second end seal. In one approach, an adhesive-free grasping portion may be formed at a first end of the flexible package. As discussed below, the flexible package material may be converted into one package blank off-line or in-line with the packaging processes and also may be formed in both horizontal and vertical form-fill-seal operations, among others.

A method of packaging products in a series of packages may include feeding a continuous film web having longitudinal edges and a predetermined width between the longitudinal edges. The method also may include merging a continuous substrate with the continuous film web across less than the entire predetermined width. By one approach, the continuous film web is scored to define an opening in the film web upon initial opening once the substrate is removed from the continuous film web and an adhesive, such as a pressure sensitive adhesive that provides a degree of releasability and resealablity, is provided between the continuous substrate and the continuous film web. If performed in-line, the method may provide products in a series for packaging, and the continuous film web and substrate may be wrapped around the products. Further, a longitudinal seal, such as a fin or lap seal, may be provided along the longitudinal edges of the continuous film web, and leading and trailing end seals may be provided between adjacent packages of the series of packages.

In one configuration, the method of manufacturing resealable flexible film packages includes scoring a continuous film to define an opening in a subsequently formed individual package; applying a continuous pressure sensitive adhesive label or closure layer to at least cover the score; feeding the film/label combination around the product to envelop the product; forming a longitudinal seal by joining the opposite edges of the film together; forming two substantially transverse end seals; and scoring peel tabs in a unsealed film area distal to an end seals.

The series of flexible packages may be formed in-line just before the film is being wrapped around a product or may be formed off-line well before the products are packaged. For example, a laminate structure may be prepared prior to being brought to the packaging line to fill the packages with products. In another configuration, the laminate may be formed in-line with the packaging operation such that the laminate is formed around or just before the product is packaged.

As used herein, the flexible film may be a formed of a thin polymer material. For example, the flexible film may be a flexible sheet of material in a roll or as individual blanks. To form the flexible film, a variety of processes may be employed. The flexible film may be, for example, laminated, extruded, cast, blown, or a combination thereof. By one approach, the flexible film may include a laminate having several thin layers of material. The laminate structure may include a polyethylene terephthalate (PET) layer and/or an oriented polypropylene (OPP) layer. Other optional laminate layers include a polyethylene (PE) layer, a polypropylene (PP) layer, a polylactic acid (PLA) layer, a sealant layer, an ink or print layer, nylon, and a metalized layer, such as a metalized oriented polypropylene (MET OPP) layer, to note but a few options. These different layers may have a variety of thicknesses and densities. Furthermore, the flexible film may be a combination of several of the above-mentioned film structures. By another approach, the flexible film may include a single layer (mono-web) polymer. If a single layer polymer is employed, the film may include, for example, polyethylene terephthalate, polyethylene, nylon, or oriented polypropylene. By yet another approach, the flexible film also may include a mono-web with a sealant thereon. Further, the components of the flexible film laminate may be joined by adhesives or by extrusion processes.

If a PET layer is used in the flexible film laminate, the PET layer may impact the rigidity of the laminate. More particularly, the PET layer may have different degrees of stiffness from flexible to semi-rigid, depending on the thickness of the PET layer. A PET layer may be incorporated into the laminate because it is relatively lightweight and strong and can have a high transparency if desired. The PET layer also may be useful as an oxygen (gas) and moisture barrier. In addition, an OPP layer also may further strengthen the flexible film and also provide a useful barrier to permeability.

The flexible film package may include a score that defines a package opening upon initial rupture or initial opening. The term "score" as used herein may describe any type of mechanically-formed or cut score line, a laser-formed score, or any other scoring means that would compromise the integrity of the film (i.e., a line or area of weakness). A score may be disposed partially through the depth of the flexible film, or it may be a die cut through the entire depth of the film. The score also may be formed on either side of the flexible film such that the score may be cut into the exterior or interior surface of the flexible film. In one example, the score is made into the flexible film from the interior surface of the flexible film and extends through the flexible film and substantially through the pressure sensitive adhesive. In addition, the score also may be a discontinuous line such as a set of perforations, which also may be either partially through the depth of the flexible film or completely through the entire depth of the flexible film.

By one approach, the elongated closure layer is disposed or continuously applied upon the flexible film over the score such that there are generally no disruptions in the elongated closure layer or portions where the flexible film lacks the elongated closure layer along one axis of the film. The elongated closure layer may comprise a label such as a label with a backing, a release liner or a linerless label. In another configuration, the elongated closure layer may include a second flexible film with pressure sensitive adhesive disposed between the flexible film and the second flexible film.

As discussed below, the pressure sensitive adhesive may be an interstitial layer to a laminated film structure such that the pressure sensitive adhesive is laminated between the flexible film and the second flexible film layers.

In yet another configuration, the elongated closure layer may comprise a tape that is continuously applied over the flexible film along its longitudinal axis. Though a linerless label may be similar to tape, a linerless label oftentimes requires additional printing, including, for example, for registration purposes. As illustrated below, the elongated closure layer may be applied on both horizontal and vertically formed packages. The continuous closure layer may be transparent, opaque, or optionally printed. The continuous closure layer may include any of a variety of flexible or semi-rigid polymers, such as, for example, an oriented polypropylene (OPP), including a bi-axial OPP, and a polyethylene terephthalate (PET) layer. In one illustrative embodiment, the continuous closure layer may have a thickness of about 0.5 to 5.0 mil (50 to 500 gauge; 0.0127 to 0.127 mm). By one approach, the continuous closure layer may be about 1.0 to 3.0 mil (100 to 300 gauge; 0.0254 to 0.0762 mm) in thickness. In one configuration, the continuous closure layer may have a thickness of about 2.5 mil (250 gauge; 0.0635 mm). For some applications, PET may be desirable because of its thermal resistance in creating non-peelable seals. Further, while the elongated closure layer may be a continuous strip of material continuously applied to the flexible film without disruption, it is noted that in some configurations, the label may be more of a discrete-type label, as described below in other embodiments.

The continuous closure layer may be applied to cover at least the score line. Further, the continuous closure layer preferably extends beyond the score line to provide sufficient marginal region around the score to effectively reseal the package opening once the score has been initially opened or ruptured.

As suggested, the package opening is preferably resealable such that at least a partial hermetic seal is obtained around the opening (in some configurations the resealable opening is substantially hermetic). The pressure sensitive adhesive between the flexible film and the elongated closure layer helps produce the resealing characteristics of the package opening. The pressure sensitive adhesive is preferably neutral or non-reactive to the product to be packaged. By one approach, the pressure sensitive adhesive may include, for example, a cold formed adhesive, a hot melt adhesive, a cold seal adhesive, a natural or synthetic latex adhesive, a low tack adhesive, ethylene vinyl acetate (EVA), an acrylic adhesive (such as a water-based or solvent acrylic adhesive), a styrene block copolymer adhesive, a butyl rubber adhesive, a silicone rubber adhesive, a natural rubber adhesive, a nitriles adhesive, an acrylic emulsion adhesive, and combinations thereof. Further, the pressure sensitive adhesive may be extruded, coextruded, printed, or combinations thereof. In one configuration, the pressure sensitive adhesive is an acrylic water-based adhesive. The pressure sensitive adhesive may be a variety of thicknesses. By one approach, the pressure sensitive adhesive may be about 0.5 to 1.5 mil (50 to 150 gauge; 0.0127 to 0.0381 mm) in thickness. The pressure sensitive adhesive may be suitable for resealing in a variety of conditions, such as ambient and refrigerated conditions, to note but a few.

In some configurations, the pressure sensitive adhesive may provide a substantially hermetic seal even under refrigerated conditions (i.e., the pressure sensitive adhesive can be operable in a temperature range of about −10 to 90 degrees Celsius; and preferably in the range of about 2 to 7 degrees Celsius). The pressure sensitive adhesive may be applied directly to the film but also may be applied to ink or another coating on the film. By one approach, the pressure sensitive adhesive remains attached to the continuous closure layer, even after the closure layer is repeatedly opened and reclosed. In another configuration, the pressure sensitive adhesive is a low tack adhesive or fastener. Optional low tack adhesives or fasteners are disclosed in U.S. patent application Ser. No. 13/035,399, filed Feb. 25, 2011, which is incorporated herein by reference. The low tack adhesive may include a variety of suitable materials exhibiting a relatively low tack to undesired surfaces but, at the same time, still exhibits a good bond strength to desired surfaces (such as not delaminating from the flexible film), and a relatively good cohesive or self adhesive bond strength to like surfaces to hold a flexible package or pouch closed, but still permit the package to be openable or peelable by hand. If a low tack adhesive is employed with the package, it is anticipated that the pressure sensitive adhesive may be adhered to either the closure layer, the film, or both, once the closure layer is pulled upward or away from the film and the package is open. In one illustrative embodiment, a portion of the low tack adhesive (PSA) remains adhered to the film and another portion of the low tack adhesive (PSA) remains adhered to the continuous closure layer during opening of the package.

In addition, the initial seal of the package (prior to opening) also may be substantially hermetic (e.g., provide a gas and moisture barrier) for extended periods of time. The initial seal may be created by the package end seals or longitudinal seal, along with the continuous closure layer and pressure sensitive adhesive laminated above the score, which subsequently defines a package opening.

In one configuration, a resealable flexible film package includes a scored film with edges that are longitudinally sealed to form a sleeve. A first package or sleeve end seal is disposed substantially transverse to the longitudinal seal at a first package end. A second package or sleeve end seal is disposed substantially transverse to the longitudinal seal at a second package end. In some configurations, the first and second end seals can be optionally peelable or non-peelable. As used herein, a peelable seal is one where the sealant layers may separate from one another, and a non-peelable seal includes a sealant that bonds such that the sealant layers do not separate, i.e., a destructive seal. The film between the first and second end seals defines a package interior. The flexible film has a label or other continuous closure layer continuously disposed over the score of the film and along a longitudinal axis of the package with a pressure sensitive adhesive. The label can be employed to reclose or reseal the package as contents are removed from the package. In addition, after removal of some of the package contents, the film may be rolled or twisted to compress the package, and then, the label may be applied thereover to reclose or reseal the package. The package size may then be rolled or twisted to reduce the package size to the amount of content remaining in the package.

By one approach, the pressure sensitive adhesive has a peel strength between the film and the label that is greater than a force required to separate sides of the score. The label may extend beyond the score line sufficiently enough to reseal the package with the pressure sensitive adhesive disposed between the label and the film. A wide variety of score patterns are anticipated, and several configurations are provided herein. A score may be disposed generally longitudinally from the first package end to the second package end. In addition, the score may be straight, arcuate, or a combination thereof. Further, the score may include shapes such as a "T" shape, a teardrop, and a circle, to note but a few. In one configuration, the score may define an opening at or near the first package end. In some embodiments, the score line forms a loop between the end seals. In other embodiments, the score may begin at an outer edge of the first end seal and extend rearward, joining to form a single score line. In one configuration, the score line does not extend past the second end seal. In yet another configuration, the score may extend into and/or through the end seals. Since the seal area may be formed by heat seal bars, the heat employed to form an end or longitudinal seal in the package, also may melt the polymers sufficiently to inhibit any tearing of the score past the heat seal, even if the score extends into the heat seal area prior to forming of the seal.

The terminus of the score line adjacent the second package end may be configured to inhibit or prevent further tearing of the film beyond the score line. The end of the score line adjacent the second package end may include configurations having a "J" hook, a double "J" hook, a smile, a shepherd's hook, a teardrop, and a double teardrop (providing a relatively large package opening at either end of the package), among others. In one example, the score line includes an opening, such as a teardrop-shaped opening, adjacent the first package end that extends to a single score line running generally longitudinally toward the second package end, which provides an opening to the package interior. In another configuration, the score includes an opening, such as a teardrop-shaped opening, adjacent the first package end and two generally straight portions extending therefrom and extending longitudinally down the package. The generally straight portions may be parallel and may be spaced about 5 mm or less apart. The score also may include a narrow arcuate section joining the two generally straight portions adjacent the second end. In one configuration, the label extends beyond the first end seal and at least to the leading edge of the package.

As discussed below, a second score line or area such as a tab score may be added to the package to define a tab portion such as a tab in the film/label laminate. This second score line or area may be disposed distal and adjacent to the first sleeve end seal. In addition, multiple second score lines or a score area can be added to assist with proper functioning of the tab portion. The multiple score lines can be added to assist with concerns regarding variations in the registration of the elements.

Referring initially to FIG. 1, a series of flexible package blanks 10 are shown. A continuous flexible film web 12 has a width and a longitudinal axis along the length of the packages formed therefrom. An elongated or continuous closure layer 14 is continuously applied along the longitudinal length of the package blanks to a portion of the width of the continuous flexible film web 12. For example, the continuous closure layer 14 may be applied substantially along the entire longitudinal axis of the continuous flexible film web 12. A pressure sensitive adhesive 18 (FIG. 2) is disposed between the continuous flexible film web 12 and the continuous closure layer 14. The pressure sensitive adhesive 18, like the continuous closure layer 14, is continuously applied between the continuous flexible film web 12 and the continuous closure layer 14 so that there are no areas between the two layers without the pressure sensitive adhesive. A score 16 is formed in the continuous flexible film web 12 and will subsequently form a package opening when the continuous closure layer 14 is pulled away from the continuous flexible film web 12.

More specifically, the score 16 is formed into the flexible film 12 and may define the package opening 36 once the flexible film package 5 (FIG. 5) is initially opened. The package opening allows a consumer to easily access the product within the package 5. As mentioned above, the score 16 may be formed in a variety of operations, including, for example, mechanically-formed, such as by a die cut, laser-formed, or any other forming operation that compromises the integrity of the film. See, for example, U.S. Pat. No. 5,158,499. The score 16 may be formed on the interior or exterior surface of the flexible film. In addition, the score 16 may be disposed partially through the thickness of the flexible film (a partial depth score line) or through the entire flexible film thickness (a full depth score line). In addition, the score 16 may be a variety of widths, as well as depths. The score 16 may be formed before the continuous closure layer 14 is applied to or merged with the flexible film 12 or after the elongated, continuous closure layer 14 is applied to the flexible film 12. If the score 16 is formed subsequent to application of the continuous closure layer 14, the score 16 may be formed through the flexible film 12 (from the interior surface) and into the pressure sensitive adhesive 18. In one approach, the score 16 may be formed through the flexible film 12, the pressure sensitive adhesive 18 and partially into the continuous closure layer 14.

In addition to the score 16 that subsequently forms the package opening 36 (FIG. 5), the continuous flexible film web 12 also may have a tab score 15 (FIG. 1) formed therein. The tab score 15 may be formed similar to the score 16. The tab score 15 may be disposed on the continuous flexible film 12 in an area where the continuous closure layer 14 is applied thereon. As discussed in more detail below, the tab score 15 permits a portion 38 of the flexible film to separate from the remainder of the continuous flexible film web 12 to form a tab portion 40 at an end of the film package with the continuous closure layer 14. In the illustrative configuration of FIG. 1, the tab score 15 includes a series of arcuate die cuts that result in an arcuate portion of the flexible film 38 separating from the remainder of the continuous flexible web 12. In addition, as discussed in more detail below, the tab score 15 includes a series of score lines so that the longitudinal registration of the continuous flexible film web does not need to be precisely calibrated with the seal bars and separation or knife cuts that form or separate the individual film packages 5 from the series of flexible packages 10. Indeed, as discussed below, the tab score 15 is formed to intersect with the knife or separation cut 44 subsequently made into the laminate when the individual packages are formed.

In one illustrative embodiment, the score 16 and the tab score 15 are formed after the continuous closure layer 14 is applied to the flexible film web 12. In such a configuration, the score 16 may extend through the entire depth of the flexible film 12 and possibly through portions of the pressure sensitive adhesive 18. It also is anticipated that the score 16 may extend slightly into the continuous closure layer 14; however, the score 16 does not extend into the continuous closure layer 14 sufficiently enough to compromise the integrity of the barrier properties of the continuous closure layer 14. A variety of different score depths also are anticipated for tab score 15 as well.

A pre-scored film (or one scored prior application of the closure layer) also can define tear lines to create an opening on the flow-wrap package as the label is pulled back. The score 16 may maintain the seal of the flexible film package prior to opening, such that the flexible film 12 is not completely scored through the entire depth. Alternatively, the score 16 may extend through the flexible film 12 such that the continuous closure layer 14 substantially provides the seal prior to initial opening of the flexible package.

A variety of score 16 configurations are anticipated and a few examples are discussed herein. The particular score configuration employed for a given flexible film package may depend on the products being packaged, whether a structural support is being incorporated into the flexible film package, and the manufacturing equipment available, among other factors, By one approach, the score 16 defines a package opening that permits access to at least 70 percent of the products within the flexible film package upon initial opening of the package. More particularly, when the elongated closure layer 14 is peeled to the end of the score 16 to expose the entire score 16, it is anticipated that a user may access (i.e., remove from the package) any of at least 70% of the product within the package. This gives the consumer access to a substantial portion of the products within the flexible film package just after initial opening. By yet another approach, the score 16 defines a package opening that permits access to at least 90% of the product within the package. In another configuration, the score 16 defines a package opening permitting access to at least 50% of the product within the package.

FIG. 1 illustrates the score line 16 having a bulbous or arcuate section 30 extending into two generally elongated, straight sections 32 that terminate at ends 34, which have hooks in the illustrated configuration. The hooks or J-shaped ends help prevent the score 16 from propagating or continuing to tear the flexible film 12. In addition, depending on the product contained within flexible film 12, the arcuate section 30 of the score 16 permits the package opening to be sufficiently large enough to easily serve and access a substantial portion of the product contained therein.

Figure 8:
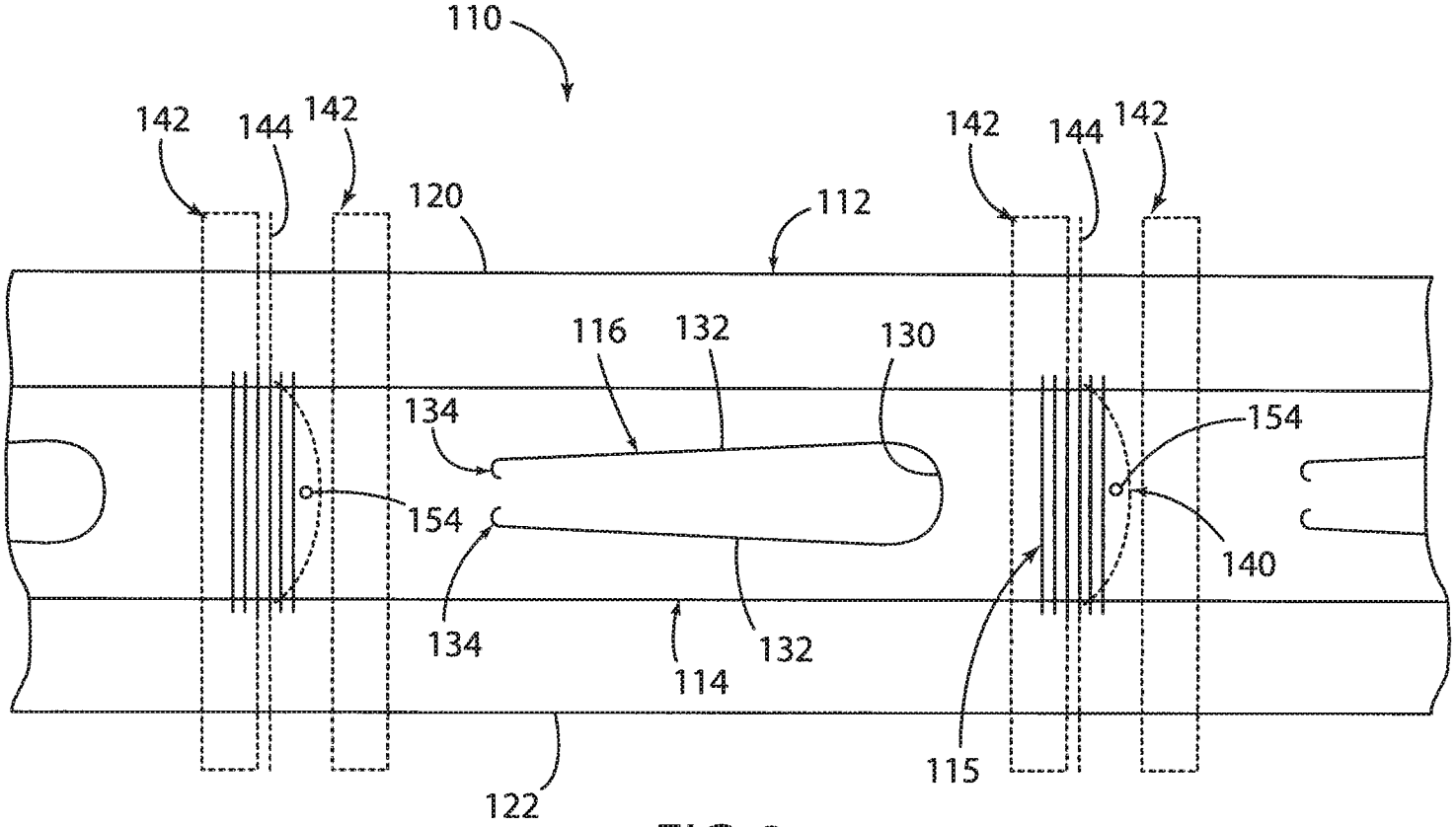
FIG. 8 is a plan view of a section of another series of flexible film package blanks.

Referring briefly to FIG. 8, another series of flexible package blanks 110 is shown. The series of flexible package blanks 110 is similar to the series of flexible package blanks 10 and has a continuous flexible film web 112 with an elongated or continuous closure layer 114. The primary differences with the series of flexible packages 110 are the score 116 and the tab score 115. The score 116 includes a bulbous or arcuate portion 130 that is slightly narrower than portion 30 and also includes two generally elongated, straight sections 132 that angle inward toward one another and to ends 134 that include hooks extending away from the center of the package. The package opening created with score 116 may be slightly more narrow than the package opening created with score 16. In addition, the tab score 115 includes a series of straight score lines that are configured to intersect the knife cut 144 subsequently made when individual packages are formed. FIG. 8 also illustrates an opening or peg hole 154 that may be formed through the closure layer 114 and the flexible film 12 to allow the individual packages to be hung, for example, for display purposes.

Flexible film web 12, 112, as suggested above, may be a laminate with several layers of material, including, for example, a PET layer, an OPP layer, a PE layer, a MET OPP layer, a PP layer, and/or a PLA layer, to note a few options. These layers may be joined by adhesives or by an extrusion process. Alternatively, the flexible film web 12 may be a single layer polymer or mono-web. Since the flexible film package is at least partially hermetically sealed, the flexible film web preferably provides a gas and moisture barrier. By one approach, the flexible film may be about 1 mil to about 5 mil (100 to 500 gauge; 0.0254 to 0.127 mm) in thickness. By another approach, such as that employed with extrusion lamination, the flexible film web 12 may be about 0.47 mil to about 0.98 mil (47 to 98 gauge; 0.012 mm to 0.025 mm) in thickness. In one illustrative embodiment employed with extrusion lamination, the flexible film web 12 may be about 0.67 mil to about 0.71 mil (67 to 71 gauge; 0.017 mm to 0.018 mm) in thickness. For the above extrusion lamination examples, the extrudate also will add about 0.4 mil to about 1.2 mil (40 to 120 gauge; 0.01 to 0.03 mm) of additional thickness to the flexible film. The thickness of the film may be a function of the desired barrier to gas, moisture, and light, along with the level of desired structural integrity, the desired depth of score line, and the available manufacturing equipment.

Flexible film web 12, 112 may be a heat sealable copolymer. In some configurations, the heat sealable polymer forms a seal between, for example, 50 and 300 degrees Celsius. Flexible film web 12 also may be a pressure sealing film. In one configuration, the film web 12, 112 may be a pressure sealing film. For example, the pressure sealing film may form a seal between, for example, a pressure of about 0.7 to 7.0 kg/cm. By one approach, the pressure sealing film forms a seal at about 5.6 kg/cm.

In addition to the various laminate layers mentioned above, additional laminate layers such as sealants, stiffeners, ink, release layers, also may be incorporated into the laminate structure. For example, a sealant layer can be added to facilitate the formation of seals that enclose the product. By one approach, the sealant layer may be oriented on the film surface directed to the interior of the package (interior-facing surface). The sealant layer may be a variety of polymer sealants, such as a heat activated polymer sealant layer like ethylene vinyl acetate (EVA), ionomer plastic (such as that sold under the trade name SURLYN by DuPont), metallocene, and organoclay, among others. In one example, seals, such as fin seals, can be formed using a heat activated sealant layer. In addition, cold sealant and pressure sealants also may be used with the configurations disclosed herein. If the products within the flexible film package are food products, then it is noted that food grade sealants would be employed.

In one configuration, stiffeners are added to flexible film 12, 112 to increase the stiffness of the film. These stiffeners may be in addition to the stiffness adjustments that can be made by changing the thicknesses or densities of the previously mentioned laminate layers. These stiffeners can be added as a component of the extruded film or as a separate layer. For example, a laminate layer such as a polyamide polymer (e.g., nylon) may be included in the laminate film structure of flexible film web 12. By one approach, nylon may be added as a laminate layer that is held to the remainder of the film structure by an adhesive. Further, in one configuration, the nylon layer may be positioned in between other layers such that the other flexible film layers are attached on each side of the nylon layer (i.e., a tie layer). In one configuration, a film structure, such as a 2 mil structure, may include a nylon layer of about 6-10% of the film thickness or about 0.003 to 0.005 mm. In one approach, the nylon layer comprises about 8% of the film thickness. By yet another approach, the nylon layer may comprise about 0.004 mm.

As noted, an ink layer may be formed into the laminate as an additional laminate layer. For example, one specific laminate can include ink and a primer disposed between other film layers such as a PET layer and an OPP layer. Alternatively, the ink may be a surface printed layer with a release over-lacquer such as that used for a mono-web. Other additional layers may include a metalized layer, as noted above.

A release layer may be incorporated in some configurations to provide more flexibility in the laminate structure and also may increase the numbers options for pressure sensitive adhesives. For example, if a release layer is incorporated, the pressure sensitive adhesive used in the packager may have a lower peel force. The release layer may be a homopolymer such as an OPP. By one approach, a release layer also may be an over-lacquer that is printed or extruded onto the film thereby providing a barrier between the pressure sensitive adhesive and the flexible film to provide consistent opening characteristics.

Figure 4:
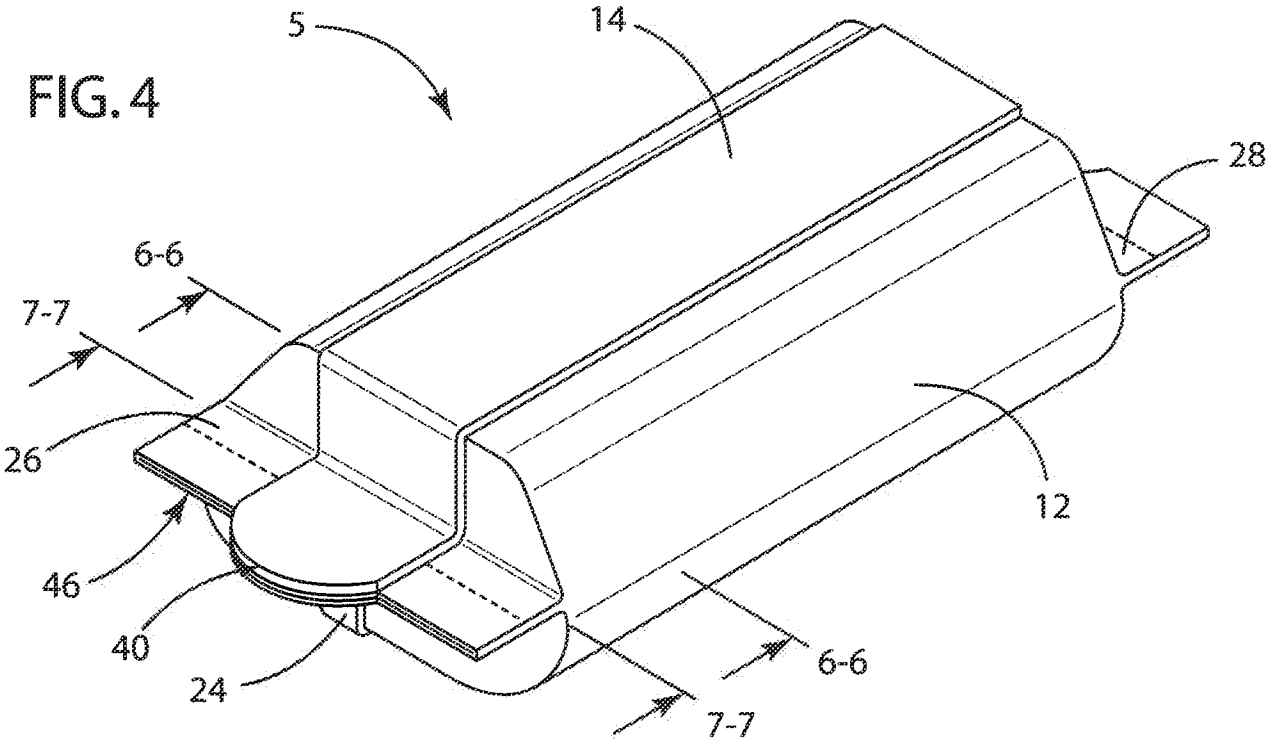
FIG. 4 is a flexible film package formed of one of the flexible film package blanks of FIG. 1.

By one approach, the elongated closure layer 14 is continuously applied along the flexible film 12 such that the continuous closure layer 14 extends from one end seal to another end seal once the flexible film package 5 is formed. In FIG. 4, the continuous closure layer 14 extends from a first end seal 26 to a second end seal 28. Furthermore, the closure layer 14 extends only partially over the width of the flexible film 12 that forms the film package 5. It is also contemplated, however, that the continuous closure layer 14 may extend the entire width of the package but only be partially disposed over the length of the flexible film 12. More particularly, the continuous closure layer 14 preferably does not extend both the entire width and the entire length of the package. The continuous closure layer 14 is partially disposed in either direction (i.e., the length or width) and continuously disposed in the other of the directions. In one approach, the continuous closure layer 14 is continuously applied along one axis of the flexible film and is only partially applied along the axis normal to the continuously applied axis. Thus, the flexible film packages 10 may have an elongated closure 14 that runs the entire length of the package and over only a portion of the width or an elongated closure 14 that runs the entire width of the package and over only a portion of the length of the package.

Figure 2:
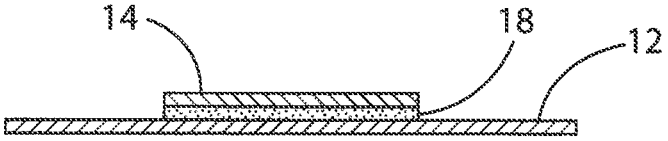
FIG. 2 is a cross sectional view of the laminate structure of the flexible package blanks of FIG. 1 along line 2-2.
Figure 3:
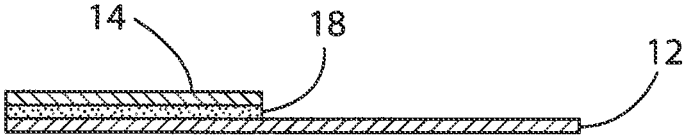
FIG. 3 is another configuration of the laminate structure.

FIG. 2, which shows a cross section of the flexible film along line 2-2, illustrates a pressure sensitive adhesive between the flexible film 12 and the elongated closure layer 14. Though the elongated closure layer 14 is disposed in a generally centered position in FIGS. 1-2, it is also anticipated that the elongated closure layer 14 may be off-center or offset on the width or length of the package. FIG. 3 illustrates how the elongated closure layer 14 may be disposed along an edge of the flexible film 12.

The elongated closure layer 14, which is adhered to the flexible film 12 and covers score 16, permits easy manual opening of the flexible package 5. In one embodiment, the elongated closure layer 14 can be formed such that the flexible package 5 has a tab portion 40. More particularly, a tab portion 40 (FIG. 5) may be formed by the elongated closure layer 14 and a portion of the flexible film in an unsealed area of the flexible film extending distal to an end seal such as end seal 26, allowing a user to grasp and peel open the upper layer of the peelable seal, i.e., the elongated closure layer 14.

Figure 5:
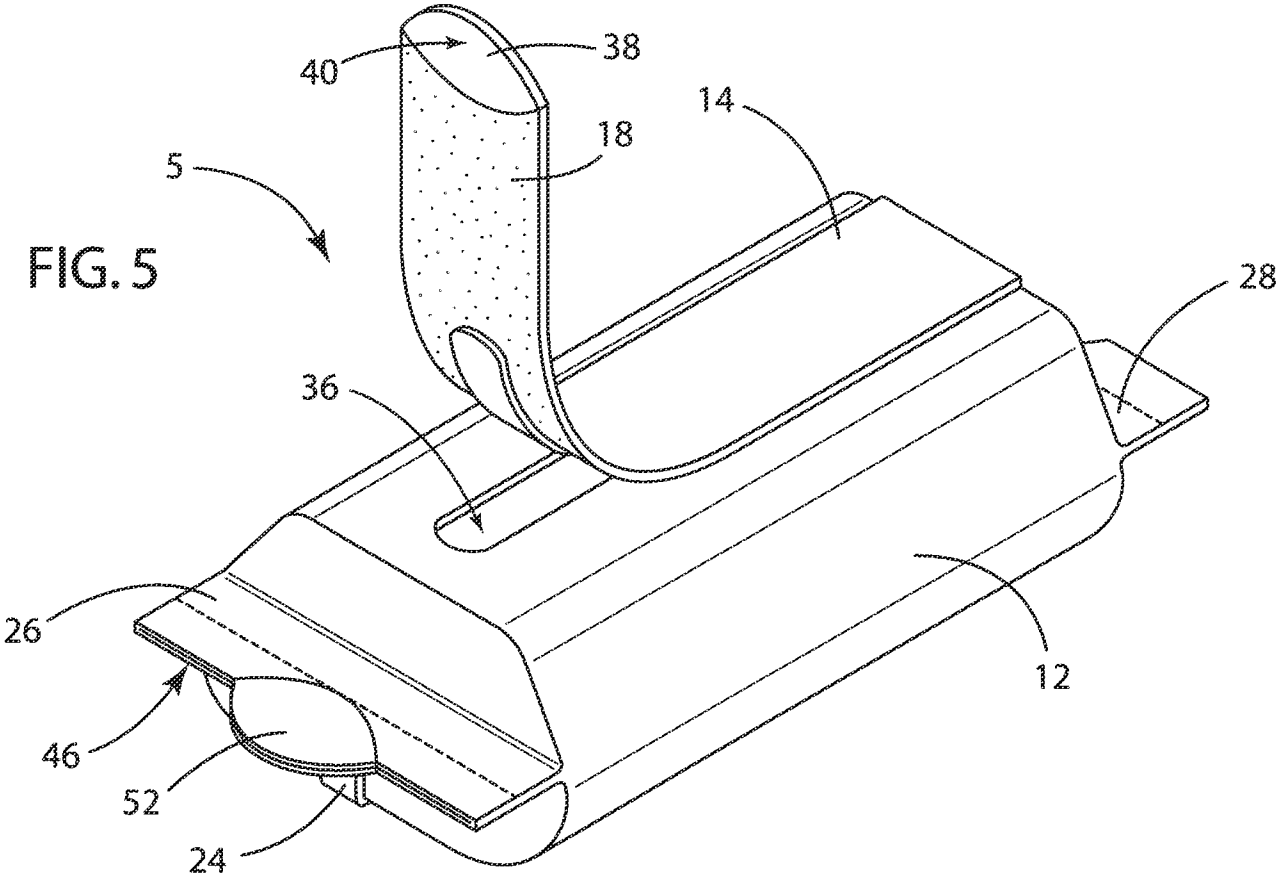
FIG. 5 is the flexible film package of FIG. 4 in a partially open configuration.
Figure 6:
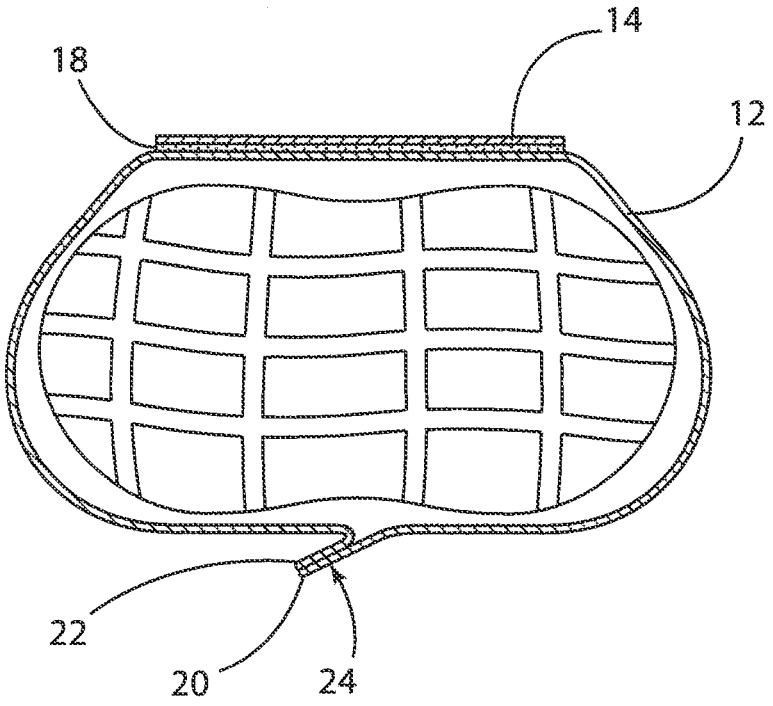
FIG. 6 is a cross sectional view of the flexible film package of FIG. 4 along line 6-6.

In one configuration, flexible film 12 has a first edge portion 20 and a second edge portion 22. The edge portions 20, 22 may be brought together and formed into a longitudinal seal, such as, fin seal 24 extending from a first end seal 26 to a second end seal 28, as shown in FIGS. 4-6. The longitudinal seal also may include a lap seal. The longitudinal seal may run the length of the package, as illustrated in FIGS. 4 and 5. However, the package may be configured such that the longitudinal seal runs along the width of the package as well.

Figure 7:
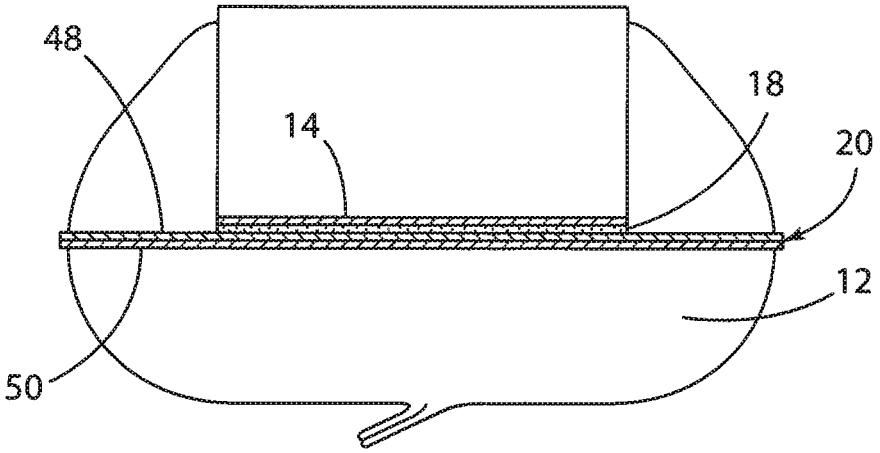
FIG. 7 is a cross sectional view of the flexible film package of FIG. 4 along line 7-7.

FIG. 1 illustrates one approach to creating the end seals 26, 28. FIG. 1 generally illustrates how the seal bar areas 42 (illustrated in dashed lines) create the first and second end seals 26, 28 of the packages (shown in FIGS. 4 and 5). In one illustrative approach, the continuous flexible film web 12 is wrapped around a forming device such as a forming tube, forming collar or in another manner and the edge portions 20, 22 are brought together for sealing. At this point, if the continuous flexible film web 12 also has been wrapped around the product to be contained therein, the ends seals 26, 28 also may be formed on the package. The end seals 26, 28 may include an upper and lower film portion 48, 50, as shown in FIG. 7, or also may include a front and back portion, depending on the configuration of the flexible film package.

In addition, FIG. 1 illustrates where the separation cut 44 may be formed between the end seals 26, 28, also illustrated in dashed lines. The separation cut 44 separates the individual packages 5 from the series of flexible film packages 10 and cuts through the flexible film web 12, the continuous closure layer 14, and the pressure sensitive adhesive 18. In one example, this separation point occurs between the second end seal 28 of a leading package and the first end seal 26 of a trailing package.

In one illustrative approach, the end portions of the flexible film of two packages disposed adjacent the first and second end seals 26, 28 are not sealed together. The free ends 46, since they are not sealed together, may be graspable by a user. Thus, to open a package, especially those lacking a resealable closure, a user may grasp the free ends of the flexible film that are adjacent the upper and lower portions of the end seal and pull apart the end seal. More particularly, in some packages, the free end portions are the pulled apart by consumers to rupture the substantially hermetic film-to-film seal that forms the end seal, sometimes referred to as a destructive seal. In other configurations, including those lacking free end portions, a user may elect to pull the front and back panels (or the upper and lower panels) away from one another, adjacent the seal, to rupture the end seal. Both of these manners of opening a package, rupture the permanent or primary seal and are oftentimes not resealable.

The end seals 26, 28 and the longitudinal seal 24 are film-to-film seals and may be considered primary seals and are oftentimes permanent or destructive seals. The closure layer 14 also forms a seal with the flexible package 5 and may be considered a secondary seal. The secondary seal is resealable and generally is not destructive. In one illustrative embodiment, the peel force required to separate the primary seals (primary peel force) is higher than the peel force required to separate the secondary seals (secondary peel force).

In one example, the flexible film package 5 has primary seals, including end seals 26, 28 and longitudinal seal 24, along with a secondary seal formed by the closure layer 14 over the length of the flexible film package 5. The secondary seal is formed, in part, by the pressure sensitive adhesive 18 disposed between the continuous closure layer 14 and the flexible film 12.

FIG. 7, which is a cross section taken along line 7-7 of FIG. 4, shows the flexible film 12 at the first end seal 26. The continuous closure layer 14 and pressure sensitive adhesive 18 also are disposed adjacent the first end seal 26. Near or at this point, the user will grasp the tab portion 40 (FIG. 5) and pull upward to separate the continuous closure layer 14 from the flexible film 12 to expose package opening 36. So that the continuous closure layer 14 is peeled away from the flexible film 12 without disturbing the primary seal between the upper and lower portions 48, 50 of the first end seal 26, the primary peel force therebetween is larger than the secondary peel force required to separate the continuous closure layer 14 from the flexible film 12. More particularly, if the primary and secondary peel forces are equal the user may disturb or negatively impact the primary seals, which may not be resealable. By one approach, the primary seal has a peel force that is 200-300 grams/in.$^2$ higher than the peel force of the secondary seal. In another configuration, the difference in peel forces may be between 100-400 grams/in.$^2$.

As suggested above, many consumers previously opened packages by rupturing the primary seals at the end or top of a package. As illustrated in FIG. 5, the flexible film package 5 is configured to permit the user to pull the continuous closure layer 14, which is adjacent the end seal, upward from the end seal 26 without rupturing the end seal 26. In addition, the flexible film 12 has a tab score 15 formed therein such that the user can grasp the continuous closure layer 14 without contacting the pressure sensitive adhesive 18. To that end, the primary and secondary seals may have peel forces configured to permit a user to easily open the package without disturbing the primary seals. In addition, the flexible package 5 may have a tab portion 40 that permits easy opening of the package.

As noted above, the free ends 46 of the package are adjacent the end seals but are generally not sealed together. More particularly, the free ends 46 of the package may be found in an unsealed area of the film laminate and, by one approach, are distal to the end seal of the package thereby allowing a user to grasp and peel open a portion 38 of the upper layer or portion 48 of the film and the continuous closure layer 14.

As noted above, the tab portion 40 may be formed by the combination of the tab score 15 and the separation cut 44. The leading end of the flexible film package 5 may be defined by the separation cut 44, which also may be adjacent the location of the tab portion 40. In one illustrative approach, a user may grasp at that end to begin opening the package. Specifically, a consumer may grasp the free end 46 of the upper portion 48 of the flexible film 12 and also the portion of the continuous closure layer 14 adjacent the leading end. To assist the user with lifting or peeling the continuous closure layer 14 from the flexible film 12, one of the free ends 46 adjacent the upper portion 48 of the end seal 26 may have tab score 15 formed therein. Thus, a portion of the flexible film 38 may separate from the remainder of the flexible film 12 at one of the tab scores 15. The portion 38 may cover the pressure sensitive adhesive 18 disposed underneath the continuous closure layer 14 and provide the user with a tack free gripping or tab portion 40. More particularly, the portion 38 is provided by having the tab score 15 separate the flexible film portion 38 from the remainder of the flexible film 12.

A cut-out 52, shown in FIG. 5, illustrates where the portion 38 of the flexible film 12 is removed from the remainder of the flexible film to cover the pressure sensitive adhesive 18 on the tab portion 40. As discussed in more detail below, the tab score 15 may be disposed partially into the leading end seal 26 of the package 10, the tab score 15 may extend just along the leading end seal of the package 10, or may be disposed just outside the leading end seal 26. In addition, if a series of tab scores 15 are employed, the tab scores 15 may have lines disposed in all three locations. If the tab score 15 extends just slightly into the leading end seal 26, a slight portion of the end seal 26 may be included in the portion 38 removed from the flexible film 12; however, if the tab score 15 extends significantly into the leading end seal 26, the forces within the seal will likely not permit much of the leading end seal 26 to separate therefrom to form the portion 38 of flexible film 12. Thus, the configuration of the portion 38 that is removed from flexible film 12 may depend on the configuration of the separation cut, the tab scores 15, the relative placement of the tab scores 15, and also may depend on the strength of the leading end seal 26. In one illustrative embodiment shown FIG. 1, the middle arcuate score line of tab score 15 will typically define the trailing, perimeter edge of the tab portion 44. This is the largest of the tab scores 15 that is not welded by the end seal 26 in sealing area 42. Thus, a variety of configurations may be employed for the tab portion 44, the tab score 15, and the flexible film portion 38 and a few examples are provided herein.

The separation cut 44, which defines the leading edge of the tab portion 40 and the leading edge of the flexible film package 5, also defines the trailing edge of another flexible film package 5. Thus, as a leading flexible film package 5 is provided a trailing edge by a die or knife cutting assembly, a trailing flexible film package 5 is provided a leading edge.

The pressure sensitive adhesive 18, which is disposed or applied between the flexible film 12 and the elongated closure layer 14, may have a variety of strengths and compositions. As noted above, the pressure sensitive adhesive may include, for example, a cold formed adhesive, a hot melt adhesive, a cold seal adhesive, a natural or synthetic latex adhesive, a low tack adhesive, ethylene vinyl acetate (EVA), an acrylic adhesive (such as a water-based or solvent acrylic adhesive), a styrene block copolymer adhesive, a butyl rubber adhesive, a silicone rubber adhesive, a natural rubber adhesive, a nitriles adhesive, an acrylic emulsion adhesive, and combinations thereof. Further, the pressure sensitive adhesive may be extruded, coextruded, printed, or combinations thereof. By one approach, the pressure sensitive adhesive has a higher bonding strength than the strength required to tear or separate the score 15. In such a configuration, a user may pull upward on the elongated closure layer 14, expose the package opening, remove the desired amount of product, and then reseal the package using the pressure sensitive adhesive outside the score. By one approach, the pressure sensitive adhesives may have a variety of thicknesses. For example, the pressure sensitive adhesive could be between about 0.2 mils to 1 mil thick and may be even thicker.

Figure 9:
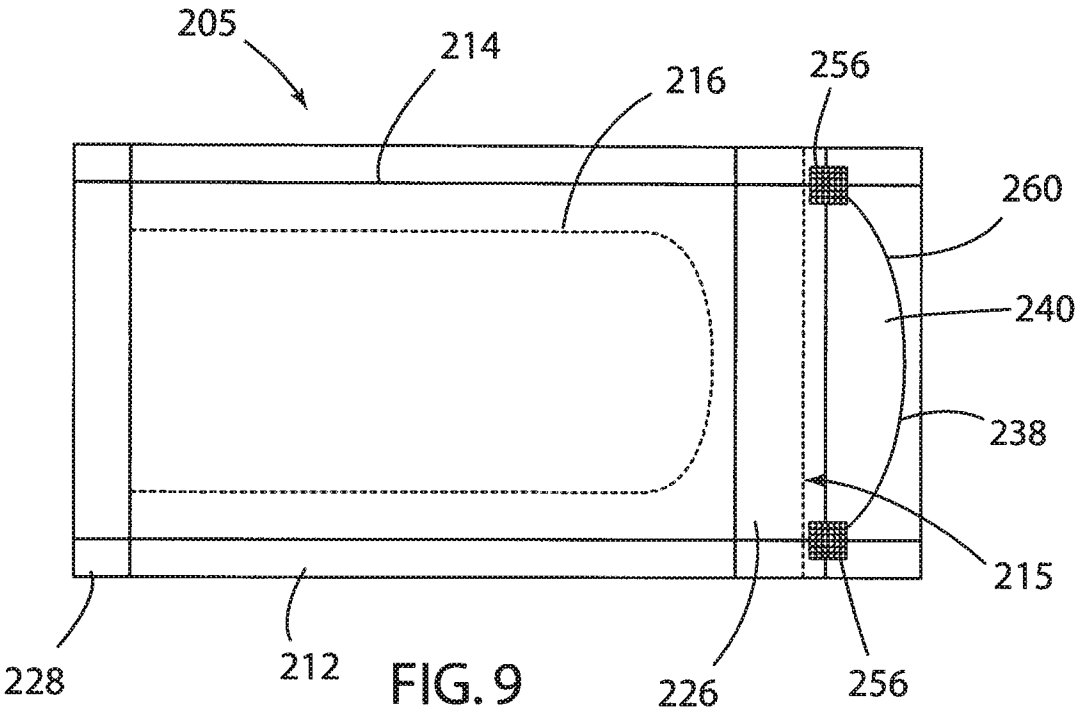
FIG. 9 is a plan view of another flexible film package.

Referring now to FIG. 9, a flexible film package 205 includes a flexible film 212 having a continuous closure layer 214 disposed thereon. The flexible film package 205 includes a score 216 and a tab score 215 disposed adjacent a first end seal 226. In one approach, the score 216 includes a generally U-shaped configuration that has an arcuate portion 230 and two generally elongated straight portions 232 that terminate at end portions 234 adjacent end seal 228. Tab portion 240 is adjacent end seal 226 and is defined, in part, by the score 215, which include a plurality of repeating straight score lines through the flexible film 212. The leading and trailing edges of the flexible film package 205 are straight and do not have arcuate sections as with the package of FIGS. 4-5. As illustrated in FIG. 9, a die cut 260 is illustrated through, at least, the continuous closure layer 214. By one approach, the die cut 260 is formed through the continuous closure layer 214, the pressure sensitive adhesive 218, and the flexible film 212. Thus, a tab portion 240 is created adjacent the first end seal 226 having an arcuate leading edge defined by the die cut 260 through the continuous closure layer 214 and the score 216 through the flexible film layer 312. As shown in FIG. 9, pair of cross-hatched score areas 256 may be provided adjacent the outside portions of the tab 240. By one approach, the die cut 260 extends into the cross-hatched score areas 256. The cross-hatched score areas 256 permit easier separation of the continuous closure layer 214 from the flexible film 212 at the trailing edge of the tab portion 240.

Figure 10A:
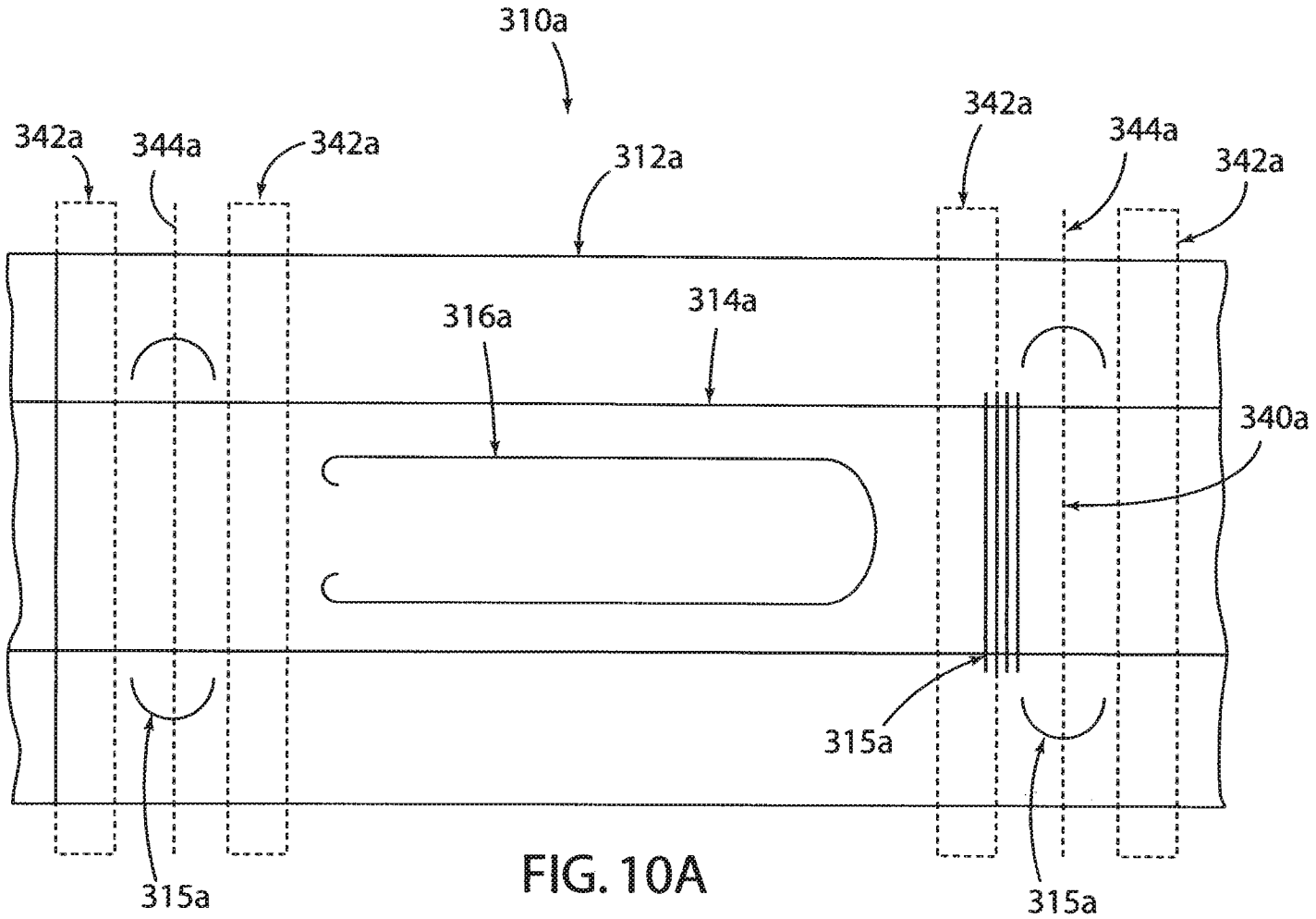
FIG. 10A is a plan view of a section of another series of flexible film package blanks.
Figure 10B:
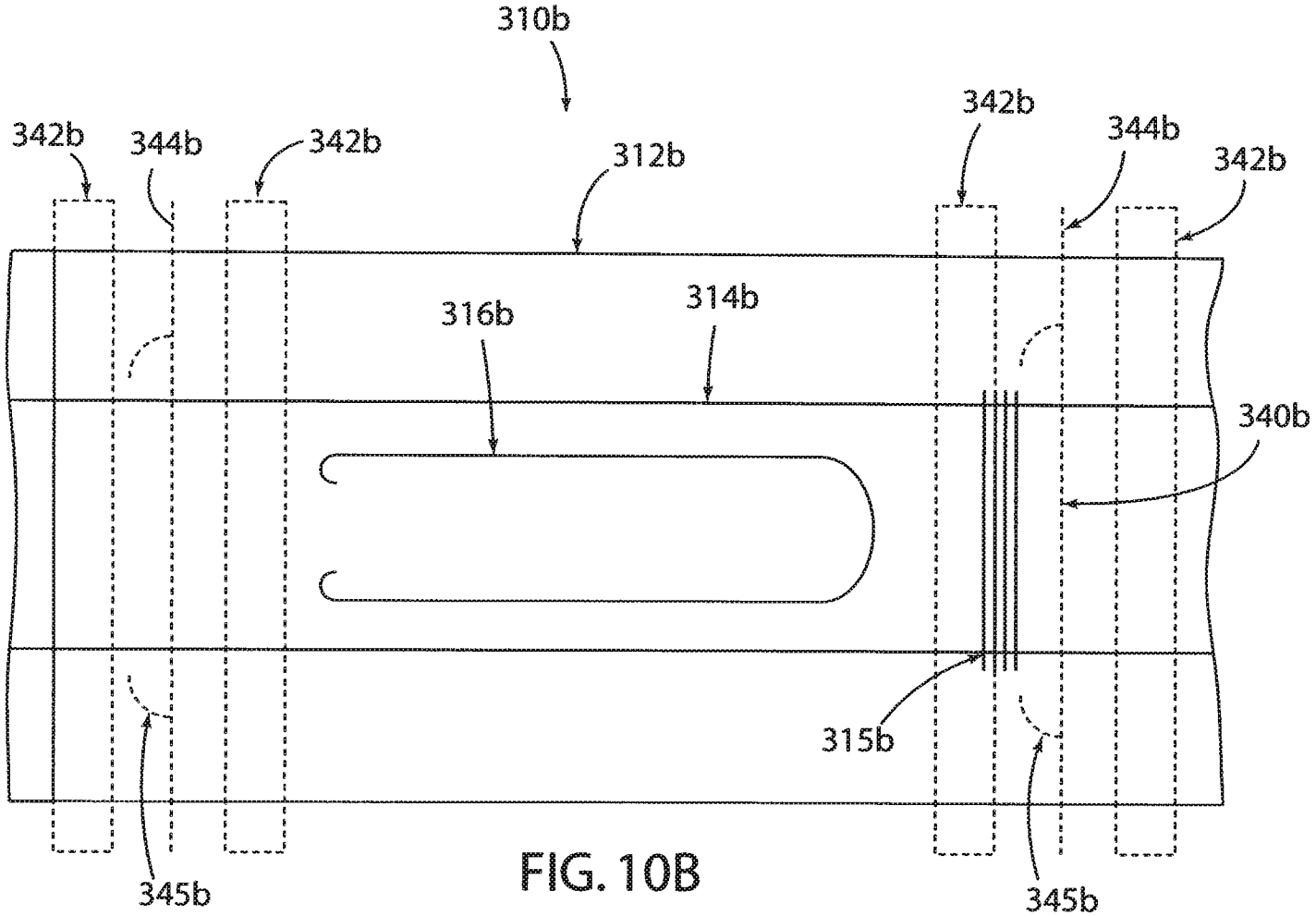
FIG. 10B is a plan view of a section of another series of flexible film package blanks.

A series 310*a* of flexible film packages, illustrated in FIG. 10A, is similar to the flexible film package blank 205, however, the series of flexible film packages 310*a* lacks a tab portion with an arcuate leading edge but includes a straight leading edge. The series of flexible film packages 310*a* includes a flexible film 312*a* with a continuous closure layer 314*a* disposed thereon. The flexible film 312*a* has a score 316*a* that becomes the package opening and a tab score 315*a* that helps form a tab portion 340*a*. The arcuate shaped tab score 315*a* extends into the free ends of the leading and trailing packages to permit variation in the registration of the package elements with the separation cut 344*a*. More particularly, tab score 315*a* does not require that the longitudinal registration of the continuous flexible film web be precisely calibrated with the separation cut 344*a* that is employed between the end seals of leading and trailing packages. In addition to having the arcuate tab score 315*a* formed by a score forming mechanism similar to that which forms score 316*a*, the arcuate cuts also may be formed by the separation cut. As illustrated in FIG. 10B, a series 310*b* of flexible film packages, which will subsequently look identical to the series 310*a* of packages, may be formed by having a separation or knife cut 344*b* configured to create arcuate cuts 345*b* in the film in the unsealed areas distal to the leading end seal. The configurations of FIG. 10A and FIG. 10B both provide a tab portion 340*a*, 340*b* that is relatively wide. The tab portion 340*a*, 340*b* may have arcuate sides and straight leading and trailing edges.

Figure 11:
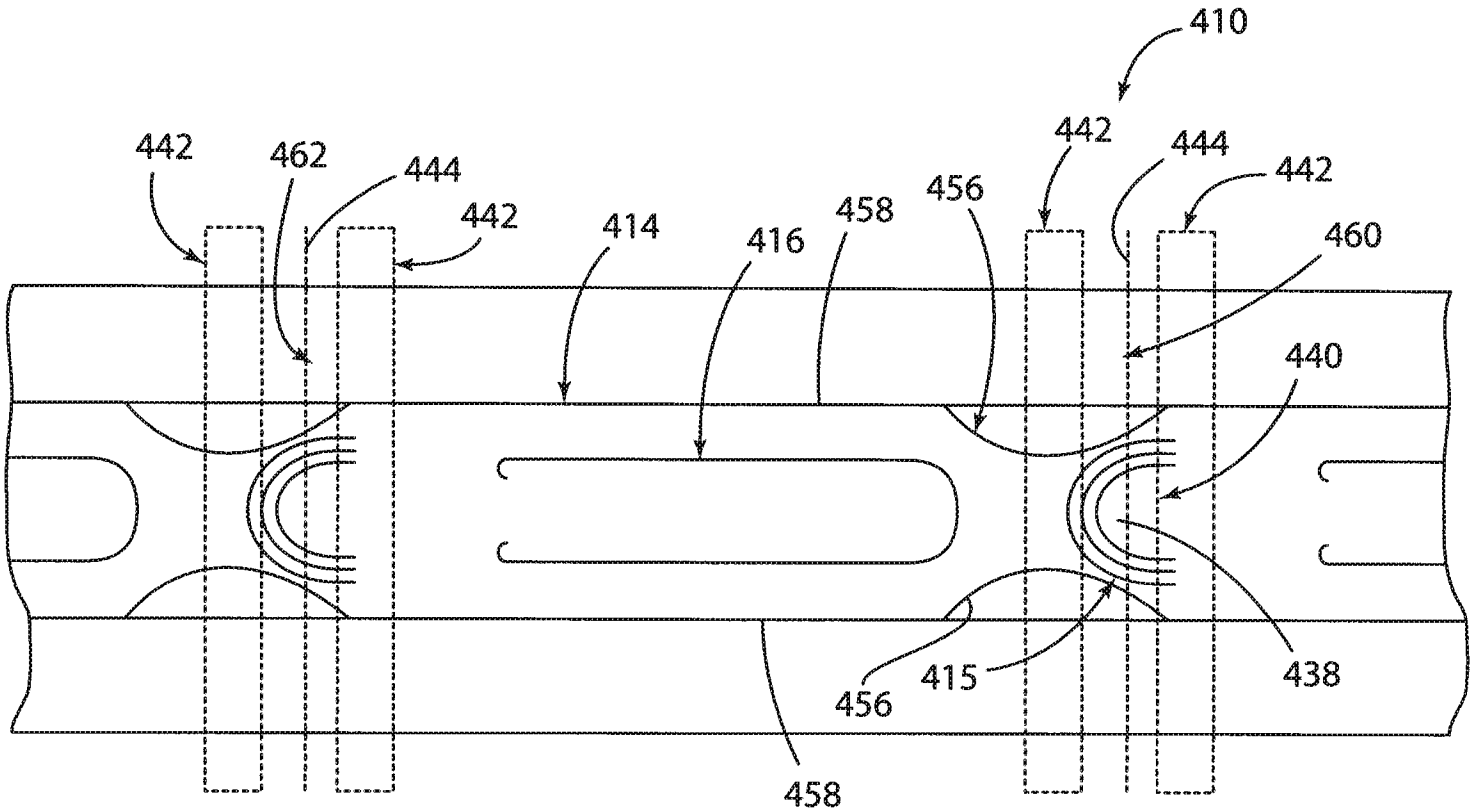
FIG. 11 is a plan view of a section of another series of flexible film package blanks.
Figure 12:
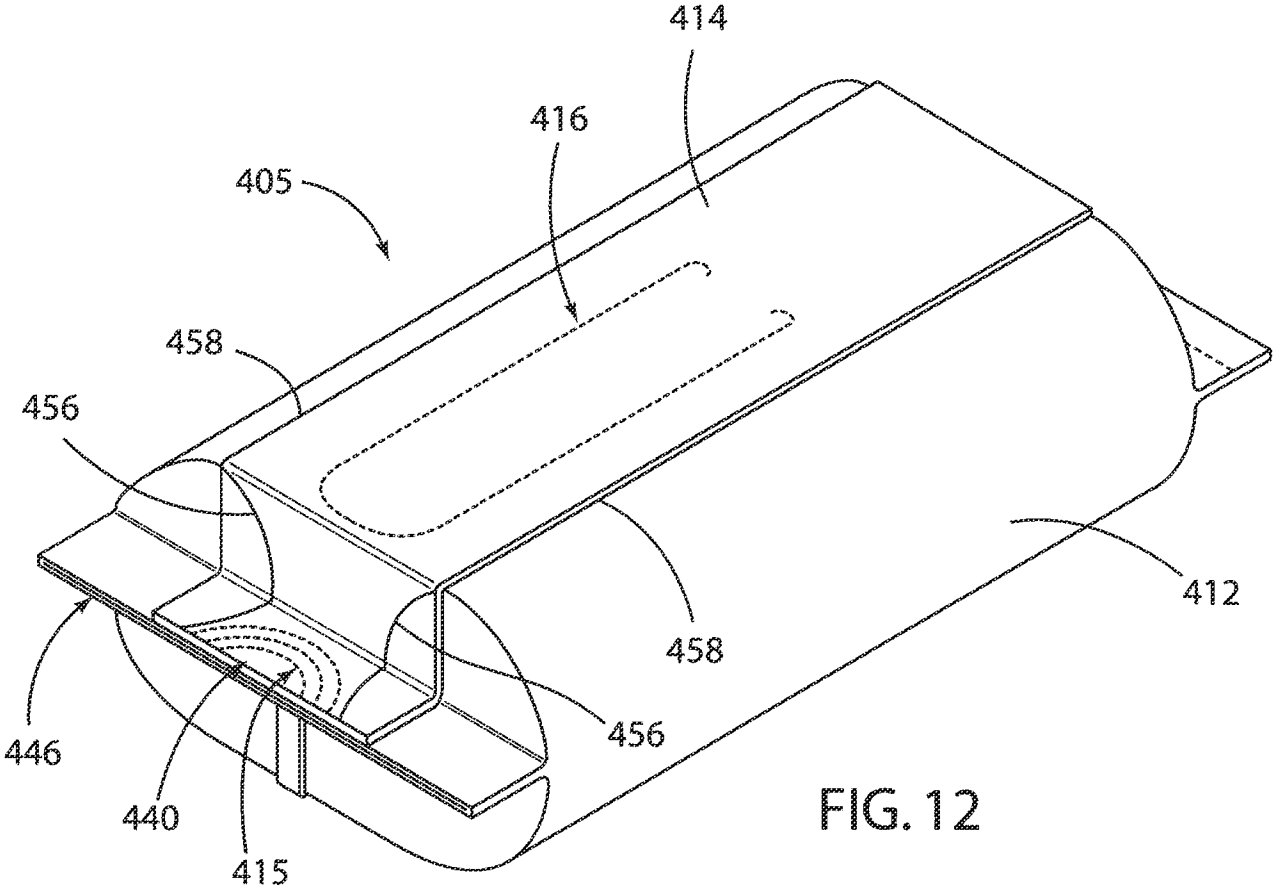
FIG. 12 is a flexible film package formed of one of the flexible film package blanks of FIG. 11.
Figure 13:
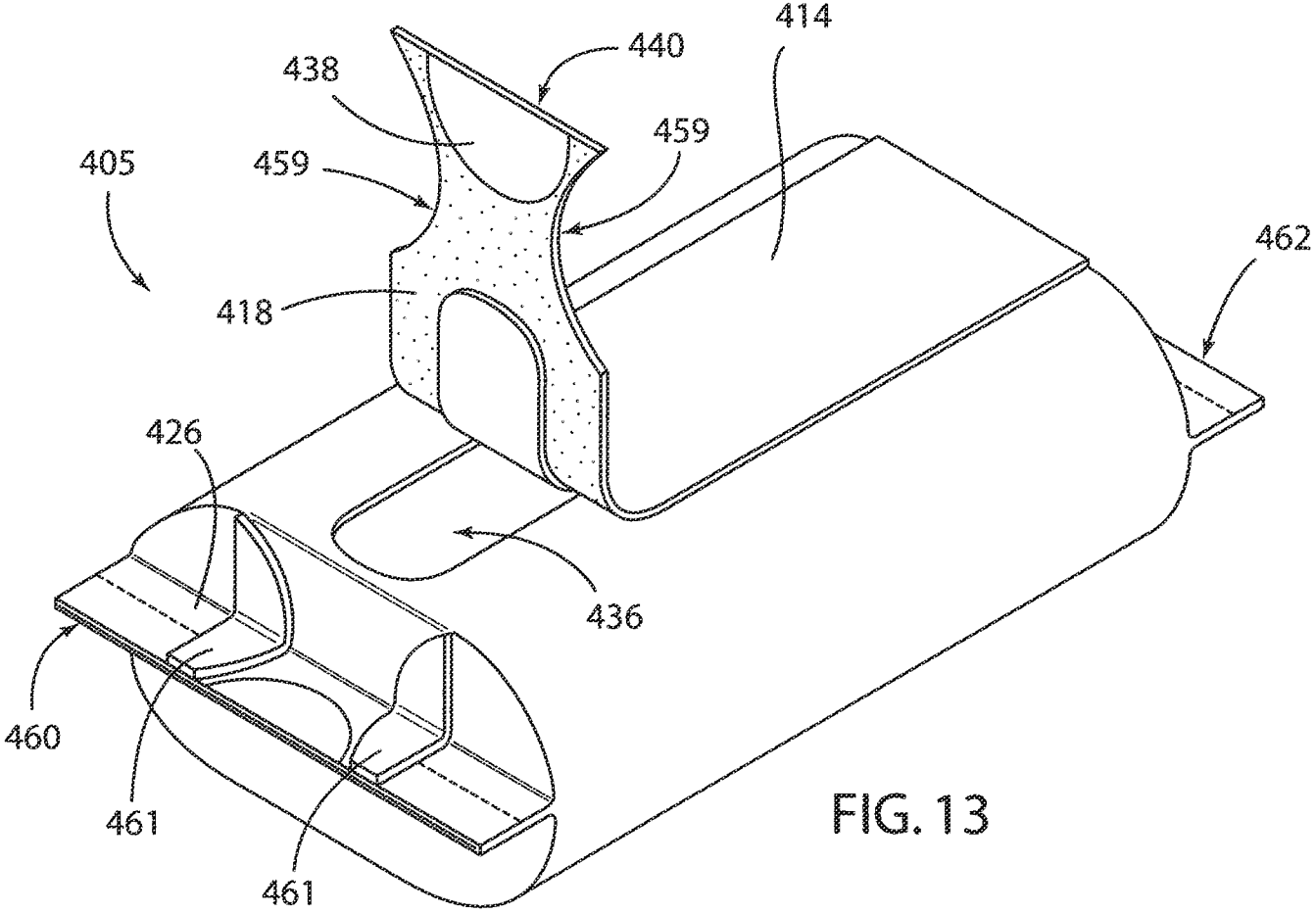
FIG. 13 is the flexible film package of FIG. 12 in a partially open configuration.

Another illustrative series of flexible film package blanks 410 is shown in FIG. 11. The series of flexible film package blanks 410 includes a continuous flexible film 412, a continuous closure layer 414, and a score 416 (illustrated in FIG. 12 in dashed lines) that provides for a package opening 436 once the continuous closure layer 414 is at least partially lifted from the subsequently formed package 405 (FIG. 13). The continuous closure layer 414, similar to the previously described configurations, covers a portion of the width of the flexible film 412. Further, the series of flexible film package blanks 410 also includes a closure layer score 456 disposed in the closure layer 414. The closure layer score 456 extends from a tab portion 440 (near the leading edge of the package) and is directed inward toward the package body and terminates at edges 458 of the continuous closure layer 414. The closure layer score 456 may be disposed through the full depth of the closure layer 414, and the score 456 also may extend into the pressure sensitive adhesive 418 disposed between the continuous closure layer 414 and the flexible film 412. The closure layer score 456 assists the user with peeling the continuous closure layer 414 from the flexible film 412, which can become difficult for packages with a relatively wide continuous closure layer 414 that covers more area of the flexible film 412. The closure layer score 456 forms cut-outs 459 in the continuous closure layer 414 once the tab portion 440 and a portion of the continuous closure layer 414 it is lifted from the film 412. The portions 461 of the continuous closure layer 414 that are cut-out from the remainder of the continuous closure layer 414 remain adhered to the flexible film 412 disposed adjacent the leading edge of the package 460. In sum, the closure layer score 456 reduces the peel force required to lift the continuous closure layer 414 from the flexible film 412.

In addition to the score 416, a tab score 415 is formed in flexible film 412. The tab score 415 (illustrated in FIG. 12 in dashed lines) may extend from a trailing seal area 442 (which forms a trailing end seal) of one package to the leading seal area 442 (which forms a leading end seal) of another package. Thus, the tab score 415 extends at least partially into the free ends of the package that are positioned between the two seal areas 442 prior to separation of the packages. As illustrated in FIG. 12, free ends 446 are adjacent both a leading edge 460 and a trailing edge 462. The leading edge 460 is adjacent the tab portion 440 and forms the leading edge of the tab portion 440. In addition, the leading edge 460 is formed by the separation cut 444, which is straight in this example. Thus, the tab portion 440 has a straight leading edge as well. The straight separation cut 444 also provides a straight trailing edge 462 of the packages as well.

The tab portion 440 also has a removed portion 438 from the flexible film 412 that covers the pressure sensitive adhesive 418 disposed on the continuous closure layer 414. As illustrated in FIG. 11, the tab score 415 includes arcuate lines that intersect the seal area 442 that becomes the leading end seal 426. Thus, when the tab portion 440 is pulled away from the flexible film package 405, the portion 438 is removed from the remainder of the flexible film 412 to cover the pressure sensitive adhesive that is adhered to the closure layer 414.

In addition to a configuration with a longitudinal seal and two end seals, it also is anticipated that the flexible film package may have three side seals. By one approach, such a package may have a dead fold.

Figures 14, 15, 16, 17:
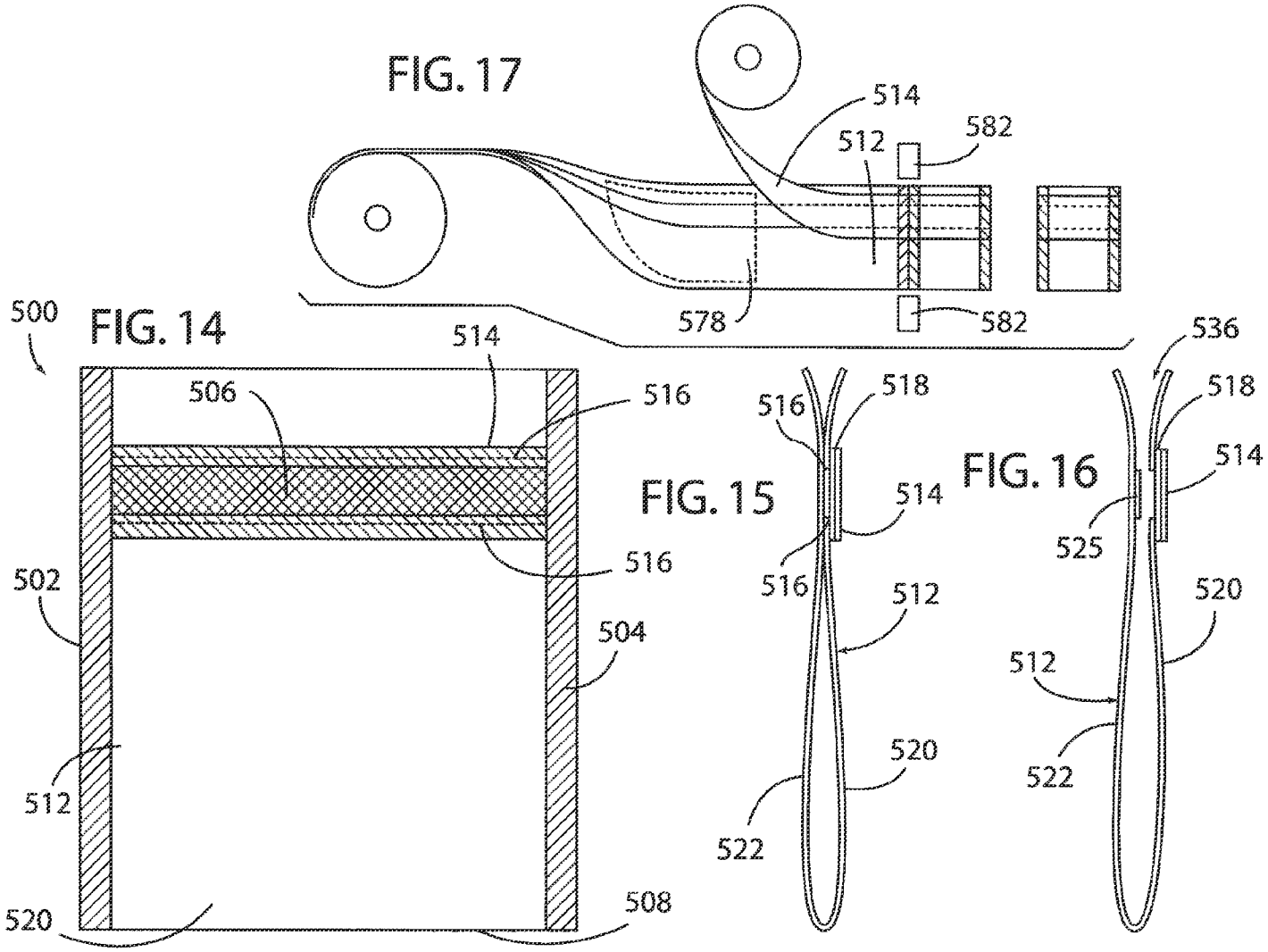
FIG. 14 is a side view of another flexible film package.
FIG. 15 is a cross sectional view of the package of FIG. 14 in a closed configuration.
FIG. 16 is a cross sectional view of the package of FIG. 14 in an open configuration.
FIG. 17 is a schematic illustration of a manner of forming the package of FIG. 14.

FIG. 14 shows another flexible film package 500. By one approach, the flexible film package 500 includes a front and a back film panel 520, 522, first and second end seals 502 and 504, along with a top seal 506 extending from the first end seal 502 to the second end seal 504, which is a longitudinal seal, and a dead fold 508. Flexible film 512 includes an elongated closure layer 514 disposed from the first end seal 502 to the second end seal 504.

As illustrated in FIG. 15, flexible film package 500 includes a pressure sensitive adhesive 518 disposed between the flexible film 512 and the elongated closure layer 514. In addition, a score may be disposed between one of either the front or back film panels 520, 522. By one approach, a score 516 is disposed through the front panel 520, and the elongated closure layer 514 and the pressure sensitive adhesive 518 are disposed thereon. Thus, once the package opening 536 is created by pulling the front and back film panels 520, 522 away from one another, a cut away portion 525 defined by the score 516 is separated from the front panel 520 and adheres to the back panel 522. More particularly, the top seal 506 is formed between the front and back panels 520, 522 and portions of the score 516 may be disposed above and below the top seal 506. Thus, once the score 516 is separated, a cutout portion 525 of the front panel 520 that is sealed (via top seal 506) to the back panel 522 remains adhered thereto. After opening (as shown in FIG. 16), a user may access the product within the flexible film package 505, and then, a user may reseal the package 505 by pressing the pressure sensitive adhesive 518 underneath the closure layer 514 into contact with the back panel 522 and the cut away portion 525.

FIG. 17 schematically illustrates one method of manufacturing the flexible film package 505. The continuous closure layer 514 may be continuously disposed upon flexible film web 512. In such a configuration, a forming or folding mechanism 578 may be used to form the film into the package shape for filling with product and forming die 582 may be used to create the seals and the separation cut between packages.

Figure 30:
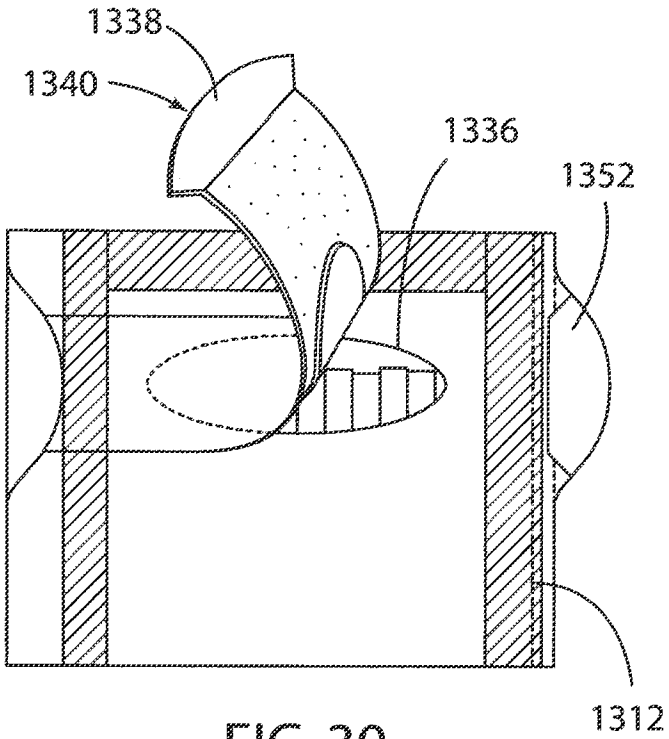
FIG. 30 is the flexible film package of FIG. 29 in a partially open configuration.
Figure 29:
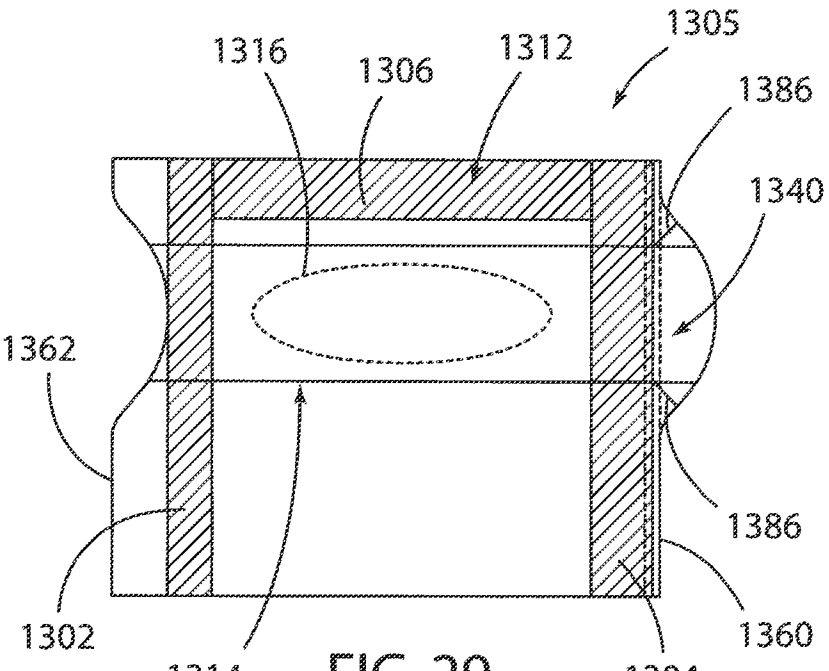
FIG. 29 is a side view of another configuration of a flexible film package.

Turning to FIG. 29, another illustrative package 1305 is shown with three side seals. A first and second side seal 1302, 1304 and a top seal 1306. A flexible film 1312 has a continuous closure layer 1314 from one of the side seals 1302 to the other side seal 1304. Indeed, the continuous closure layer 1314 extends from a first edge 1360 to a second edge 1362 of the package 1305. A score line 1316 is disposed in the flexible film 1312 underneath the continuous closure layer 1314, and the score line 1316 subsequently forms the package opening 1336 (FIG. 30).

The package 1305 further includes notches 1386 through the flexible film 1312 adjacent a tab portion 1340 that is adjacent the first edge 1360. The notches 1386 help remove a portion 1338 of the flexible film 1312 from the remainder of the film. As shown in FIG. 30, the cut-out 1352 is found where the portion 1338 has been removed from the flexible film 1312. The portion 1338 covers the pressure sensitive adhesive 1316 on the continuous closure layer 1314 to provide a tab portion 1340 for grasping. In addition, a tab score 1315, similar to previously described tab scores, may be formed adjacent or at the side seal 1304 to assist with removal of the portion 1338, which may remain adhered to the continuous closure layer 1314.

Figure 22B:
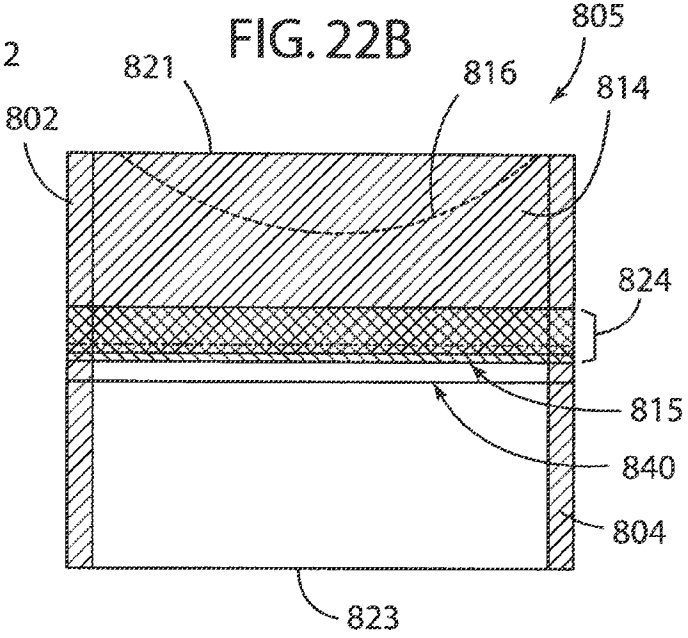
FIG. 22B is a side view of a flexible film package.
Figure 22A:
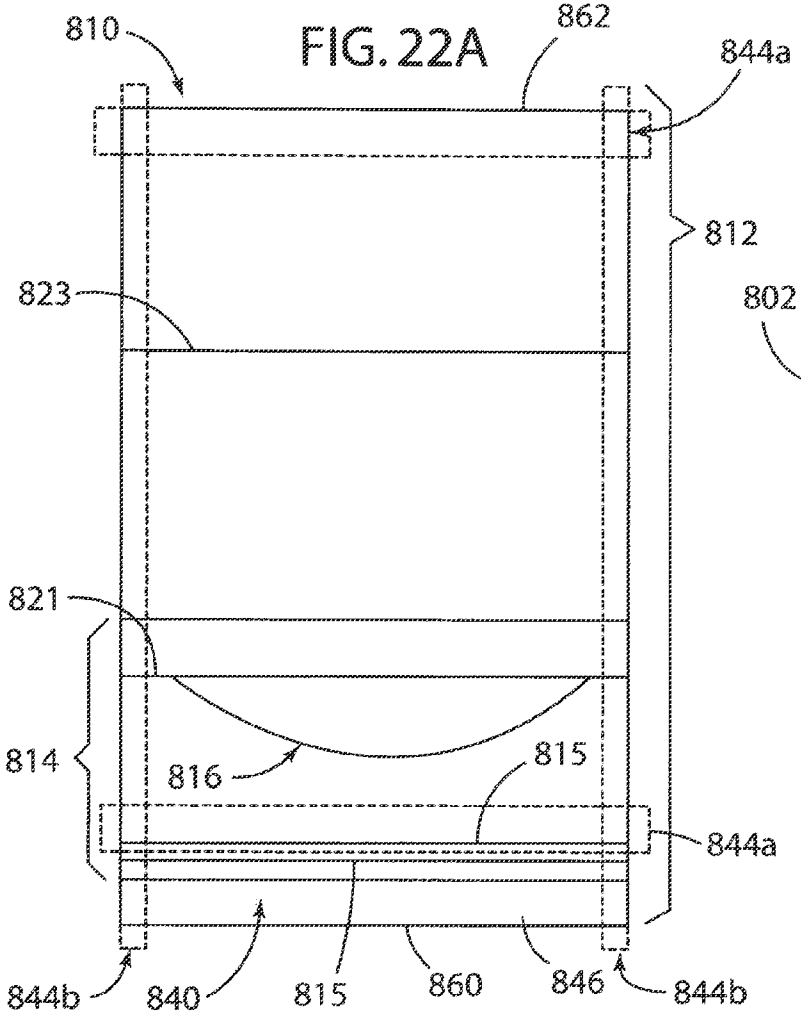
FIG. 22A is a plan view of another flexible film package blank.

Another package configuration is illustrated in FIGS. 22A to 22D. FIG. 22A shows a package blank 810 that may be formed into package 805 (FIG. 22B). The package blank 810 includes a flexible film 812 with a continuous closure layer 814 and an arcuate score line 816 disposed thereunder, as shown in FIG. 22A. FIG. 22A also illustrates tab score 815 disposed near tab score 840. The package blank 810 of FIG. 22A also illustrates where the fold lines 812, 823 will be disposed and where the seal areas 844*a* will form a lap seal 824 and where the seal areas 844*b* will form side seals 802, 804 to form a package 805. The formed package 805 illustrated in FIG. 22B includes two side seals 802, 804 and a fin or lap seal 824. FIG. 22B also shows tab score 815 and opening score 816 (in dashed lines).

Figure 22C:
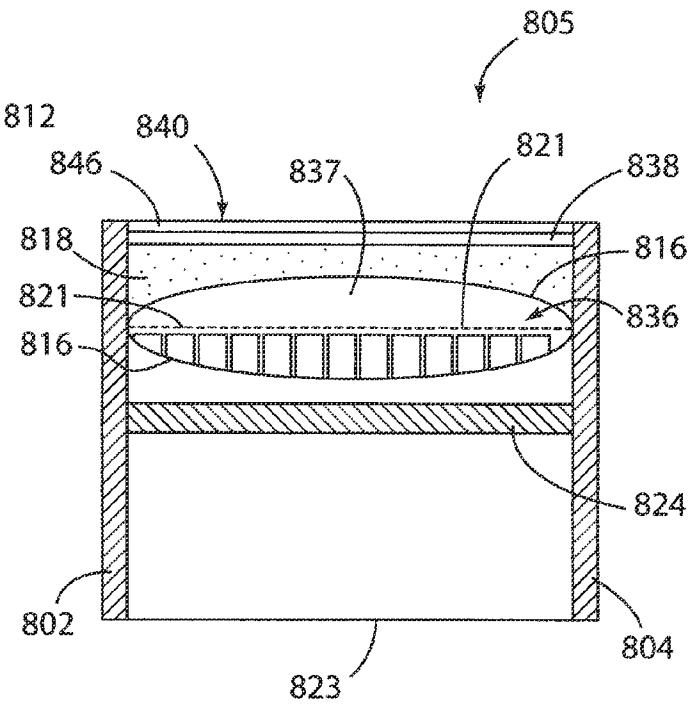
FIG. 22C is a side view of the flexible film package of FIG. 22B in an open configuration.
Figure 22D:
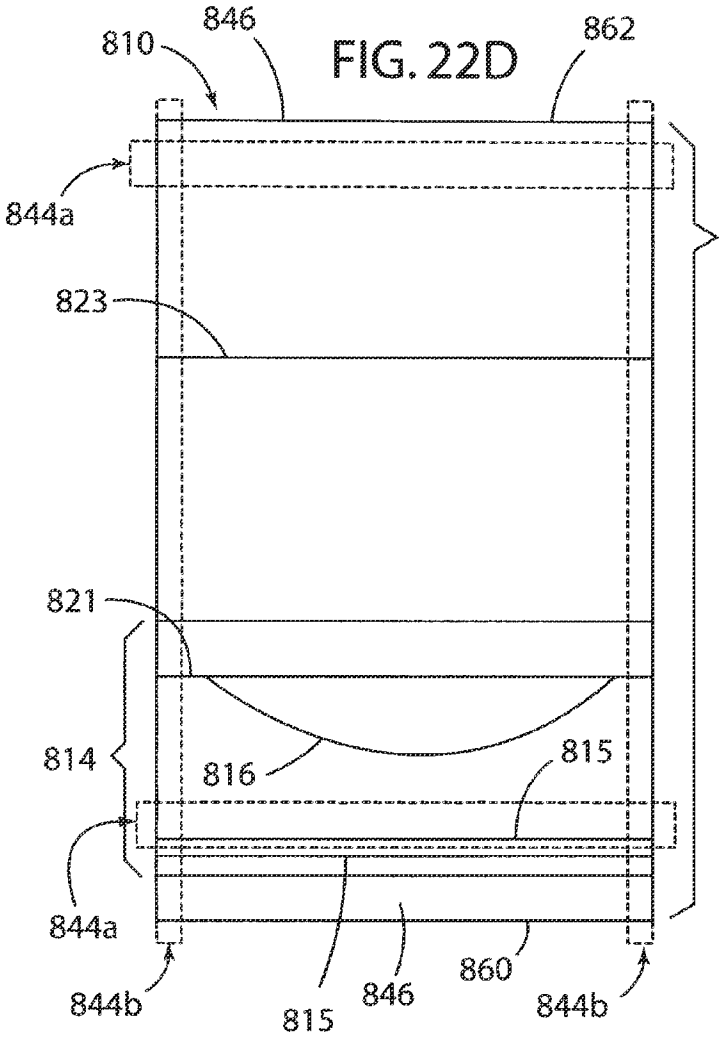
FIG. 22D is a plan view of another flexible film package blank.

The package 805 shown in FIG. 22B may be formed from two different package blanks. For example, FIG. 22A shows package blank 810 that may be formed into package 805 having a lap seal 824. Alternatively, FIG. 22D shows package blank 810 that may be formed into a package 805 similar to that shown in FIG. 22B with a fin seal 24, as opposed to a lap seal. If a lap seal is desired for the package 805, the free end 846 is disposed only adjacent the first end 860 of the flexible film 812, as shown in FIG. 22A. Alternatively, if a fin seal is desired for the package 805, a free end 846 is disposed adjacent the first end 860 and the second end 862 of the flexible film 812, as shown in FIG. 22D.

In addition, the package 805 includes a top fold 821 and bottom fold 823. The top fold 821 may be formed in the flexible film 812 and the continuous closure layer 814. In addition, a score 816 is formed in the flexible film 812 to create a package opening 836 (FIG. 22C) once the continuous closure layer 814 is lifted from the flexible film 812. As illustrated, the score 816 that forms the package opening may be disposed adjacent the top fold 821 such that the fold 821 and the continuous closure layer 814 help avoid additional tearing of the flexible film 812 beyond the score line 816. By one approach, the ends of score 816 are disposed at or near the fold line 821. Once the package 805 is opened, as illustrated in FIG. 22C, a package opening 836 may be formed by having a portion 837 of the flexible film 812 lifted with the continuous closure layer 814.

As shown in FIGS. 22A and 22D, the continuous closure layer 814 is disposed near free end 846 that may partly form the tab portion 840. A series of tab scores 815 may be disposed in flexible film 812 near the tab portion 840. Further, one of the tab score 815 may form a portion 836 of the flexible film 812 that is removed from the remainder of the film to cover a portion of the pressure sensitive adhesive 818 that is disposed on the tab portion 840. Thus, the tab portion 840 includes a free end 846 of the flexible film 812 and a portion 838 of the flexible film 812 that is removed from the remainder of the film 812 (and remains adhered to the pressure sensitive adhesive disposed on the underside of the continuous closure layer 814). To reseal the package 805, the pressure sensitive adhesive 818 (FIG. 22C) disposed between the continuous closure layer 814 and the flexible film 812 may reseal the continuous closure layer 814 to the flexible film 812 around the score 816 that forms the package opening 836.

Figure 18:
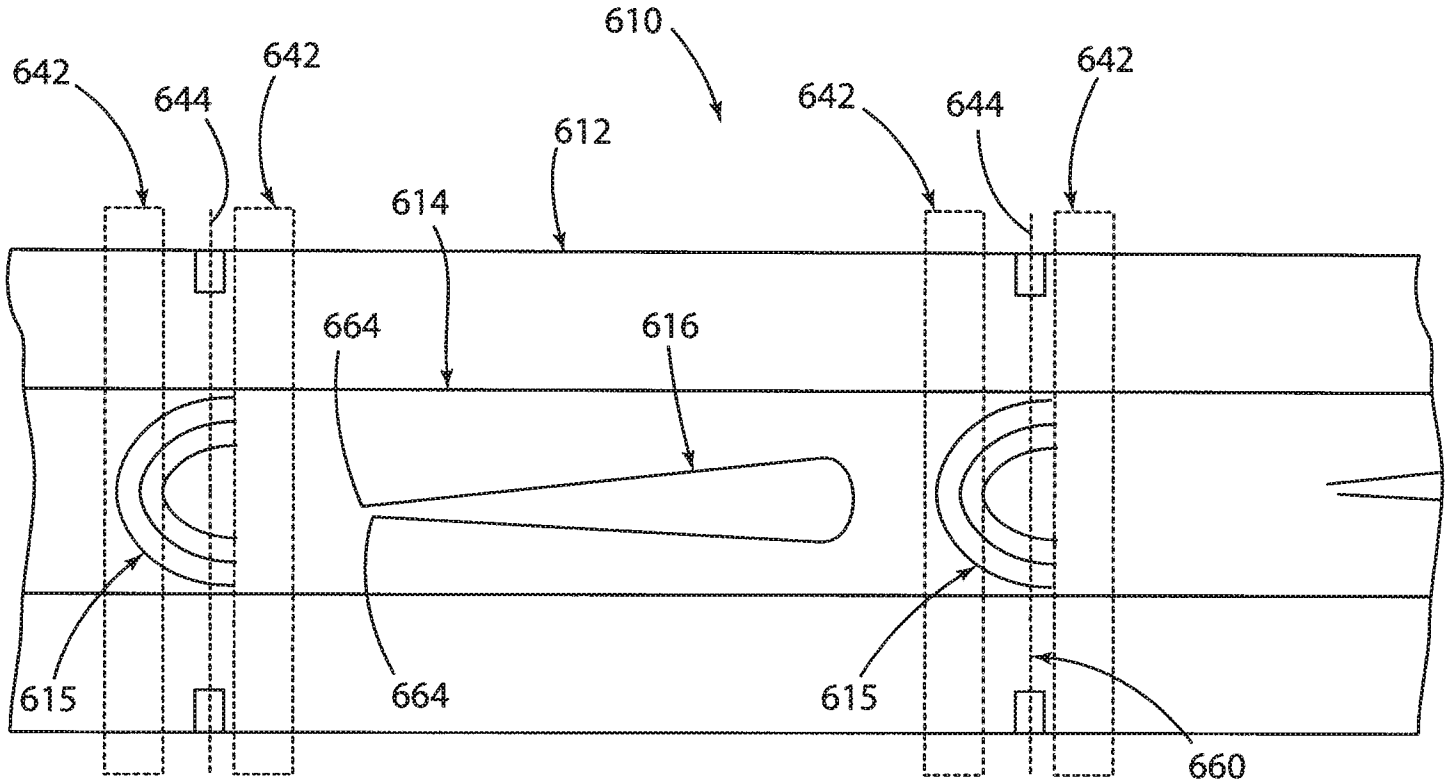
FIG. 18 is a plan view of a section of another series of flexible film package blanks.
Figure 19:
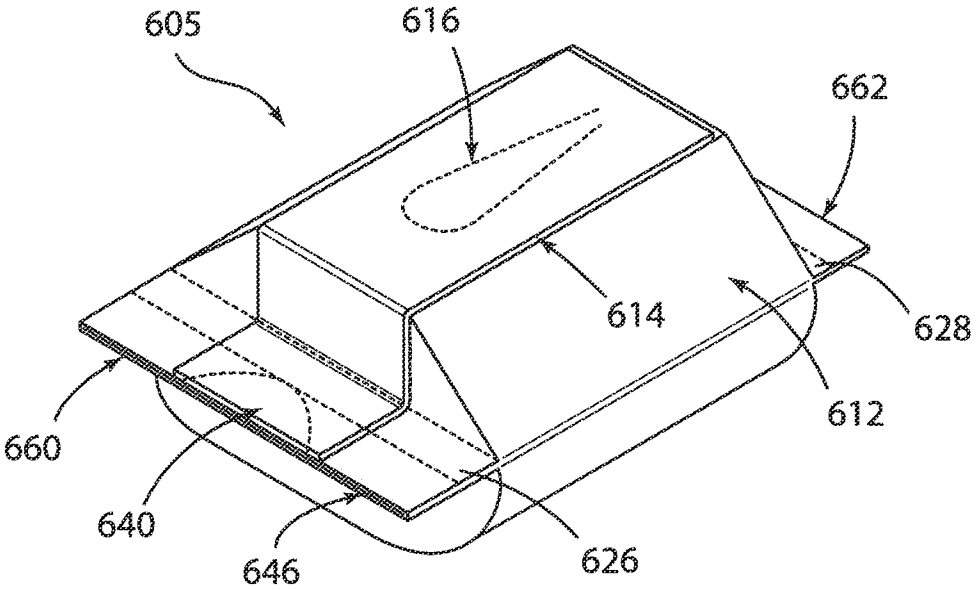
FIG. 19 is a flexible film package formed of one of the flexible film package blanks of FIG. 18.

Another illustrative series of flexible film package blanks 610 is shown in FIG. 18. The series of flexible film package blanks 610 are formed into individual flexible film packages 605 (FIG. 19). The series of package blanks 610 includes a continuous flexible film 612, a continuous closure layer 614, a score 616, and a tab score 615. In one illustrative example, the score 616 includes an arcuate portion that connects two generally elongated straight portions. Unlike other examples, the score 616 does not terminate at tear-inhibiting portions, i.e., hooks or J-shaped ends, that are configured to inhibit or prevent the score 616 from tearing beyond the formed scored. By one illustrated approach, during package opening, ends 664 of the score 616 will continue to tear the flexible film 612 past the initially formed score 616 such that the ends 664 of the score 616 eventually come together. In such a configuration, a closed-shape portion of the flexible film 612 will be formed by the tear lines or the score 616, and this closed-shape portion may be lifted from the flexible film 612 during package opening.

Figure 20:
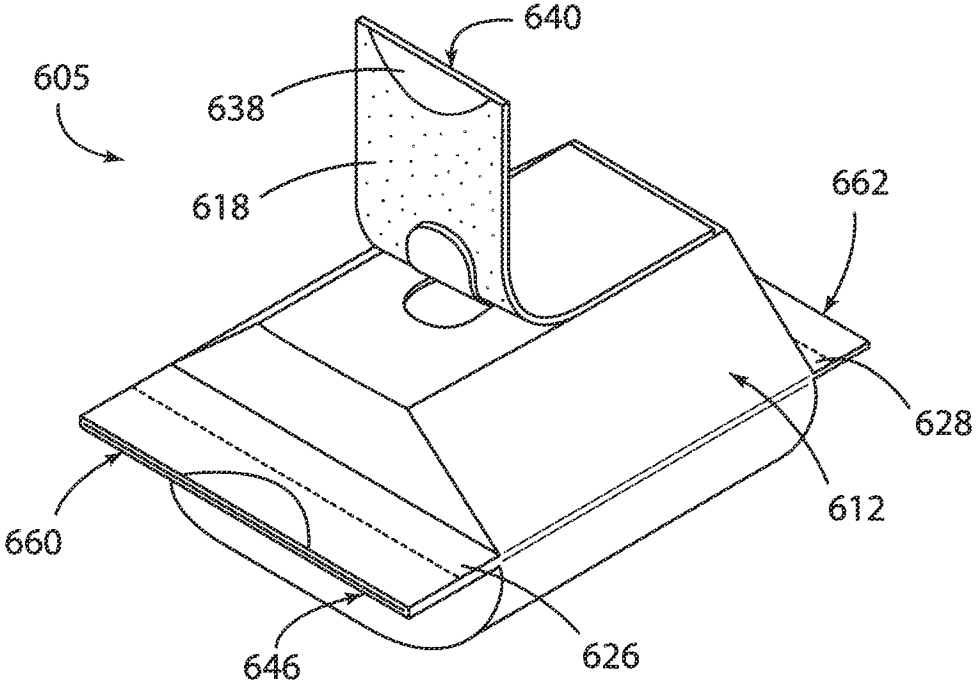
FIG. 20 is a portion of the flexible film package of FIG. 19 in a partially open configuration.

The series of flexible film package blanks 610, which has a continuous flexible film 612 and a continuous closure layer 614, is formed into individual packages 605 having an elongated closure layer 614 over the flexible film 612. The elongated closure layer 614 extends from the leading edge 660 to the trailing edge 662 of the package 605. The separation cut 644 is a straight cut in the illustrative example of FIG. 18. In addition, a tab score 615 having an arcuate configuration is disposed adjacent the leading edge 660 of the package 605. Specifically, the tab score 615 includes a series of spaced, arcuate scores. The tab score 615 intersects with the seal area 642 that forms the first end seal 626. Thus, when a consumer grasps a tab portion 640 at the free ends 646 and pulls upward from the package 605, a portion 638 of the flexible film 612 will be removed from the remainder of the flexible film and will cover a portion of the pressure sensitive adhesive 618 disposed on the closure layer 614 (FIG. 20).

Figure 21:
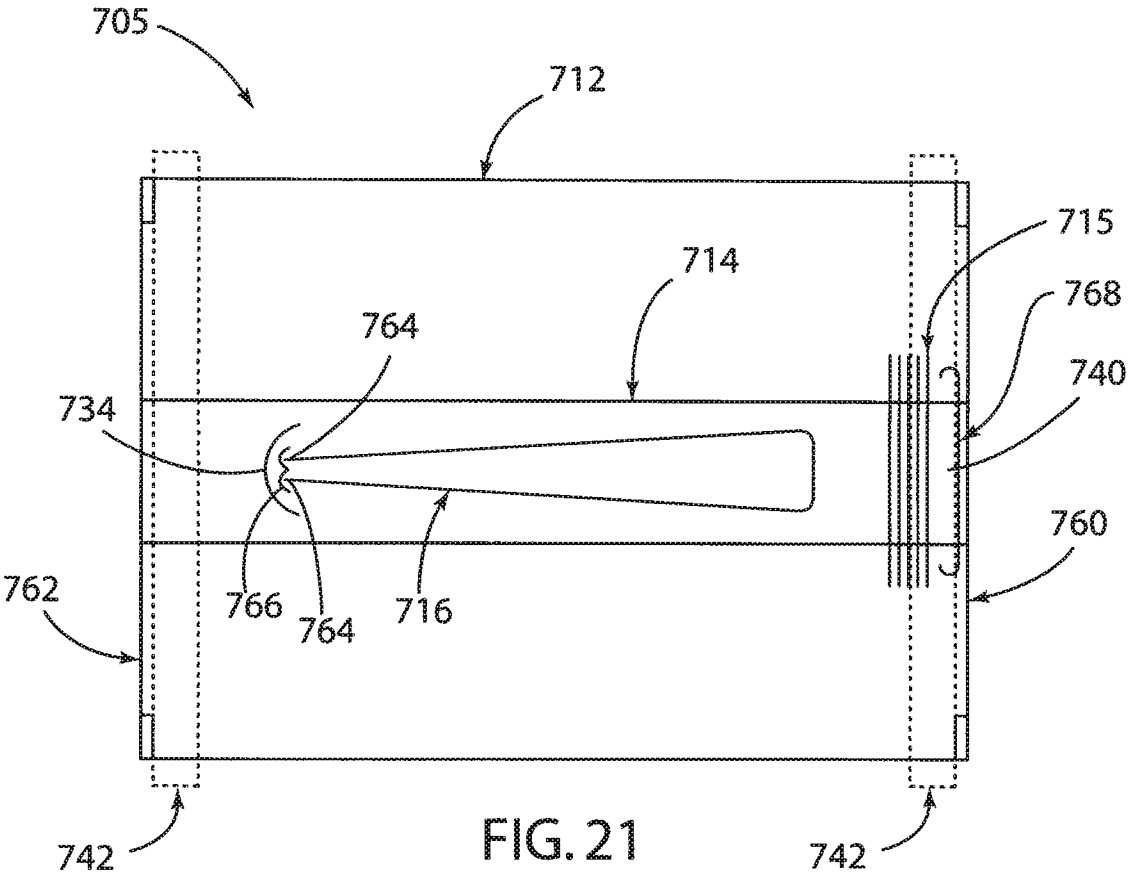
FIG. 21 is a plan view of another flexible film package blank.

An additional flexible film package blank 705 is shown in FIG. 21. The blank 705 includes a flexible film 712 having a score 716 with a continuous, elongated closure layer 714 disposed thereover. Score ends 764 have a wavy, arcuate score 766 (similar to two adjacent "smile" scores) located near the ends 764 that inhibit or prevent further tearing of the score 716 beyond the wavy, arcuate score 766. A further arcuate score 734 is positioned on the other side of the wavy, arcuate score 766, and provides additional resistance to further tearing of the score 716.

A tab score 715 is formed in the flexible film 712 near the leading edge 760 and includes a series of repeating straight lines. A tab cut 768 is formed through the flexible film 715 and the continuous closure layer 714. The tab cut 768 is positioned in between the leading edge 760 of the package and the tab score 715. For a package formed of the flexible film blank 705, a consumer can grasp a tab portion 740, having a tab leading edge that is formed by the tab cut 768 and a tab trailing edge that is formed by one of the lines of tab score 715 that intersect with the first end seal area 742. At the tab portion 740, a portion of the flexible film 712 is removed from a remainder of the flexible film to cover the pressure sensitive adhesive disposed on the surface of the elongated closure layer 714 that faces the film 712.

As noted above, the packages described herein may be formed in a variety of manners. For example, the packages may be formed in-line just prior to forming a package around a product or may be formed just prior to filling a package with product. As another example, the packages may be formed off-line well before the products are packaged. If the packages are formed off-line, the packages may be formed in a remote location away from the location where the packages are filled with product.

Before the flexible film is formed into a package, a continuous closure layer 914 may be applied to a flexible film web 912. In one example shown in FIG. 23, a continuous closure layer 914 having a pressure sensitive adhesive disposed on one side is applied to the flexible film web 912. The pressure sensitive adhesive is disposed on the side of the closure layer 914 that contacts the flexible film 912. In one configuration, the continuous closure layer 914 is wound on a roll (such as a roll of tape), that is unwound and then applied to the flexible film web 912. To aid release of the pressure sensitive adhesive from the opposing side of the continuous closure layer 914, a release layer may be deposited onto the opposing surface of the closure layer 914. It also is anticipated that a backing layer could be disposed between the pressure sensitive adhesive and the opposing side of the continuous closure layer 914.

Figure 26:
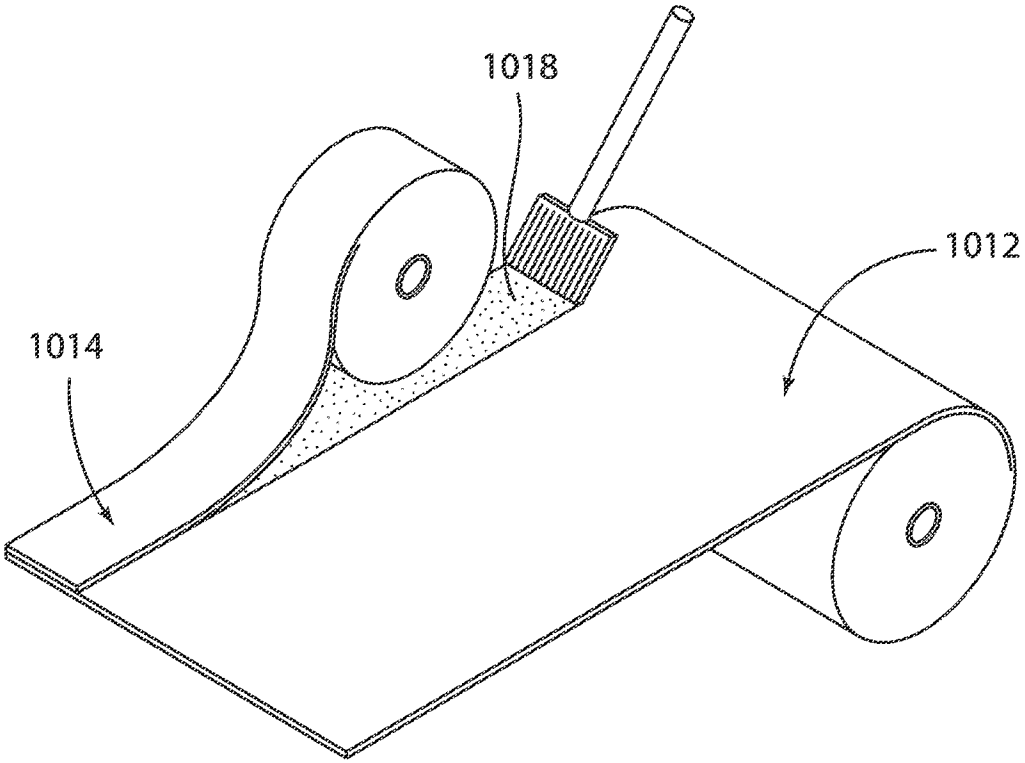
FIG. 26 is a schematic view of another process of applying a closure layer to a flexible film.

In yet another configuration, illustrated in FIG. 26, the pressure sensitive adhesive 1018 is applied separately from the continuous closure layer 1014. More particularly, instead of having the pressure sensitive adhesive previously applied to the closure layer (or previously applied to the film) before applying the closure layer to the film, the pressure sensitive adhesive 1018 may be applied around the time that the closure layer is applied to the film and in a separate application process. Thus, once the pressure sensitive adhesive 1018 is applied to the flexible film 1012, the continuous closure layer 1014 may be applied thereon. In another configuration, the pressure sensitive adhesive 1018 may be applied to the continuous closure layer 1014 just before application of the closure layer 1014 to the film 1012.

Figures 23, 24, 25:
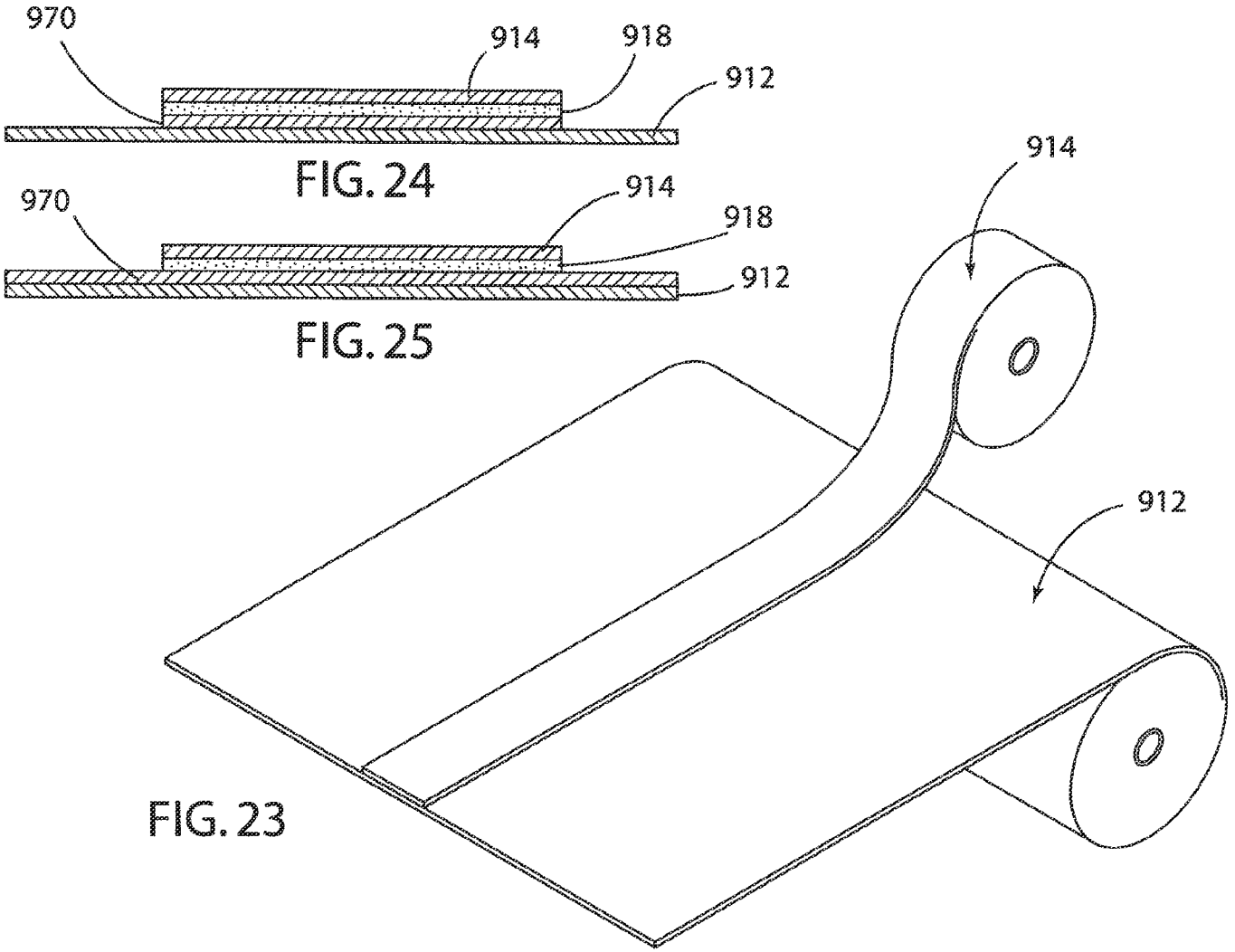
FIG. 23 is a schematic view of a process of applying a closure layer to a flexible film.
FIG. 24 is a cross sectional view of the laminate structure of the flexible film of FIG. 23.
FIG. 25 is a cross sectional view of another laminate structure.

FIGS. 24 and 25 illustrate exemplary cross sections of FIG. 23. As noted above, the packages may have a release ink 970 incorporated therein. The release ink 970, as illustrated, may be disposed between the pressure sensitive adhesive 918 and the flexible film 912. Furthermore, as shown in FIG. 24, the release ink 970 may be disposed just underneath the continuous closure layer 914. In another configuration, shown in FIG. 25, the release ink 970 may be disposed beyond the width of the continuous closure layer 914 and, in some configurations, may be disposed over the entire width of the flexible film 912.

Figure 27:
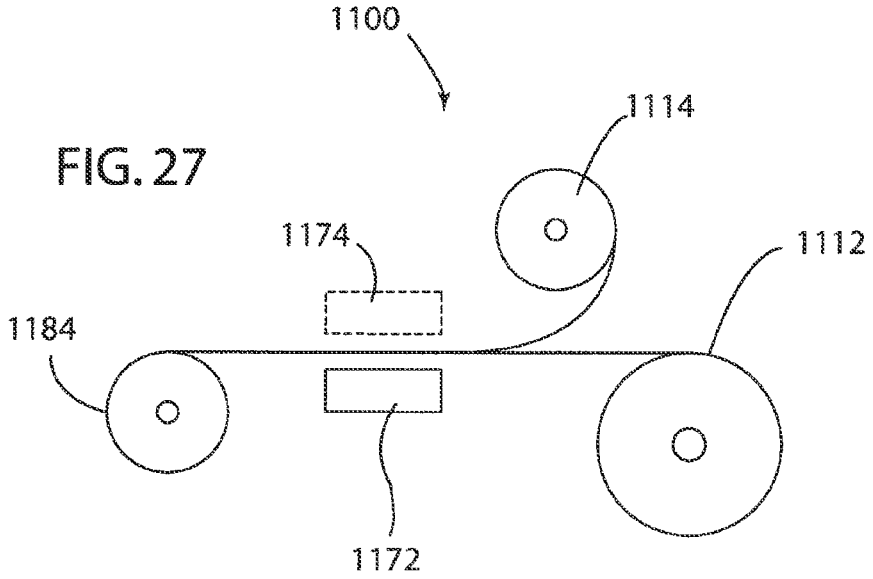
FIG. 27 is a schematic side view of an off-line process of forming a series of flexible film package blanks.

FIG. 27 illustrates one exemplary process 1100 for producing a series of flexible film package blanks in an off-line manner. In such a configuration, a continuous closure layer 1114 (which may be narrower than the width of the roll of flexible film web 1112) may be applied over a portion of the flexible film web 1112. In addition, a score may be formed into at least the flexible film 1112 by a score forming mechanism 1172. As noted above, the score may be formed on the interior surface of the package, i.e., on a side of the flexible film opposite the closure layer. In addition, if a score is formed into the continuous closure layer 1114 (either partially or completely through the closure layer), such as shown in configuration of FIG. 11, then another score forming mechanism 1174 (illustrated in dashed lines in FIG. 27) may be employed. Furthermore, though a single score forming mechanism 1172 is illustrated and may form both the score that provides a package opening and a score that partially forms the tab portion, these scores also may be formed by two separate score forming mechanisms.

The laminate including the scored flexible film web 1112 and the continuous closure layer 1114 then may be wound on a laminate roll 1184. This laminate roll 1184 may be subsequently brought to a packaging line for use in forming individual package filled with product. The packaging line may be within the same facility as the laminate forming equipment illustrated in FIG. 27, or alternatively, the laminate forming equipment may be remote from the packaging facility.

Figure 28:
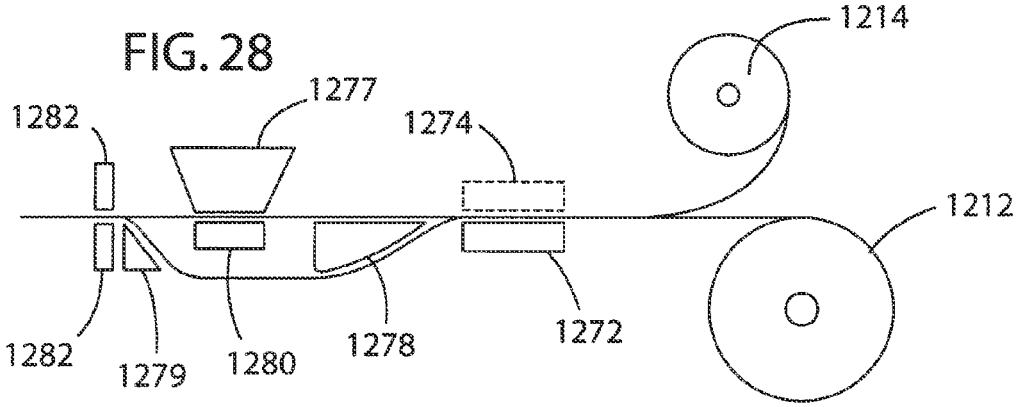
FIG. 28 is a schematic side view of an in-line process of forming a series of flexible film packages.

One exemplary in-line process 1200 for producing flexible film packages is shown in FIG. 28. By one approach, a continuous closure layer 1214 is applied to a continuous flexible film 1212. A score forming mechanisms 1272 may form the scores on the interior surface of the package. As noted above, if a score is formed through the continuous closure layer 1214, then a score forming mechanisms 1274 may be positioned adjacent the continuous closure layer 1214. Then, a package forming or folding mechanism 1278, such a forming collar, may be employed to wrap the flexible film 1212 and closure layer 1214 around a product or in a configuration that can retain subsequently filled product. A filling mechanism 1277 may be employed to fill product 1280 into the partially formed web of film. Once the flexible film 1212 and continuous closure layer 1214 are filled with product 1280, another package forming or folding mechanism 1279 may be positioned just upstream of package die 1282 (both of these functions may also be performed by a combined forming mechanism and package die). The package die 1282 may include the knife that forms the separation cut between packages and also may include the seal bars that form the end seals of the package. In addition, the package die 1282 also may form the longitudinal seal, though the longitudinal seal may also be independently formed. Though FIG. 28 illustrates a horizontal forming configuration, the processes described herein also may be performed in a vertical configuration.

In addition, while these two schematic views illustrate two exemplary manners of forming some of the package configurations described herein, additional elements may be added to form some of the packages. For example, to form packages from package blank 705 (FIG. 21), the processes may further include a tab cut assembly.

Turning now to FIGS. 31-34, various configurations of a flow-wrap package generally indicated at 10' are illustrated therein. In addition, FIGS. 35-38 illustrate the packages 10' of FIGS. 31-34 respectively in open configurations. Several of these packages are illustrated in various stages of manufacturing in FIGS. 39-43. Further, additional configurations of the labels and score lines are illustrated in FIGS. 46 to 50.

The various configurations of package 10' can be formed by joining opposing sides of the flexible film 12' together to form a seal 14'. By one approach, the flexible film 12' preferably has a sealant layer on an interior surface thereof. End seals, such as trailing and leading end seals 18', 20' also may be provided. By one approach, the leading end seal 20' may be non-peelable seals, i.e., a destructive seal where the sealant layers are considered to have bonded and do not separate from one another when pulled apart, such as that found in FIGS. 32, 34, 46-47. By yet another approach, the leading end seal 20' is a peelable seal, i.e., a seal having sealant layers that may be pulled apart or separated from one another, such as that found in FIGS. 31 and 33. Generally, at least one of the packages end seals may be a non-peelable heat seal, such as trailing end seal 18'.

Conventional film package end seals may not allow a user to easily open the package at the end seal itself, especially if very small or no free ends or unsealed portions are distally adjacent the end seals. In such configurations, the body of the package film may be grasped, and the package panels pulled apart to open the package. As disclosed herein, a tab portion may be provided to allow easier opening of the package. In one example, the leading end seal 20' has a pair of tabs 22' (one formed in the upper and lower portion of the flexible film) formed distal to the end seal 20'. As illustrated, tabs 22' are radially shaped tabs, though other shapes are possible. The tabs 22' provide a finger grip to initiate opening of the package. A trailing package edge 24' shows a concave radial shape corresponding to the shape of the tab 22' adjacent the leading edge. The reciprocal shape of the leading and trailing edges are formed when the flow-wrap package 10' is formed or separated from a roll of film or when the packages are separated from one another.

Figure 31:
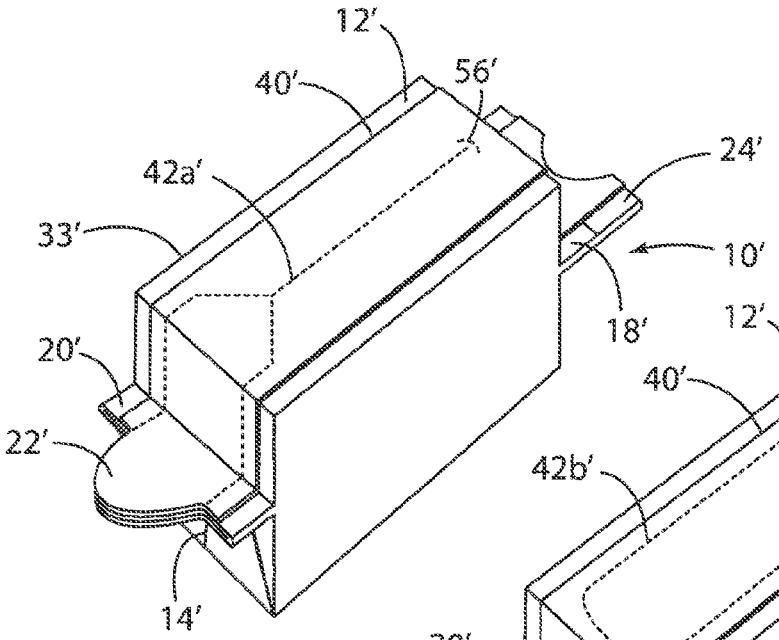
FIG. 31 is a perspective view of another flexible film package.

In the configuration of FIG. 31, the leading end seal 20' can be peelable. Peelability may be achieved by using a sealant layer on the interior surface of the film 12'. The peelable end seal can be formed by heating the seal area to between about 85 to 205 degrees Celsius, though the peelability of the seal is dependent on the range of heat used for the seal, line speed, and film thickness. Generally, the higher the temperature, the lower the peelability and the stronger the seal. In addition, the peelability and strength of the seal can be adjusted through the use of patterns or knurls. For example, if the pressure sensitive adhesive is not completely disposed to cover the entire surface area of the label 40. In such a configuration, the pressure sensitive adhesive may be provided in a patterned configuration, such as a cross-hatched pattern. By another approach, the sealing jaws that create the heat seals may include a knurl pattern thereon.

As noted above, laser-formed scores or mechanically-formed or rotary die cuts may be formed into the flexible film 12' and may define a package opening and/or the tab portion. The score may be added to the film surface that becomes the interior of the package. In addition, the die cutting or laser scoring of the film 12' is not limited to a particular gauge of material or composition. Thus, a variety of films may be used in the packages, which gives the package and the process for forming the package some flexibility. In addition, this can result in a product that is more cost effective than that found in the prior art. The tear strength of the score 42' may be at least weaker than the adhesive strength of the pressure sensitive adhesive 30' to permit a portion of film 12' to peel back with the label 40'.

By one approach, the score 42' only extends through a portion of the package to avoid negatively affecting the barrier properties of the package 10'. If the score 42' is a partial depth score line, the label 40' may not need to provide the initial hermetic barrier, though optionally it can. By yet another approach, the score 42' extends through the entire depth of the package film. The optional barrier properties of the label 40' may result from an inherent characteristic of the label material, or through an added barrier layer to label 40' (not shown). Further, in configurations where the score 42' may affect barrier properties of the film 12', the label 40' may be configured to compensate for the compromised barrier properties.

A variety of differently configured score lines may be incorporated into package 10'. For example, depending on the packaging materials, configuration, and product specifications, the desired package opening and tab may change. The seal area or end seal can stop or inhibit propagation of a score or the score pattern itself may be configured to provide such control. FIGS. 31 to 34 and 46 illustrate several possible configurations.

Figure 35:
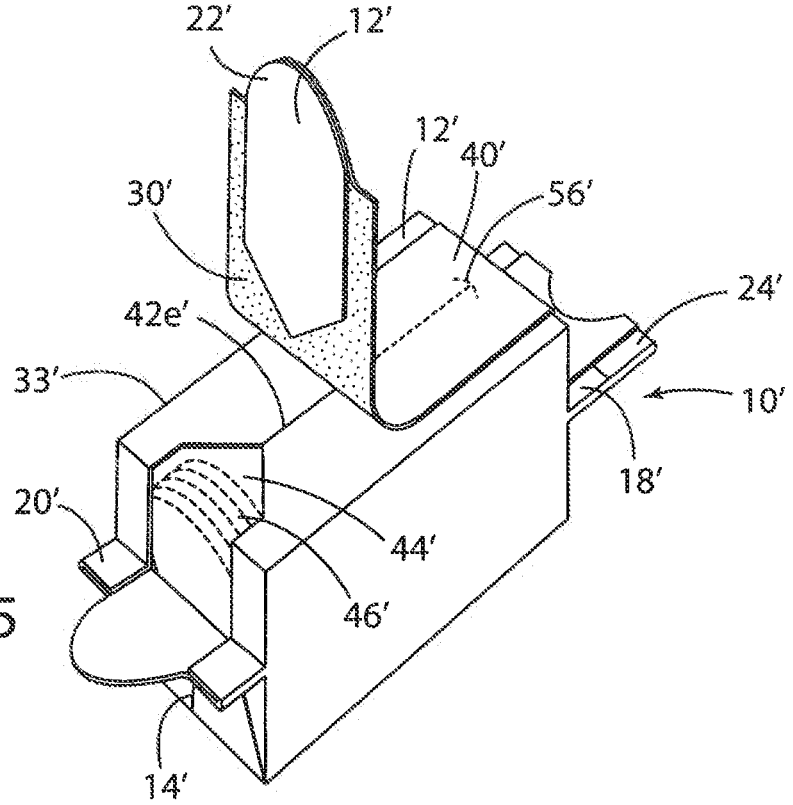
FIGS. 35 to 38 are perspective views of the flexible film packages of FIGS. 31 to 34, respectively, in open configurations.

As shown in FIG. 31, a score line **42*a*' begins at the leading edge of the package (near the end seal 20') with two score lines that extend rearwardly, angling inward and merging to form a single tear line before terminating at an arcuate "smile" portion 56' discussed below. In this configuration, a consumer may grasp an unsealed lower layer of tab 22' with one hand and the laminate of label 40' and tab 22' from the upper film 12' with the other. The upper portion of tab 22' can be peeled back, rearwardly, to expose opening 44'. Once the opening 44' is exposed, the label 44' may be used to reclose the package 10'. As shown in FIG. 35, the label 40' may be pulled off the package 10' to expose product 46'; however, the label 40' is preferably not pulled entirely off the package 10' during use. To prevent removal of the label 40' from the package 10', the trailing end seal 18', may include a permanent, non-peelable seal adhering label 40' to film 12'**.

Figure 32:
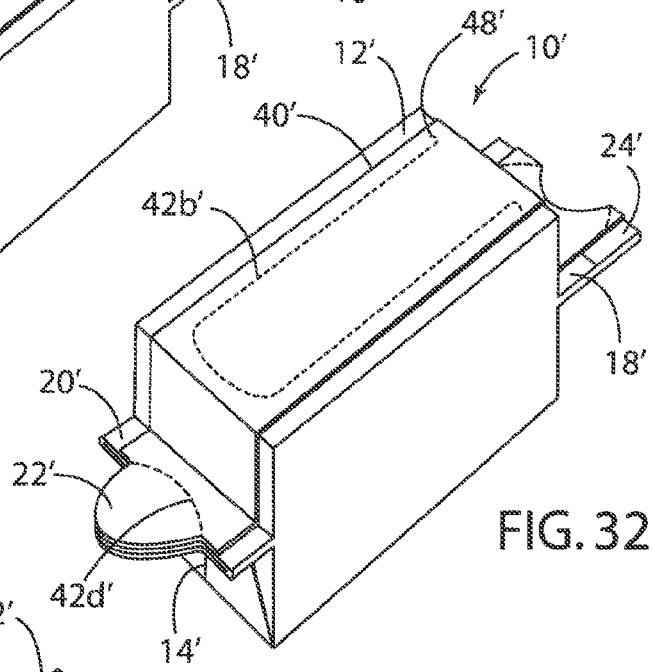
FIG. 32 is a perspective view of another flexible film package.
Figure 33:
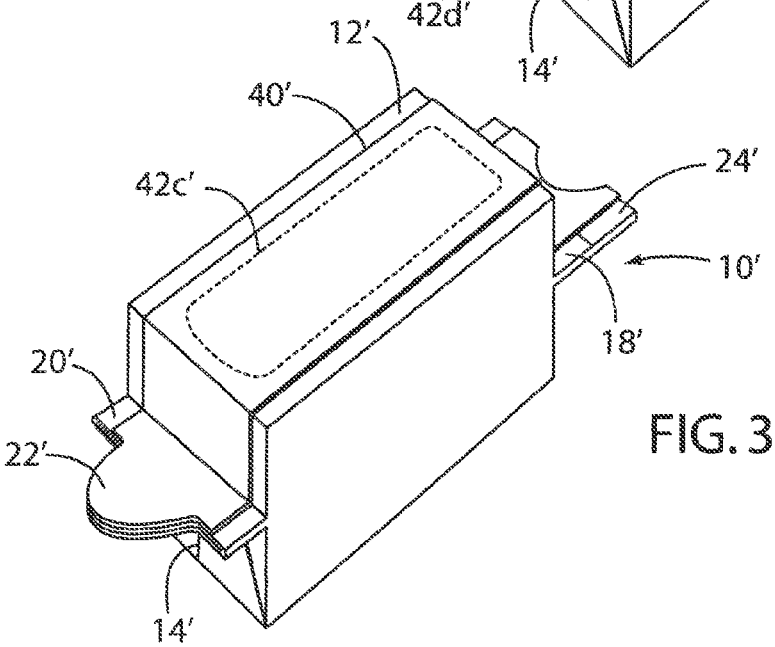
FIG. 33 is a perspective view of another flexible film package.
Figure 34:
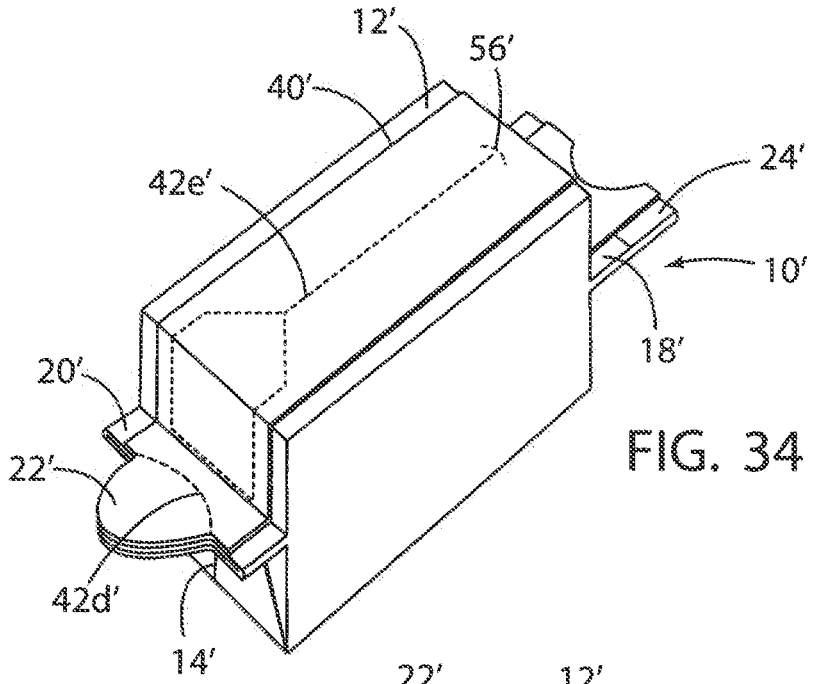
FIG. 34 is a perspective view of another flexible film package.

FIGS. 32-34 illustrate additional score configurations **42*b*', 42*c*', 42*e*'. These lines may be straight, arcuate, or a combination of both. While the score 42*a*' extends into the leading end seal 20', scores 42*b*', 42*c*', 42*e*' are disposed between the end seals 18', 20' of one package 10'. The score lines, such as 42*c*' and 42*e*', may be used to provide a portion or cut-out of film 12' that is completely removed from the remainder of the film 12' (See FIGS. 37 and 38). In addition, the score lines, such as 42*a*', 42*b*', 42*d*'** may include a terminus designed to prevent or inhibit further propagation of the score line past the score provided in the film during manufacturing.

Figure 37:
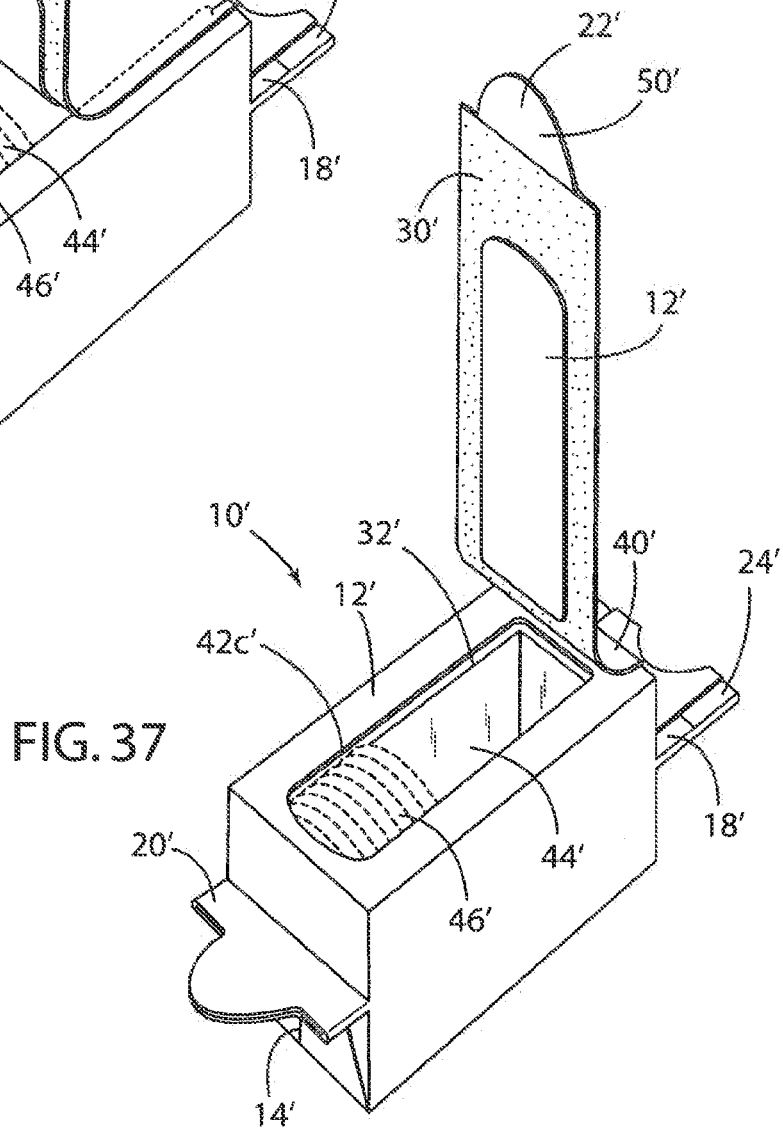

To facilitate grasping and pulling of tab 22', the label 40' may include an adhesive free area 50'. While some previously described configurations disclosed a portion 38 of the flexible film 12 peeling upward from the remainder of the package, other configurations (such as FIG. 33) may include packages where there is no tab score to form a portion 38 for separation from the flexible film. If only the closure layer or label is pulled upward from the film at the end seal, the grasping, tab portion is formed in another manner. For example, the tab 22' may be formed without any pressure sensitive adhesive disposed thereon. As illustrated in FIG. 37, a tack free or adhesive free area 50' can be employed to form tab 22'. In addition, a deadening agent may be used to deaden the adhesive applied thereto. For example, a coating process, such as that employing an ink or varnish, may be used to deaden the adhesive on the tab 22'. In addition, the continuous closure layer or label 40' may be folded over upon itself to form a tack free area that may form tab 22'. If only the label 40' is lifted from the package to expose the package opening (i.e., a portion is not removed from the remainder of the film), then the leading end seal adjacent the tab 22' can extend to the leading edge of the package or the separation cut that forms the package.

Figure 46:
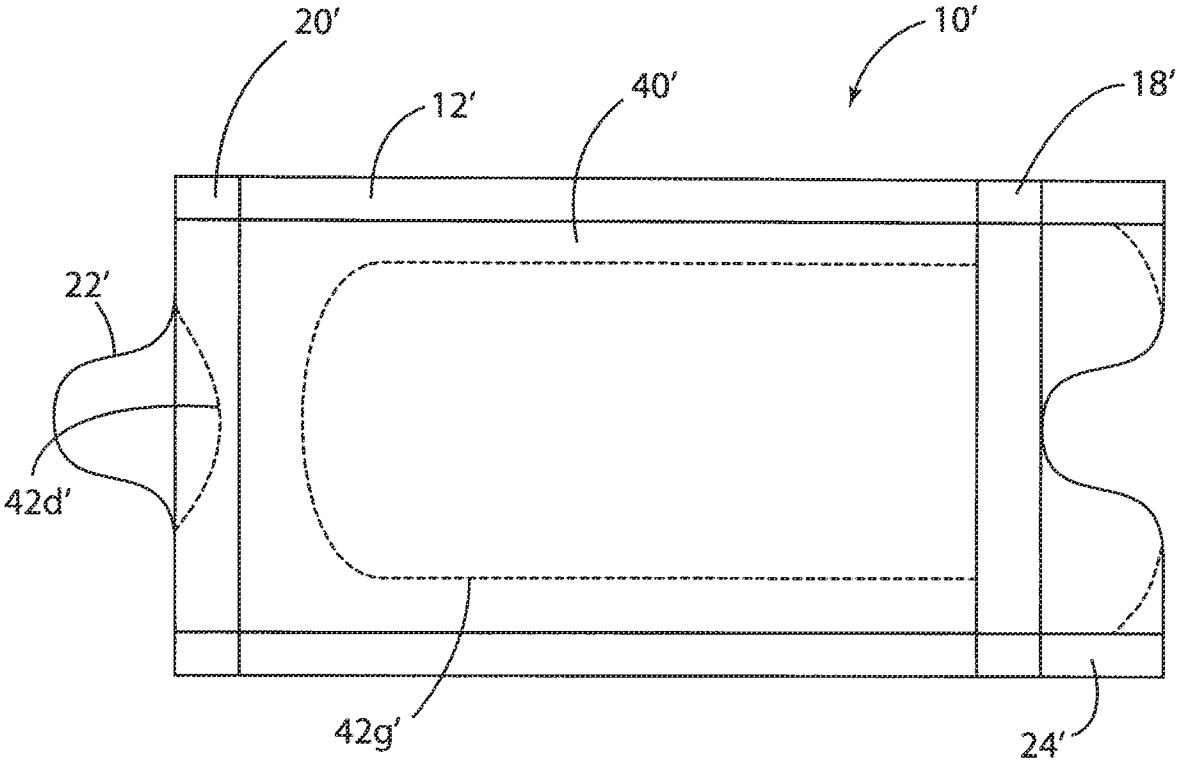
FIG. 46 is a top view of another flexible film package.

As discussed above, in addition to an adhesive-free or adhesive-deadened zone, the tack-free tab may be formed by having a portion of film cover the adhesive. In sum, a portion of film 12' may separate from the remainder of the film 12' to cover the adhesive. As shown, for example, in FIG. 32, a score line 42*d*, such as a crescent shaped score, may be added into the film 12' at the top layer of the end seal 20' to permit a portion of the film 12' to separate therealong. In FIG. 32, the upper layer of tab 22' is not sealed (or peelable) with the lower layer of tab 22' because the scored, removable portion of film 12', remains attached to the label 40', as illustrated by the scored cut-out 42*d*'. In one configuration of FIG. 36, the leading end seal 20' is preferably a non-peelable, permanent seal that retains its integrity even after the label 40' has been pulled and the package opened and closed. Further, the package 10' may be opened by peeling the resealable label 40' upward from the non-peelable seal between the film layers without disturbing the end seal 20'. A similar package configuration is illustrated in FIG. 46.

Exposed score lines tend to propagate a continued tear in use. Specifically, as a score line is being separated or ruptured the film will continue tearing past the point where the score line is originally formed in the film once the score line has begun separating. Thus, score lines may be configured to inhibit or resist this tendency. For example, FIGS. 31 and 34 illustrate an arcuate "smile" portion 56' at an end or terminus of score line 42*a*'. FIG. 32 illustrates a "shepherd's hook" or J-shaped hook at the terminus of the score line 42*b*'. FIG. 33 illustrates a score line 42*c*' having a closed shaped loop, which also helps prevent undirected tearing of film 12'. FIG. 46 illustrates a score line 42*f*' extending into permanent, trailing end seal 18'.

Figure 38:
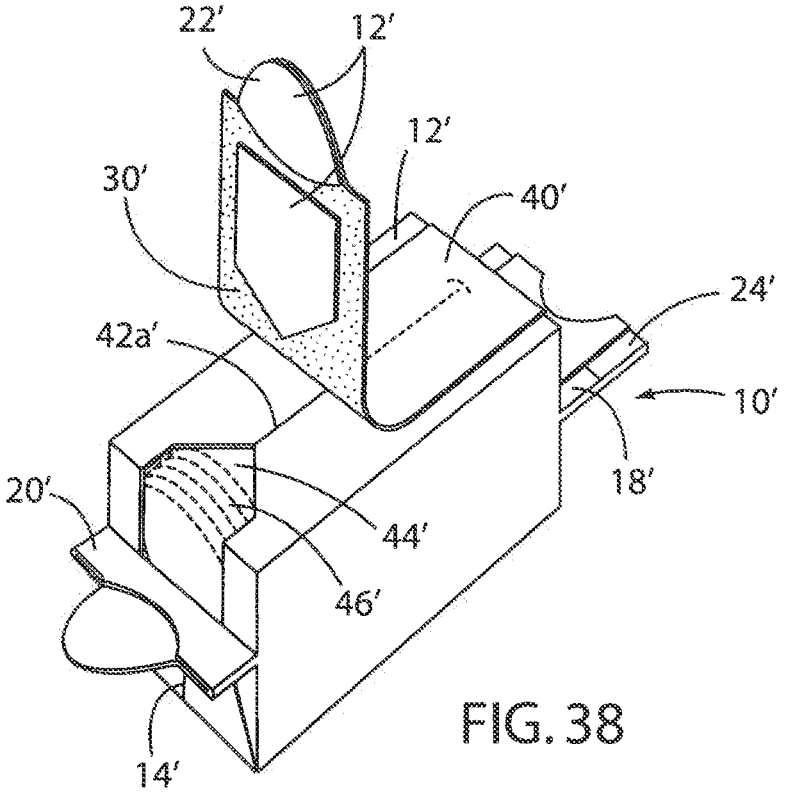
Figure 39:
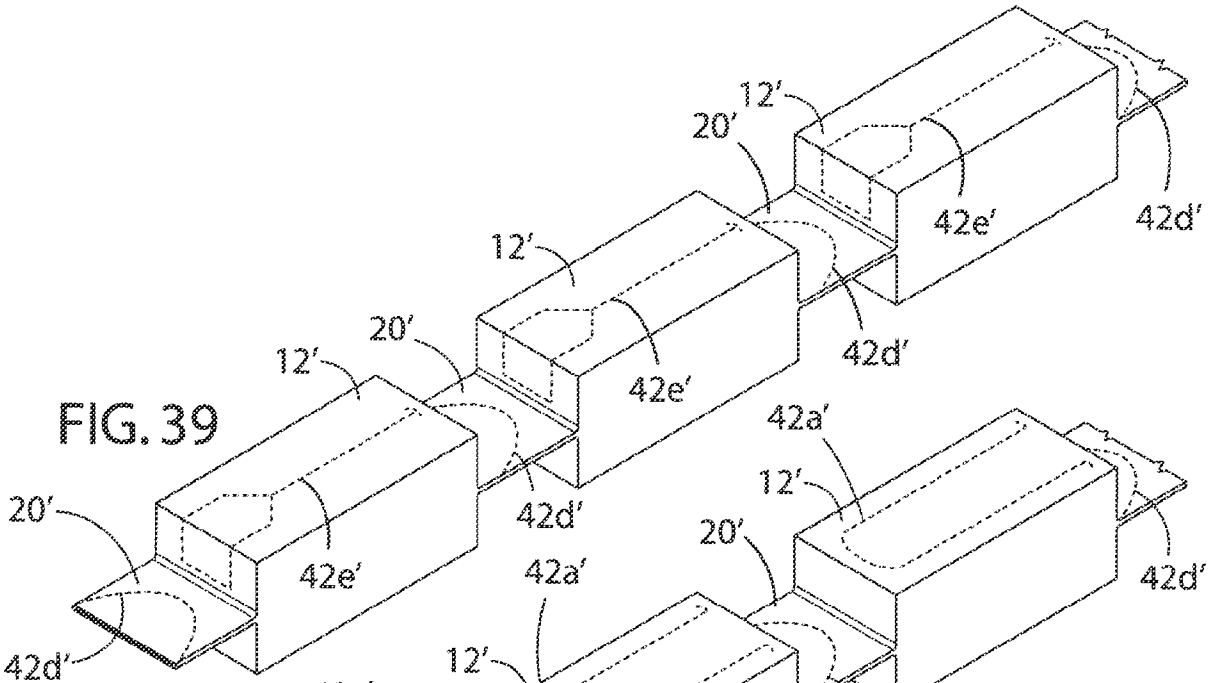
FIGS. 39 and 40 are perspective views of the flexible film packages of FIGS. 31 and 32 in a continuous flow-wrap configuration illustrated without the label applied and prior to separation into individual packages.
Figure 40:
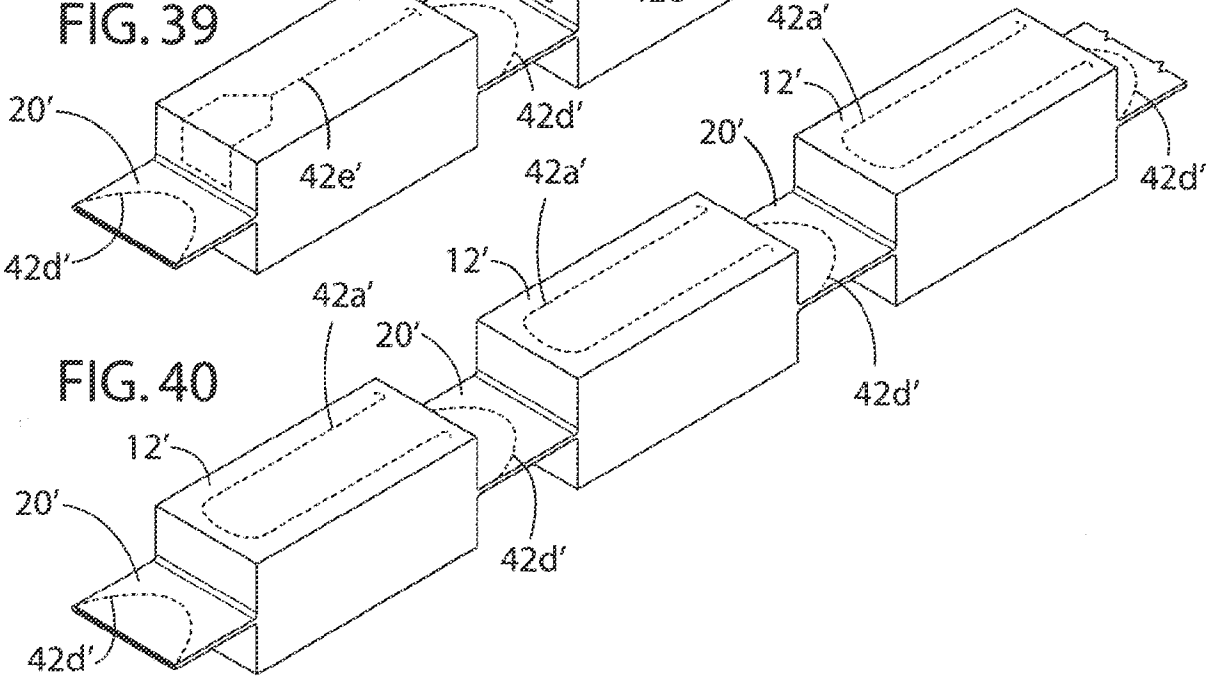

In addition to the "smile" portion 56', score line 42*a*' also includes a single, straight portion that separates into two portions that angle outward before becoming parallel to one another closer to the leading end seal. The score line 42*a*' extends to the leading edge of the package 10'. FIG. 34 includes a score line 42*e*' similar to that found in FIG. 31, except prior to reaching the leading end seal 20', the score line 42*e*' angles inward and becomes a closed shaped loop. As illustrated in FIG. 38, the package 10' of FIG. 34 includes a portion of film 12' that is removed from the remainder of film 12'.

Figure 36:
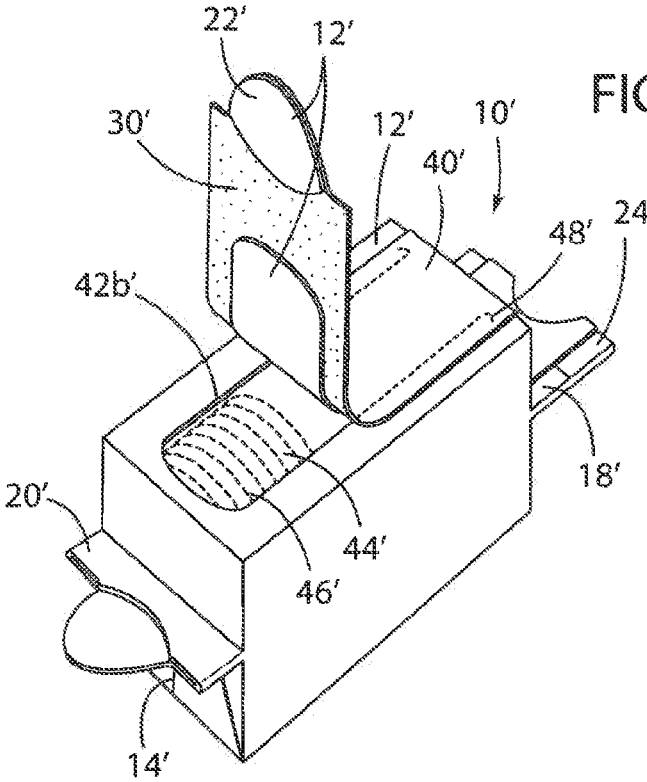

As discussed above, a continuous closure layer or label 40' may be applied to the exterior side of film 12' that is directed to the outside of package 10', preferably using a pressure sensitive adhesive. The label 40' preferably covers at least the score lines 42'. The peel strength between the surface of the package 10' and the label 40' is greater than the force required to separate sides of the score line 42'. Further, label 40' is peelable with respect to package 10'. For example, FIGS. 36 and 37 illustrate a portion of film 12' adhering to label 40' and the pressure sensitive adhesive disposed thereon to expose package opening 44'. Thus, continued pulling on tab 22' initiates rupture or separation of the score line 42'. In one illustrative embodiment, the pressure sensitive adhesive can be configuration, for example, to have an opening (separating) force of about 350 grams/inch and a closing (adhering) force of about 200 grains/inch. In addition, other opening and closing force ranges are considered to fall within the scope of the present embodiments.

The label 40' may be any film with an adhesive coving such as, for example, a flexible film with pressure sensitive adhesive, a tape, label, or linerless label that is continuously applied longitudinally to the flow of film, unlike discrete labels known in the art. By one approach, a linerless label may be a facestock having a pressure sensitive adhesive coating on one side and can be rolled onto a spool without a liner. For example, a release coating may be applied to the side of the label opposite the side with pressure sensitive adhesive. Facestocks may include, for example, standard paper, film, plastic, fabric, foil, direct thermal, and the like. In addition, linerless labels are available with removable and repositionable adhesives.

Figure 47:
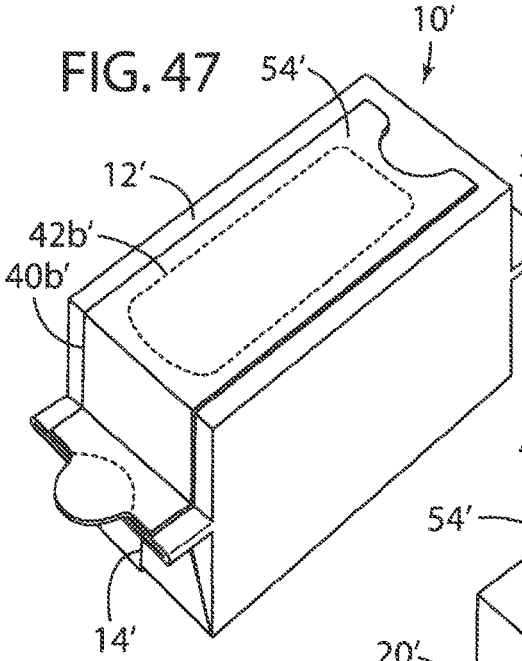
FIGS. 47 to 49 are perspective views of flexible film packages.
Figure 48:
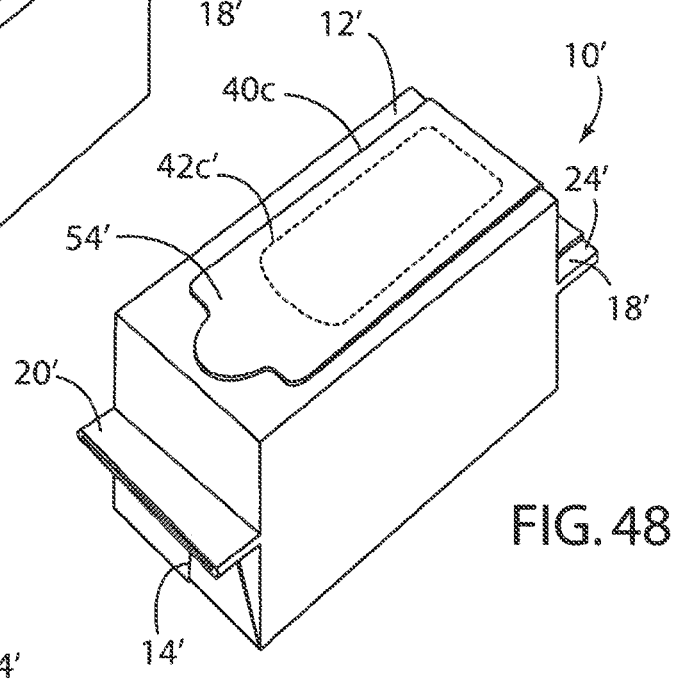
Figure 49:
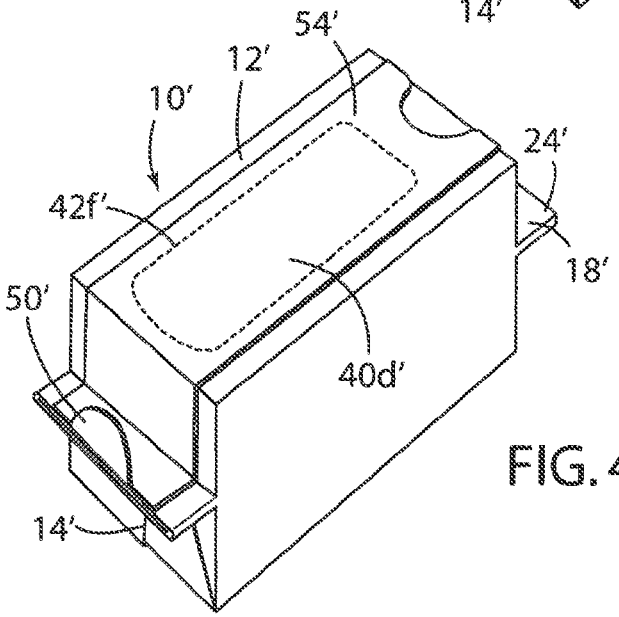

If tape or a linerless label are employed, the liner waste is eliminated. In addition, precise registration of the label on each package is no longer required due to the continuous application of the label on the flow of package film. Though the package 10' may be formed with a continuously disposed label 40', the package 10' may also be formed with a discrete label 40*b*', 40*c*', 40*d*' as shown in FIGS. 47-49.

As noted above, additional scoring, such as tab score 15 previously discussed, may be employed to assist in forming a tab. As illustrated in FIGS. 32 and 34, score 42*d*' can be added to package 10' to assist in the rupture of film 12' by forming a separable portion that can adhere to tab 22'. FIGS. 36 and 38 also show that a user can pinch and pull the laminate (including upper film 12' and label 40') rearward to open package 10'. As it is pulled, score 42*d*' separates or ruptures such that a portion of film 12' separates from the remainder of the film and pressure sensitive adhesive 30 is exposed on the underside of label 40'. This permits a portion of the film 12' to remain on label 40' to provide a tab having no exposed adhesive, while also providing sufficient adhesive on the label 40' to cover and surround opening 44'. Also, during open and reclose of the package 10', the leading end seal 30' remains intact, despite separation of a portion of the film 12' near the leading end seal 30'.

Figure 50:
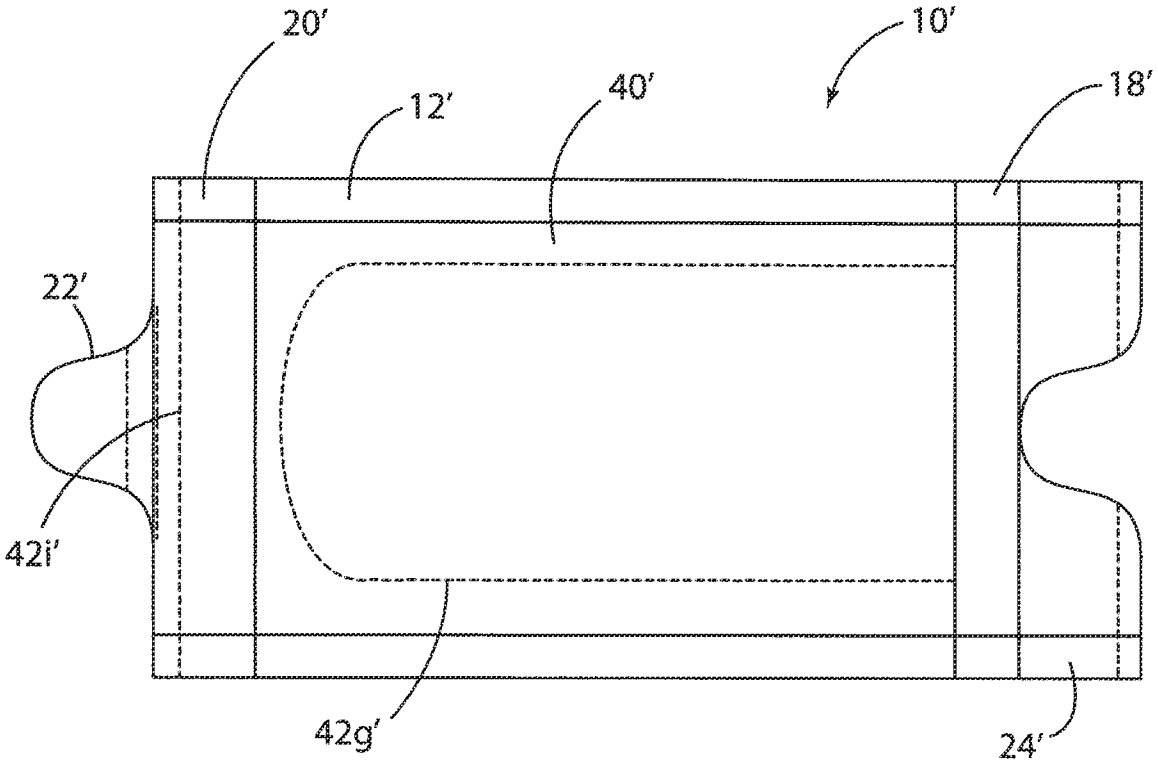
FIG. 50 is a top view of another flexible film package.

Another configuration, illustrated in FIG. 50, includes a score line 42*g*' that is disposed within ends seals 18', 20' and score line 42*i*' that is disposed at end seal 20'. Specifically, score line 42*g*' is formed in film 12' and includes a slightly arcuate portion connecting two parallel portions. The slightly arcuate portion of the score line 42*i*' is disposed near end seal 20', and the parallel portions extend to end seal 18'. The score line 42*i*' includes a series of straight parallel lines formed in film 12'. Having multiple lines helps ensure that at least one of the multiple lines is disposed distal and adjacent to the end seal 20'. In this way, one of the multiple score lines 42*i*' will permit a portion of the film 12' to be removed from the remainder of the film 12' to cover the pressure sensitive adhesive on the label 40'. Further, to permit removal of a portion of the film 12' for a tab, at least a portion of the score line 42*i*' is preferably positioned on film 12' outside of the interior space of the package 10', i.e., not between the end seals 18', 20'. In short, having multiple score lines adjacent the end seal and distal thereto allows a tab to be created even if, during production, the registration of the package elements is misaligned.

Figure 44:
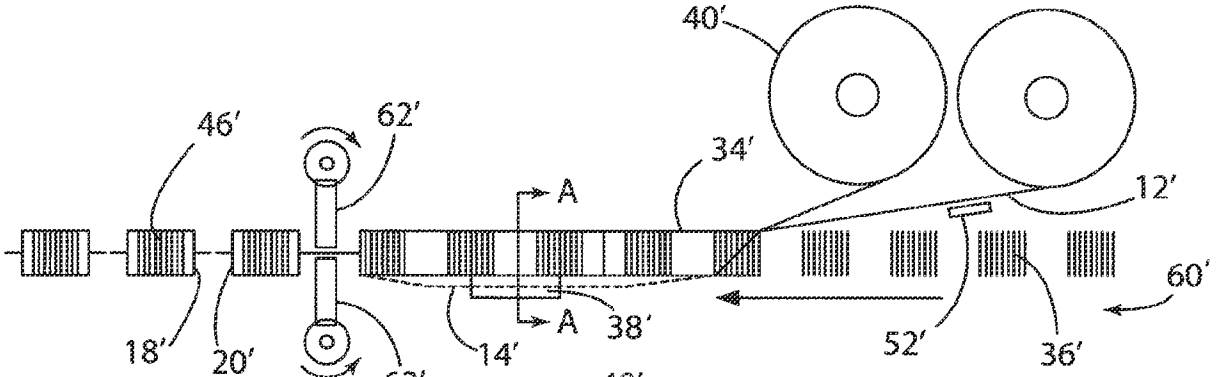
FIG. 44 is a schematic side view of a process for forming flexible film packages with a continuous closure label.
Figure 45:
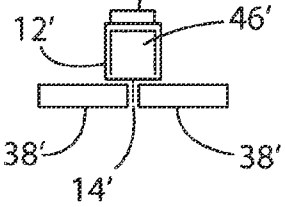
FIG. 45 is a schematic cross sectional view of a seal jaw taken along section line A-A of FIG. 44.

Flexible film packages 10' may be fixated and assembled in a variety of manners. An exemplary process 60' for forming flexible film packages is schematically illustrated in FIGS. 44-45. In one configuration, opposite sides of the film 12' may be joined to form a fin seal 14', and a package height and interior space may be defined. More particularly, fin seal 14' may be formed as two film edges are brought together and sealed by heated wheels. To facilitate the formation of the desired type of seal, a sealant layer may be disposed or applied to the film 12'. While the sealant or internal adhesive may be applied such that it covers the entire interior surface of the film 12', it also may be applied only where it is needed to provide a seal, i.e., near the end and fin seals.

The end seals 18', 20' may be formed once product 46' has been placed in the interior space of package 10'. End seals 18', 20' also can define package 10' width or length. The seals 14', 18', 20' are preferably hermetic seals that form a gas and moisture barrier. Similar to other seals discussed herein, the seals 14', 18', 20' can be thermoformed (i.e., heat welded) or formed through other welding means. For configurations where the end seal 20' is peelable, a low tack adhesive or a cold seal and processes for forming such seals may be used. In addition, the end seals 18', 20' may employ patterns, crimps, or knurls.

Figure 41:
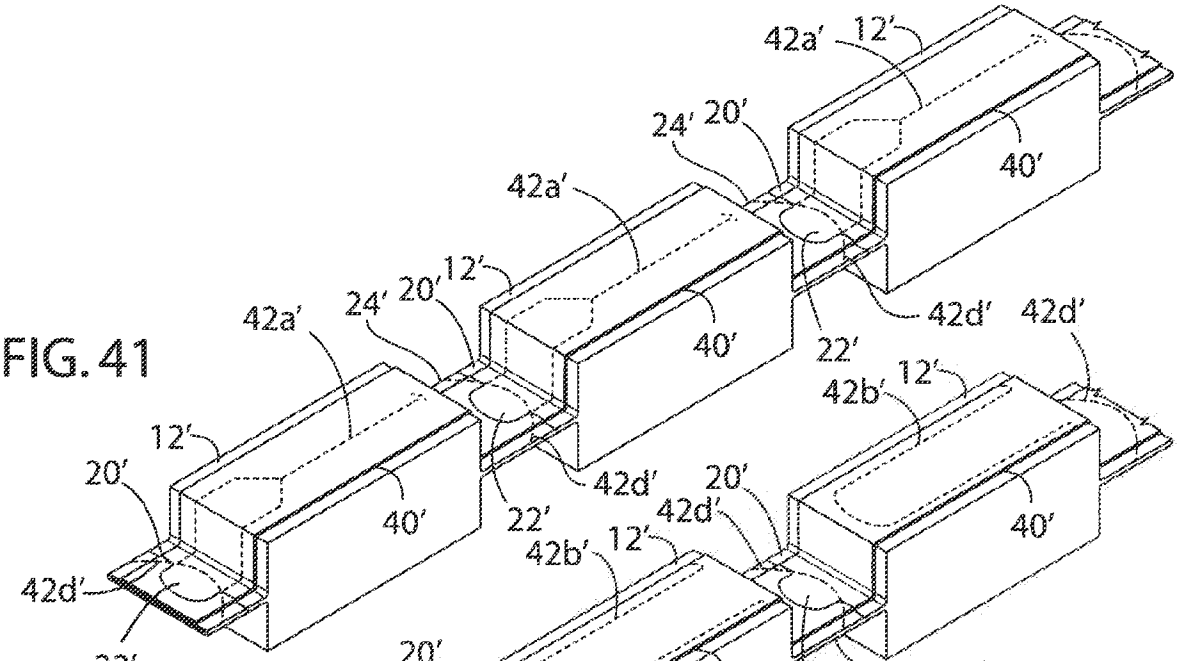
FIGS. 41 and 42 are perspective views of the flexible film packages of FIGS. 31 and 32 in a continuous flow-wrap configuration after formation of end seals and application of the label.
Figure 42:
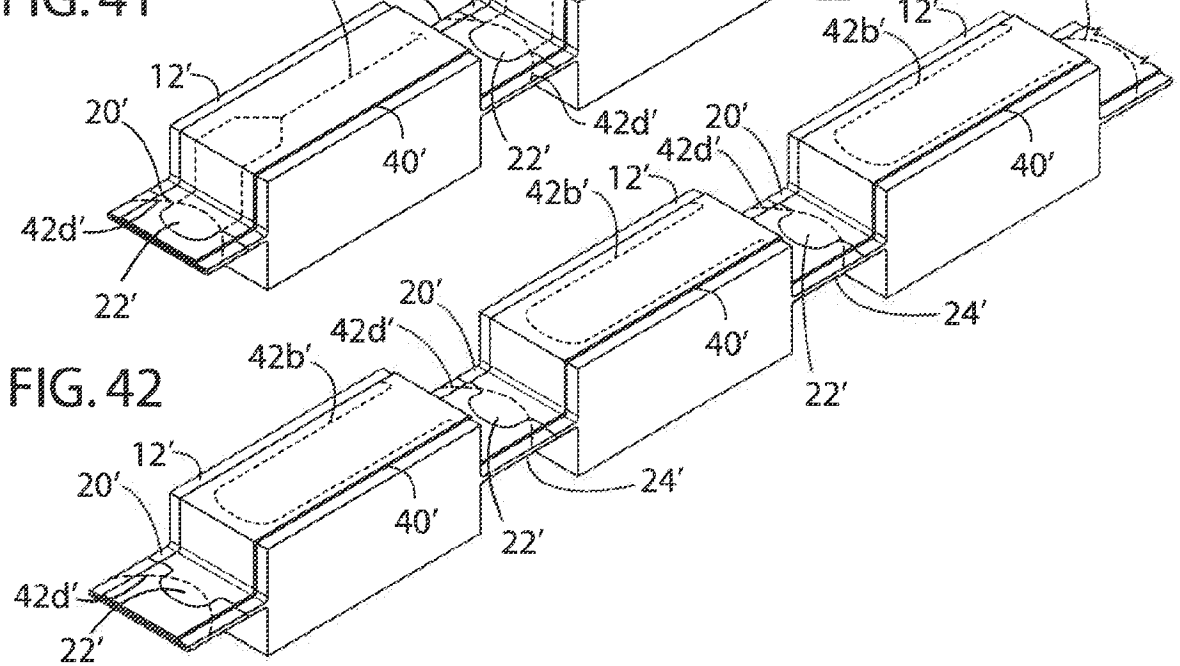
Figure 43:
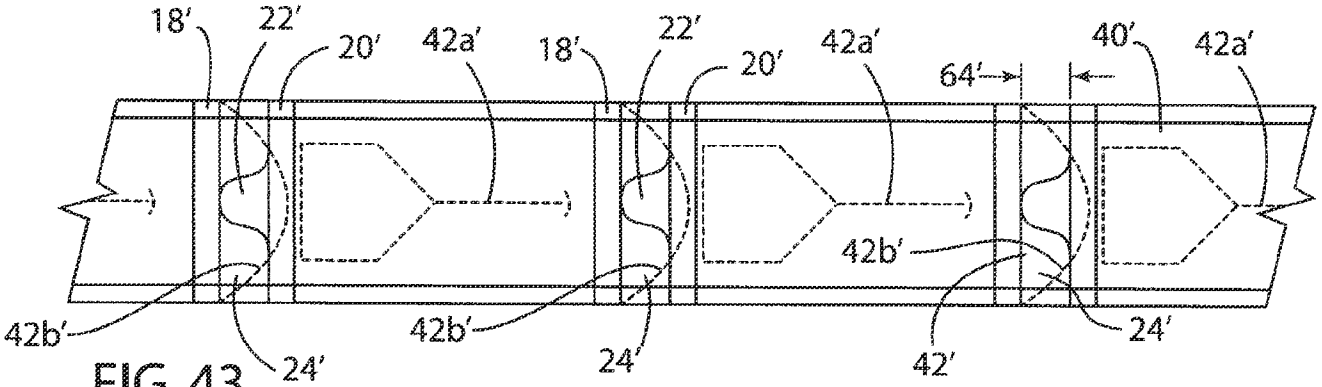
FIG. 43 is a plan view of a series of scored film packages subsequent to formation of end seals with a seal jaw.

As noted, the label 40' can be applied continuously along the longitudinal length of the flow or web of the film 12'. Once the products are at least partially enveloped and sealed within the web of film 12', the film and label laminate may be cut into individual packages. FIGS. 41 and 42 illustrate a series of formed packages that have not been separated from one another. In one illustrative configuration, the tabs 22' may be formed, in part, by an arcuate score 42*d'* formed, in part, on a roll of film, and disposed at least partially at leading end seal 20'. When the individual packages are cut from the roll of laminate, a leading edge or profile of the tab 22' may be formed. For example, the leading seal on a first package has a profile matching a trailing seal on a second package. Thus, the tab 22' may have a front edge that is arcuate and defined, in part, by the leading edge of the package and may have a rear, trailing edge that is arcuate and defined, in part, by the arcuate score line 42*d'*.

As discussed herein, the method of manufacturing and assembling the packages can employ heat seal mechanisms, cold seal mechanisms, extrusion and adhesive lamination mechanisms, and co-extrusion mechanisms. The equipment employed may depend on the desired package configuration. For example, if tab 22' includes a cut-out portion of film 12' adhered to the label 40', the tab 22' may be created by adhering or applying the label 40' to the film 12' and scoring and/or cutting the tab 22'. In addition, various score configurations may be employed, and the equipment for forming the score line may depend on the score configuration thereof.

The exemplary method 60' of making packages, shown in FIG. 44, may include a package apparatus that positions the film above or adjacent the product, then wraps the film partially around the product to form a fin seal on one side of the product. As shown, film 12' and label 40' (which may be transparent) are joined or merged form their respective feed rolls. Prior to merging label 40', film 12' may be scored at 52' on the film surface directed to the interior of the package, though the top surface also could be scored. In another configuration, the label 40' is preferably merged to the film 12' prior to the score station 52'. As noted above, the score may be firmed in a variety of manners. The fin seal 14' may be formed as the film 12' and label 40' laminate form a container or box 34' around the product 46' (see, also, FIG. 45). Though fin seal 14' is oriented on the bottom of package 10' in FIGS. 44 to 45, it may be oriented on any side of package 10'.

In one approach, heated wheels may be pressed together to form the package seals. For example, if sealant layers are employed, the heat may activate the heat sealant layer on the interior surface of the package. In one configuration, an EVA sealant layer is disposed on the film 12', and the heated wheels may be heated to between about 85 and 205 degrees Celsius. As noted above, line speed, film thickness, and other factors may affect formation of the seals, including a seal's peelability and hermeticity.

FIG. 44 illustrates that, once the film 12' has at least partially enveloped product 46', end seals 18', 20' can be formed by adjacent upper and lower seal jaws 62', as discussed below. The seal jaws 62' may form end seals of the package (such as heat seals) and also may form or define the tabs 22', such as, for example, the tab portion between the end seals 18', 20'. In configurations with activated heat seals, seal jaws 62' may be warmed by a heater element (not shown). In addition, separate heating elements are possible where different levels of peelability are desired between trailing end seal 18' and leading end seal 20'. In addition, a knife assembly may be used to fully separate individual packages or, alternatively, partially cut or perforate a portion between the packages to hold them together while providing a convenient manner of separating the packages when desired.

The fin seal 14' and end seals 18', 20' optionally may be formed from patterns imprinted on heated wheels 38' or seal jaws 62', which may emboss the film 12' as it is pulled through the manufacturing process. For example, the seal jaws 62' may rotate with the film web 12' as it moves through the production line and the seal jaws 62' may meet to form end seals 18', 20' and the seal jaws 62' also may form the tab 22' and/or separate the packages from the film. Alternatively, the film 12' may be cut with a tab cutter die. As the seal jaw 62' forms a leading end seal 20' on one package, the seal jaw 62' may form a trailing end seal 18' on another package. In a configuration where the seal jaws 62' form both the trailing end seal 18' and leading end seal 20' in the same operation, a space will be provided in the die where the film 12' is not sealed together. This space corresponds to the space 42' between the seals of adjacent packages. The free, unsealed portions of the packages 10' between the end seals 18' 20' of adjacent packages (illustrated at 42' in FIG. 43) may have a dimension 64' that is about 6 to 12 mm. The tab 22' is primarily formed in this portion of the package 10', though the rear, trailing edge may extend partially into the leading end seal 20'. If the seal jaws 62' form the two seals 18', 20' of adjacent packages at the same time, the dimension 64' is defined by the distance between the end seal areas on the die. Alternatively, the two end seals 18', 20' could be formed by two separate dies (as opposed to a single die with two separate sealing areas for the two end seals) or a single sealing die that is repeatedly applied to the film to form the two end seals.

Optional or alternative features also may be incorporated into the packages described herein. For example, an optional frame 32', as shown in FIG. 37, may be added to the package. The film 12' may be wrapped around the frame 32' to provide protection to the product 44'. Additional configurations, such as a vertical bag package, also may use the seal and reseal features described, especially for use with particular products, such as coffee.

Other alternative features may include a discrete label, as opposed to the continuous closure layer or label. A discrete, registered label may be applied to the package 10' and the other seal and reseal features may be incorporated therein. For example, FIG. 37 shows a package 10' having a discrete label 54' that may be applied between the end seals 20' and 18'. An unsealed area can extend past leading end seal 20. FIG. 38 illustrates another package 10' having a discrete label 54' applied to film 12' so that one end of the label 54' can be sealed to the trailing end seal 18' of the package 10' such that the discrete label may not be easily removed from the package 10'.

Though the embodiments of FIGS. 31 to 50 were described as having a fin seal, a lap seal also may be employed. A lap seal can be formed by first overlapping a first and second surface of the film (typically adjacent the edges of the film) to form a sleeve (as opposed to overlapping in the same surface for a fin seal).

Figure 51:
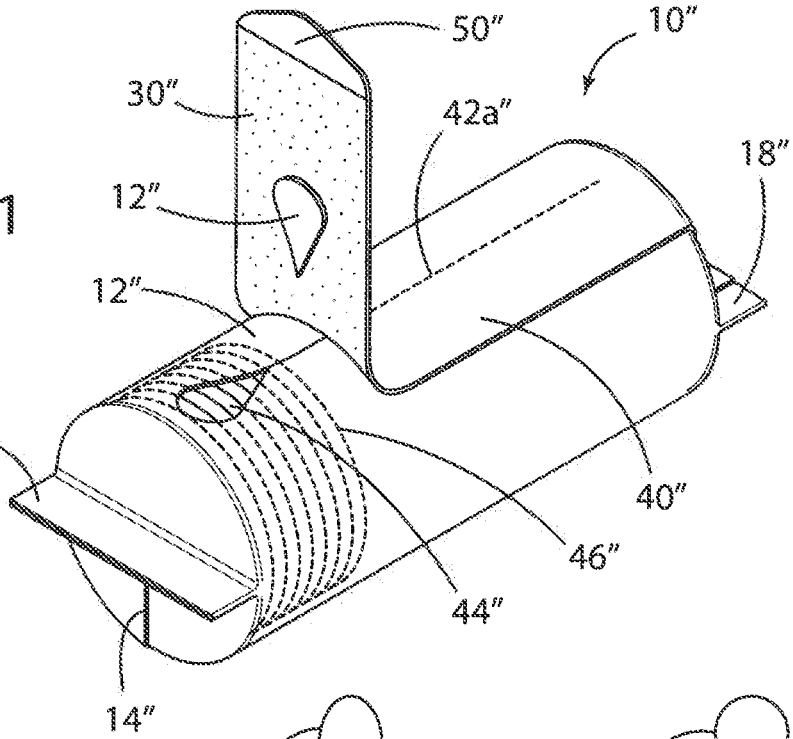
FIG. 51 is a perspective view of another flexible film package.
Figure 68:
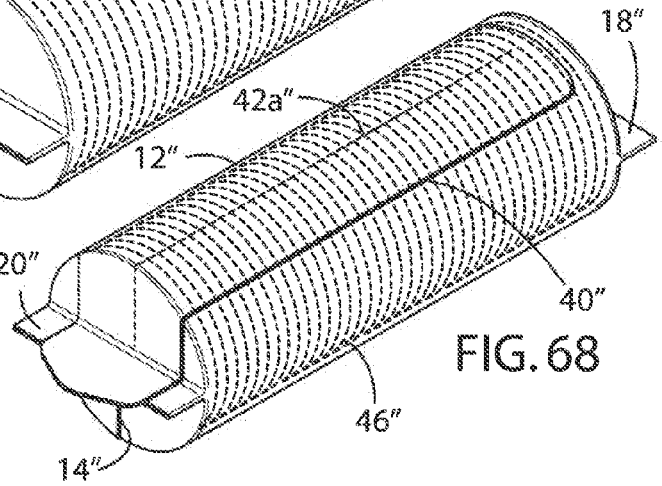
Figure 69:
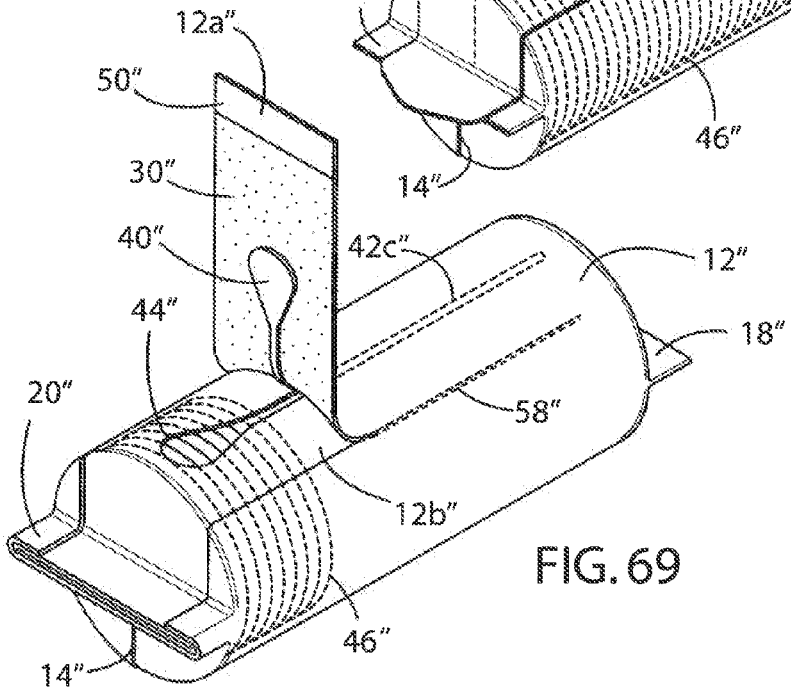
FIG. 69 is a perspective view of a flexible film package in a partially open configuration.

FIG. 51 illustrates another flow-wrap package 10". Package 10" is formed by joining opposite sides of the film to form a seal (shown as a fin seal 14"). The film 12" preferably has a sealant layer on an interior surface thereof. In addition, a trailing end seal 18" and a leading end seal 20" are also provided. In one configuration, the leading end seal 20" is non-peelable. Package 10" may be formed in a continuous application operation, such as those described above with respect to FIG. 1, or may be formed in a process employing inner and outer die cuts (see, e.g., FIG. 69), or also may be formed in a discrete label application (see, e.g., FIG. 68).

Figure 56:
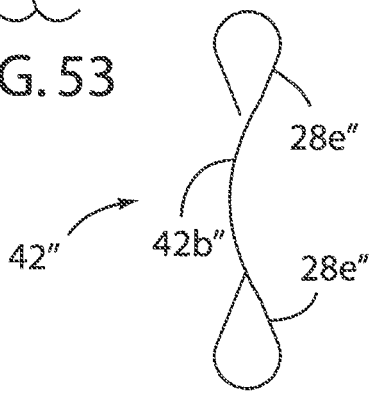

As discussed above, score lines tend to propagate a tear being formed in the film, and thus, the score may be configured to inhibit or prevent unintended tearing of the film. The score 42" may have a pattern to reduce this tendency including, for example, a double "J" hook (FIG. 53), a "smile" (FIG. 54), or a "tear drop" (FIG. 56). In addition, a shepherd's hook and a single "J" hook may be employed.

Figure 52:
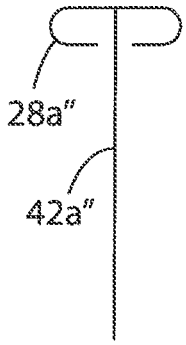
FIGS. 52 to 56 are film score patterns for flexible film packages.
Figure 53:
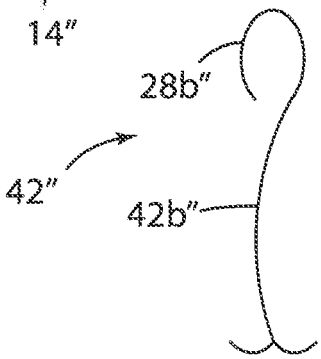
Figure 54:
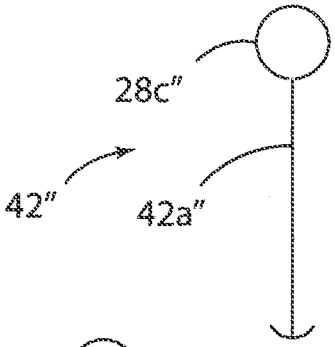
Figure 55:
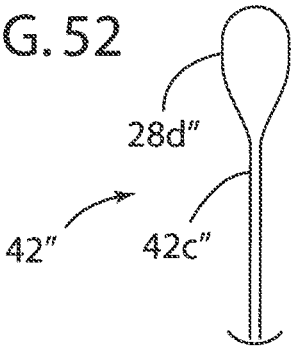

FIGS. 52 to 56 illustrate various film score patterns 42" that may be incorporated into the film packages disclosed herein. FIG. 52, for example, illustrates a "T" shaped score 42" having a straight portion 42*a*" along with shaped opening portions 28*a*". FIG. 53 illustrates a "J" hook-shaped score that has an arcuate portion 42*b*" and a shepherd's hook configuration 28*b*" at one end and two "smile" portions or "J" hooks at the other end. FIG. 54 illustrates a score 42" having a circular-shape or loop opening 28*c*" and a generally straight section 42*a*" that terminates at a "smile" portion. FIG. 55 illustrates a score 42" with a spoon-shaped configuration 28*d*" that reduces to two generally straight and substantially parallel score lines 42*c*" that terminate in a "smile" configuration. When parallel scores are formed in film 12", such as those illustrated in FIG. 55, the parallel score lines are preferably not more than 5 mm apart from one another. FIG. 56 illustrates a score 42" having a shepherd's hook configuration 28*e*" at each end and an arcuate portion 42*b*" therebetween.

Depending on the score 42" incorporated into the package, the opening created by the score 42" may permit the package opening to be sufficiently large enough to easily serve and access a substantial portion of the product contained therein. Further, in some configurations, the tendency of the flexible film to create a significant opening is, in part, due to the tendency of the flexible film to revert back to its flat sheet form. This tendency may be especially evident for discrete stacks of generally round or oval-shaped products, such as a sleeve of round cookies, crackers, or biscuits, to note but a few. This occurs primarily when no frame is used within the flexible film of the package.

Figure 63:
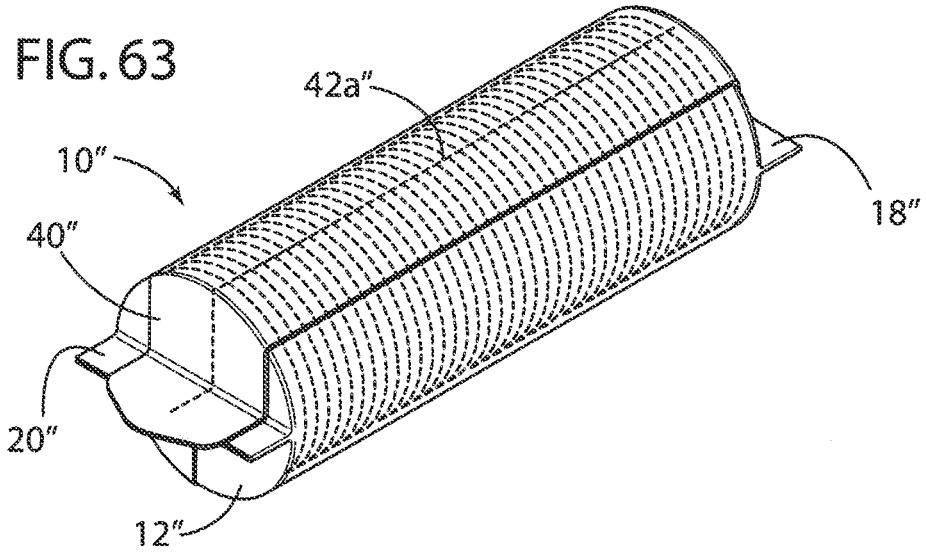
FIGS. 63 to 68 are perspective views of flexible film packages in closed configurations.
Figure 64:
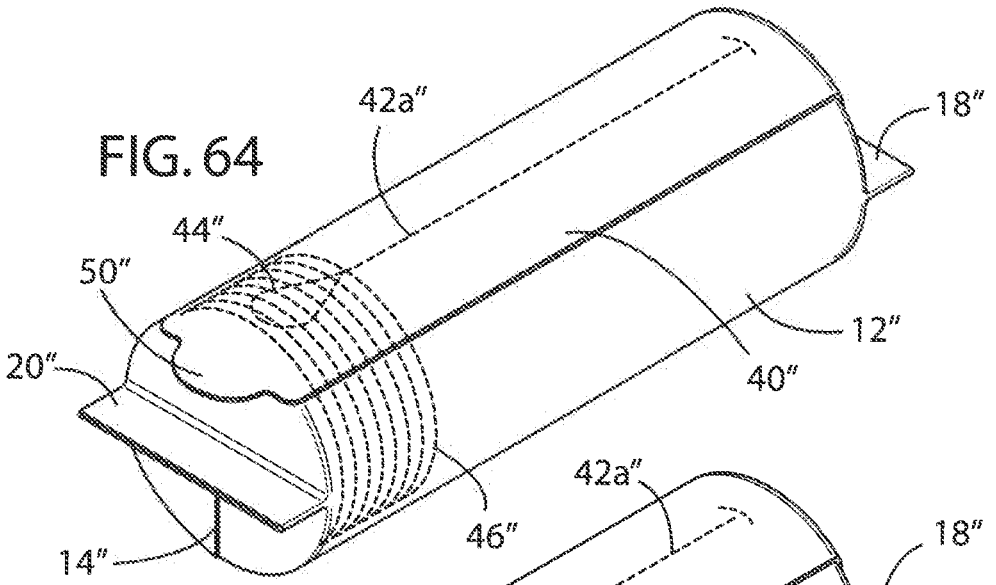
Figure 65:
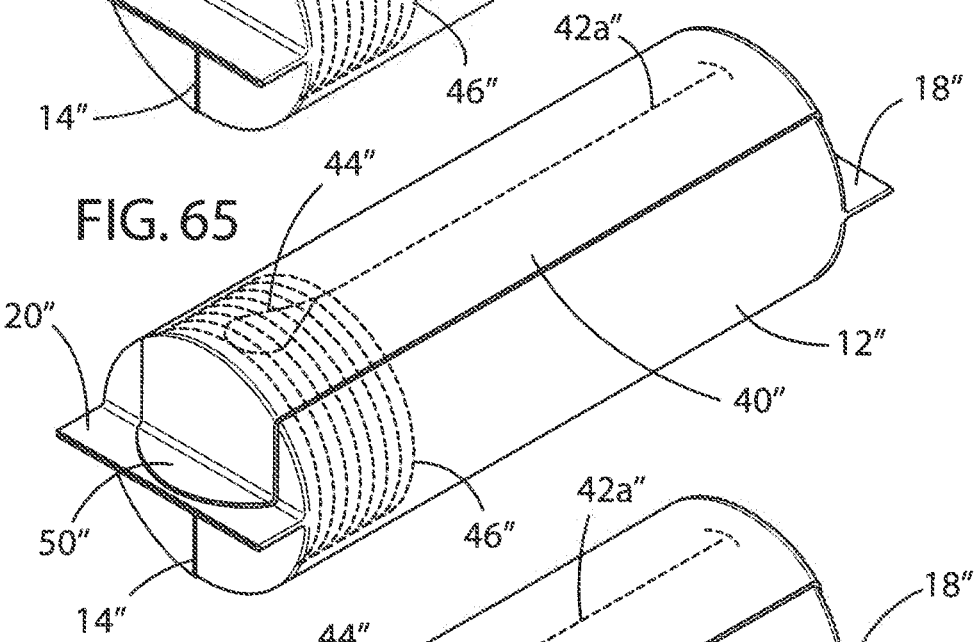
Figure 66:
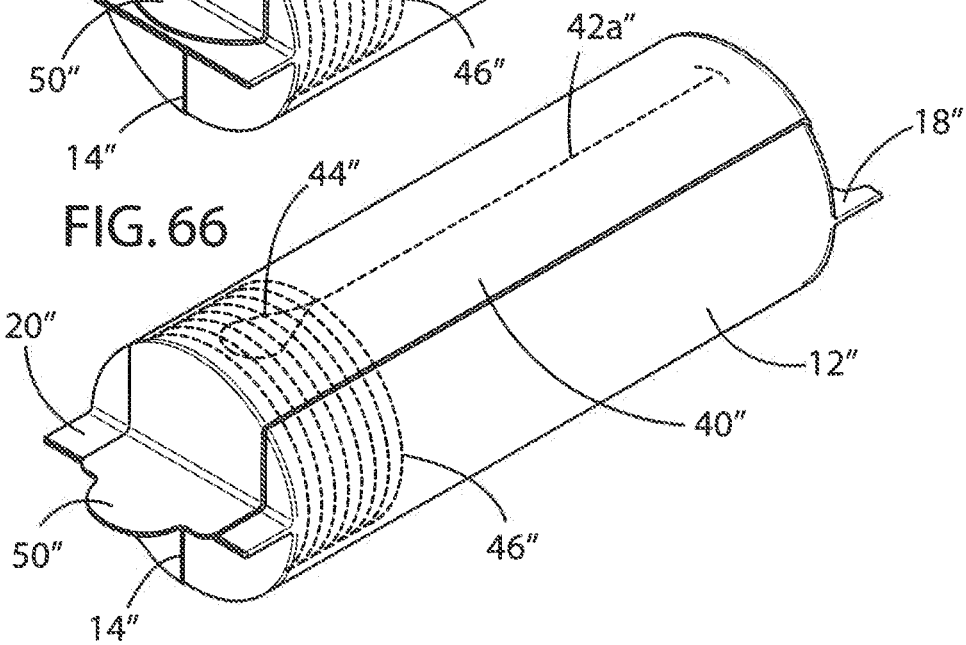
Figure 67:
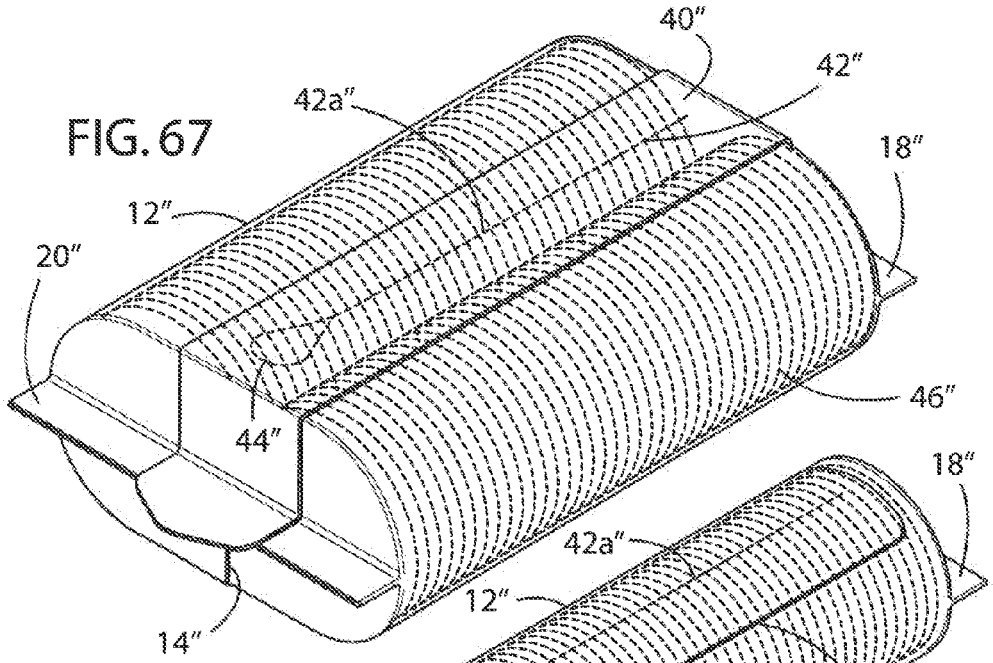

Alternatively, the score 42" may include a straight line extending longitudinally completely or partially along the length of the package, as shown in FIG. 63. In one configuration, the score 42" may be continuously formed in the package film 12", and at the point where the end seals 18", 20" are formed, the sealant in the films 12" may be melted at the heat seal, which may then render the score 42" non-functional at the end seals 18", 20" to prevent unintended opening of the package at the seals.

As discussed above, the leading end seal 20", like leading end seal 20', may have a tab 22" formed distal thereto. In one approach, the tab 22" can be a "v" shaped tab, though other configurations, such as a square shaped or radial shaped tab, are possible. The tab 22" provides a finger grip to initiate opening of the package 10". A trailing package edge may include a concave shape corresponding to the shape of the leading edge tab 22". The leading end seal 20" may be peelable, i.e., have sealant layers that are separable from one another.

As shown in FIG. 51, the label 40" may be grasped and pulled upward from the package 10" to expose score line 42*a*" and package opening 44". A pressure sensitive adhesive 30" is positioned between the label 40" and the film 12". As discussed above, a score may be provided through the film 12" at the tab 22" such that a portion of the flexible film 12" may separate from the remainder of the film to provide an adhesive-free grasping portion. In addition, the adhesive-free grasping portion may be formed by deadening the adhesive disposed upon the tab 22" or pattern applying the adhesive on the label 40" or film 12" such that no adhesive is disposed on the portion of label 40" that becomes tab 22".

Figure 57:
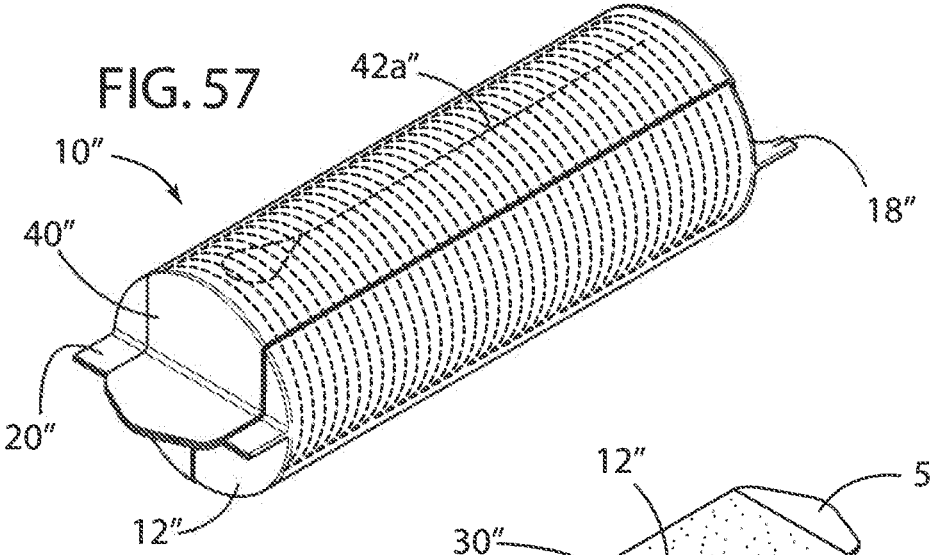
FIG. 57 is a perspective view of a flexible film package in an unopened configuration.
Figure 58:
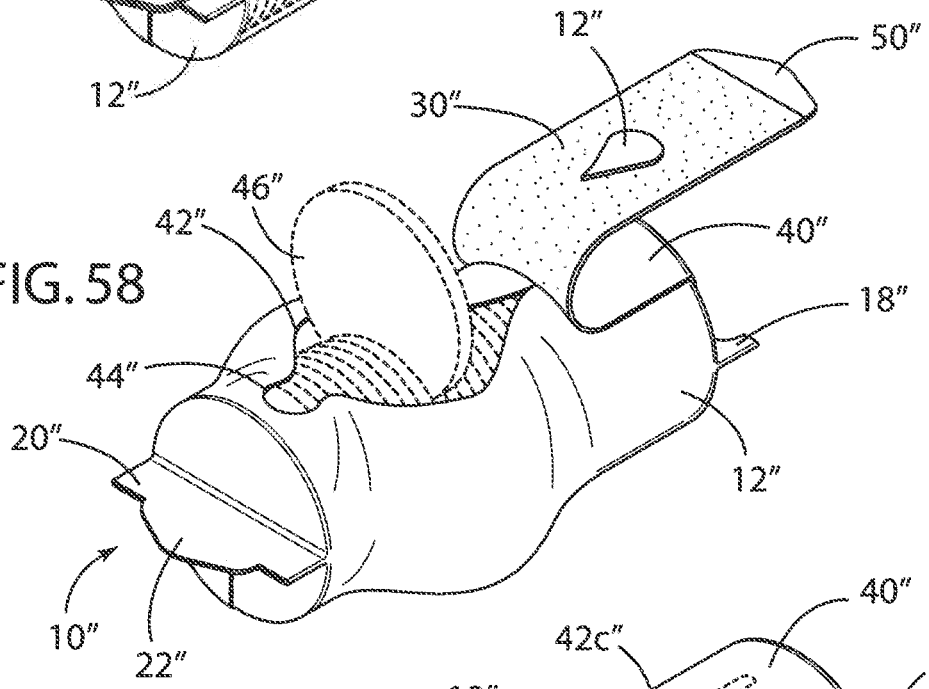
FIG. 58 is a perspective view of the flexible film package of FIG. 57 in an opened configuration.

FIG. 57 illustrates another package 10" having an unsealed inner surface 50" of the tab, which can be grasped by a consumer with one hand, while the package may grasped with the other. The label 40" may then be pulled backward to expose opening 44", as shown in FIG. 51. The label 40" is preferably not pulled entirely off package 10" during use, and therefore, the trailing end seal 18" may be form a non-peelable or permanent seal between the label 40" and the film 12". Alternatively, in some configurations, it is anticipated that both ends of the package 10" will be able to have label 40" peeled upwards, and thus, both end seals may be peelable. For example, the score 42" illustrated in FIG. 6 may be used along with a label 40" and two tabs at both ends of the package 10". This permits a user to open the package 10" at either end with resealable seals provided for both openings.

As discussed above, package 10" may be formed in a variety of processes. In one illustrative package illustrated in FIG. 69, a laminated film 12" has at least two polymer film layers 12*a*" and 12*b*" attached with a pressure sensitive adhesive 30". The film layer 12*a*" may have a score 58" formed therein to create a label 40". The film layer 12*b*" may have a score 42" formed therein to define opening 44". The score formation may occur before or after lamination of the film layers 12*a*, 12*b*, but preferably after lamination. In this configuration, the film thickness may be in the rage of about 1.8 to 3.0 mils. By one approach, the film may be about 2.1 mils for this type of configuration.

Figure 60:
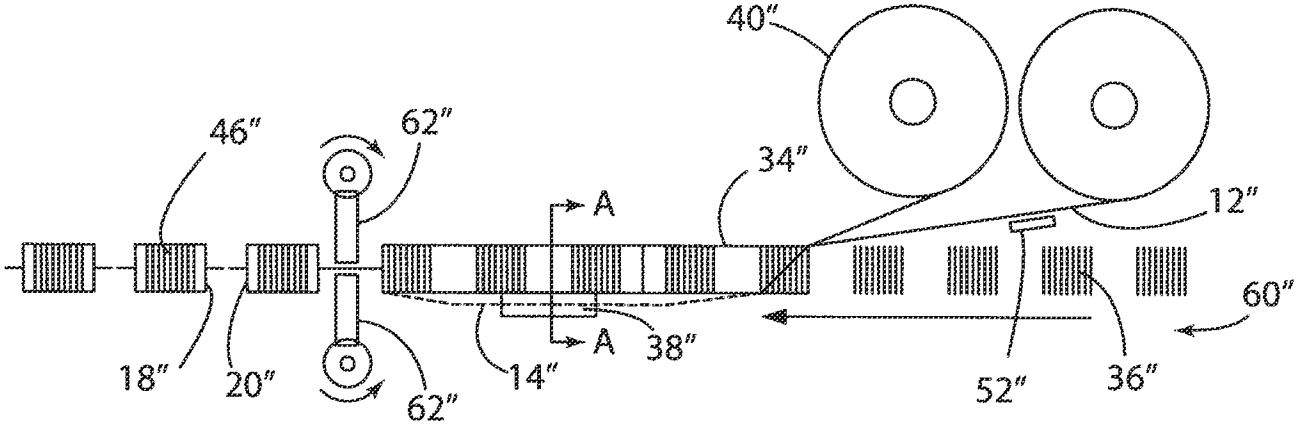
FIG. 60 is a schematic side view of a process for forming flexible film packages with a scored flexible film and a continuous label.
Figure 61:
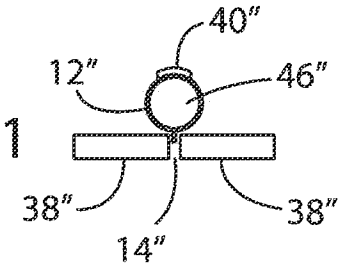
FIG. 61 is a schematic cross section of a fin seal jaw.
Figure 62:
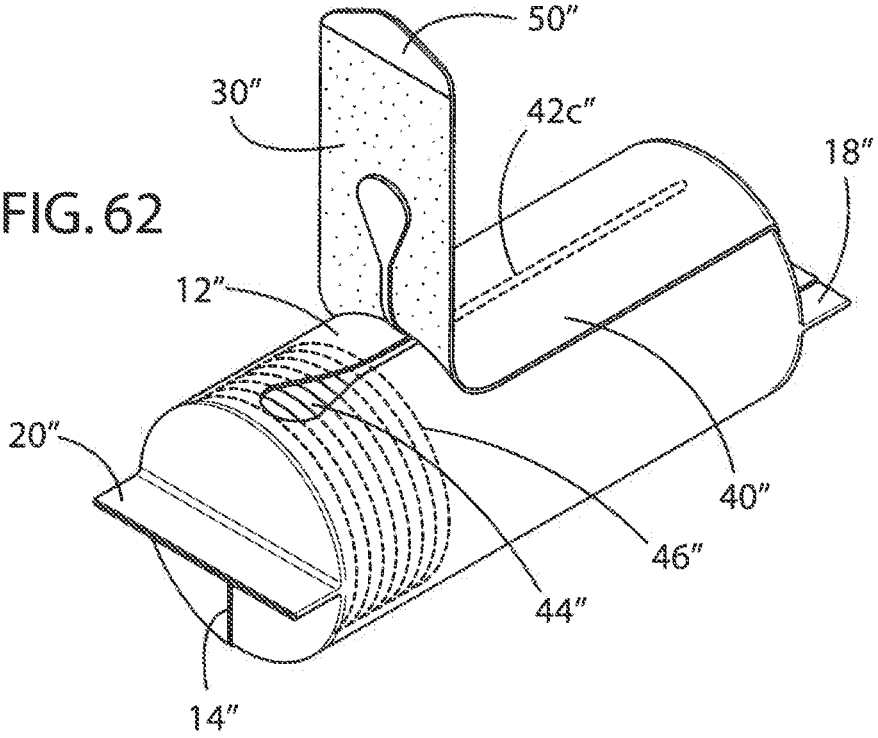
FIG. 62 is a perspective view of another flexible film package in a partially open configuration.

One exemplary manner of forming film packages 10" is illustrated as 60" in FIG. 60. Process 60" is similar to that discussed above and illustrated in FIG. 44. FIG. 61 illustrates a schematic cross section of the seal jaws that may be employed with process 60".

The various configurations of the flexible film package disclosed herein may be provided a package integrity feature that would indicate to a consumer whether or not the package has been previously opened.

Figure 59:
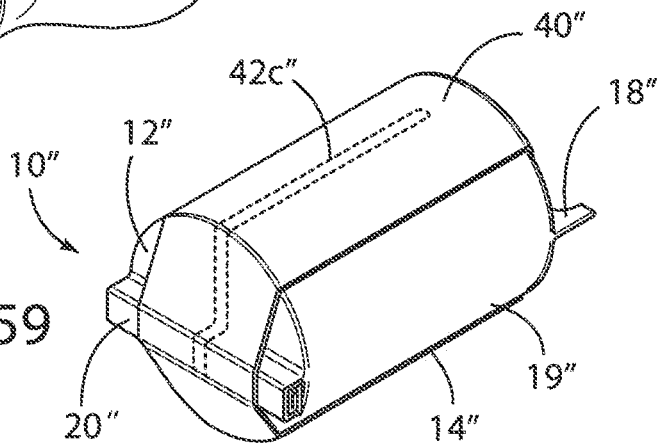
FIG. 59 is a perspective view of another flexible film package in a resealed or reclosed configuration.

By one approach, after the consumer has removed some of the products from the flexible film package, the flexible film may be rolled, folded, or otherwise flattened to evacuate air from inside of the package. Then, the elongated closure layer 14 may be wrapped over the rolled film and the product within the package making the package smaller, with less air space and, thus, may improve shelf-life of the product (see, e.g., FIG. 59). Such configurations are generally employed for packages without a structural support, such as a frame or tray; however, it is also anticipated that such a configuration may be employed with certain structural supports, depending on the configuration of the structural support and the flexible film.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

We claim:

1. A package comprising:

a flexible film defining an interior contents cavity and having a first pair of opposing edge portions forming a first seal, a second pair of opposing edge portions forming a second seal, and a third pair of opposing edge portions forming a longitudinal seal extending from the first seal to the second seal;

a score in the flexible film defining an opening to the contents cavity upon initial opening;

an elongated reclosure layer spaced from the third edge portions and extending from the first seal to the second seal, the elongated reclosure layer extending over the score and configured to be at least partially removed from the flexible film to expose the opening to the contents cavity;

a pressure sensitive adhesive between the flexible film and the elongated reclosure layer; and the elongated reclosure layer having a tack free gripping portion graspable to permit a user to expose the opening to the contents cavity, wherein the tack free gripping portion is formed, in part, by a tab score cut into the flexible film adjacent the first seal such that the tab score permits a portion of the flexible film to separate from a remainder of the flexible film, wherein the tack free gripping portion extends beyond the first seal, and wherein the flexible film and the elongated reclosure layer are separate and distinct layers.

2. The package of claim 1 wherein the tack free gripping portion has a first shape and the second seal has a portion removed having a second shape.

3. The package of claim 2 wherein the first shape and the second shape are the same.

4. The package of claim 1 wherein the tack free gripping portion comprises an arcuate leading edge.

5. The package of claim 4 wherein the arcuate leading edge extends across an entire width of the elongated reclosure layer.

6. The package of claim 1 wherein the flexible film has a predetermined width dimension between the third pair of opposing edge portions, and the elongated reclosure layer extends over less than half of the predetermined width dimension.

7. The package of claim 1 wherein the elongated reclosure layer extends beyond the score to cover sufficient marginal space around the score to effectively reseal the opening once the score has been initially opened.

8. The package of claim 1 wherein the elongated reclosure layer comprises a label.

9. The package of claim 1 wherein the elongated reclosure layer comprises a second flexible film and the pressure sensitive adhesive being disposed between the flexible film and the second flexible film.

10. The package of claim 1 wherein the flexible film comprises a laminate structure.

11. The package of claim 10 wherein the flexible film comprises a co-extruded film structure.

12. The package of claim 1 wherein the score is through a thickness of the flexible film.

13. The package of claim 1 wherein the score is disposed partially through a thickness of the flexible film.

14. The package of claim 1 further comprising a tray disposed within the package.

15. The package of claim 1 wherein the first seal comprises a non-peelable seal.

16. The package of claim 1 wherein the first seal comprises a peelable seal.

17. The package of claim 16 wherein the score extends into the peelable seal.

18. The package of claim 1 wherein the second seal comprises a non-peelable seal to inhibit removal of the elongated reclosure layer from the flexible film.

19. The package of claim 1 further comprising a plurality of discrete food products disposed within the package.

20. The package of claim 19 wherein as the plurality of discrete food products are removed from the package, the flexible film is compacted, and the elongated reclosure layer wraps over the compacted film such that the pressure sensitive adhesive adheres to an opposite side of the package.

21. The package of claim 1 wherein the score in the flexible film defining the opening extends either straight or arcuate or a combination thereof.

22. The package of claim 1 wherein the score in the flexible film defining the opening comprises a pair of parallel score lines.

23. The package of claim 1 wherein the score in the flexible film defining the opening comprises a leading end portion configured to propagate a tendency to rupture.

24. The package of claim 1 wherein the score in the flexible film defining the opening comprises a trailing end portion configured to resist tearing of the flexible film beyond the score in the flexible film defining the opening.

25. The package of claim 24 wherein the trailing end portion of the score in the flexible film defining the opening is configured with one of a single J-hook, double J-hook, smile, Shepherd's hook, dovetail, and extension to the second seal.

26. The package of claim 1 wherein the score in the flexible film defining the opening comprises a U-shaped configuration.

27. The package of claim 1 wherein the score in the flexible film defining the opening is applied to an interior side of the flexible film.

28. The package of claim 1 wherein the tab score comprises a pattern of scores.

29. The package of claim 28 wherein the pattern of scores comprises at least one of a straight line or an arcuate line or a combination of both.

30. A laminate for producing flexible packages, the laminate comprising:

a continuous web of flexible film having a width between side edges thereof and a longitudinal axis extending transversely to the width;

a continuous reclosure layer applied to the continuous web of flexible film along the longitudinal axis thereof with a pressure sensitive adhesive, the continuous reclosure layer being applied on a portion of the width of the continuous web of flexible film spaced from the side edges thereof; and the continuous web of flexible film and the continuous reclosure layer configured to be formed into a series of identical packages, the flexible film of each identical package having a first score formed therein, the reclosure layer extending over the first score and configured to be at least partially removed from the flexible film which subsequently forms a package opening; and each identical package having an adhesive free gripping portion subsequently defined, in part, by a second score in a transition area between adjacent packages, wherein the continuous web of flexible film and the continuous elongated reclosure layer are separate and distinct layers.

31. A flexible film package comprising:

a flexible film having two opposing edge portions forming a longitudinal seal extending from a first seal to a second seal;

a score in the flexible film that defines a package opening upon initial opening;

an elongated reclosure layer spaced from the edge portions and extending from the first seal to the second seal, the elongated reclosure layer extending over the score and configured to be at least partially removed from the flexible film to expose the package opening;

a pressure sensitive adhesive between the flexible film and the elongated reclosure layer; and the elongated reclosure layer having a tack free gripping portion graspable to permit a user to expose the package opening, the tack free gripping portion disposed outside of the first seal and the tack free gripping portion formed, in part, by a tab score in the flexible film, wherein the tack free gripping portion extends beyond the first seal, and wherein the flexible film and the elongated reclosure layer are separate and distinct layers.

32. A package comprising:

a flexible film defining an interior contents cavity and having a first pair of opposing edge portions forming a first seal, a second pair of opposing edge portions forming a second seal, and a third pair of opposing edge portions forming a longitudinal seal extending from the first seal to the second seal;

a cut in the flexible film defining an opening to the contents cavity upon initial opening;

an elongated reclosure layer applied to the flexible film intermediate of the third pair of opposing edge portions and extending from the first seal to the second seal and over the score, the elongated reclosure layer configured to be at least partially removed from the flexible film to expose the opening to the contents cavity;

a pressure sensitive adhesive between the flexible film and the elongated reclosure layer; and the elongated reclosure layer having a tack free gripping portion graspable to permit a user to expose the opening to the contents cavity, the tack free gripping portion formed, in part, by a tab score formed in the flexible film, wherein the tack free gripping portion extends beyond the first seal, and wherein the flexible film and the elongated reclosure layer are separate and distinct layers.

33. The package of claim 1, wherein the pressure sensitive adhesive is configured to remain attached to the elongated reclosure layer when the elongated reclosure layer is at least partially removed from the flexible film to expose the opening to the contents cavity.

34. The package of claim 1, wherein the pressure sensitive adhesive forms a peel strength between the flexible film layer and the elongated reclosure layer that is greater than the force required to separate the flexible film along the score.

35. The package of claim 1, wherein the tab score is formed to intersect with a separation cut that defines the leading edge of the package.

* * * * *